US009081353B2

(12) United States Patent
Tawada et al.

(10) Patent No.: US 9,081,353 B2
(45) Date of Patent: Jul. 14, 2015

(54) CLEANER, AND PROCESS CARTRIDGE AND IMAGE FORMING APPARATUS USING THE CLEANER

(71) Applicants: Takaaki Tawada, Kanagawa (JP); Takatsugu Fujishiro, Tokyo (JP); Kazuhiko Watanabe, Tokyo (JP); Hisashi Kikuchi, Kanagawa (JP); Naomi Sugimoto, Kanagawa (JP); Yuu Sakakibara, Kanagawa (JP)

(72) Inventors: Takaaki Tawada, Kanagawa (JP); Takatsugu Fujishiro, Tokyo (JP); Kazuhiko Watanabe, Tokyo (JP); Hisashi Kikuchi, Kanagawa (JP); Naomi Sugimoto, Kanagawa (JP); Yuu Sakakibara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/089,970

(22) Filed: Nov. 26, 2013

(65) Prior Publication Data

US 2014/0193172 A1 Jul. 10, 2014

(30) Foreign Application Priority Data

Jan. 10, 2013 (JP) ..... 2013-002658
Apr. 22, 2013 (JP) ..... 2013-089621
Jun. 6, 2013 (JP) ..... 2013-120003

(51) Int. Cl.
*G03G 21/00* (2006.01)

(52) U.S. Cl.
CPC ..... *G03G 21/0017* (2013.01); *G03G 21/0029* (2013.01)

(58) Field of Classification Search
CPC ..... G03G 21/0011; G03G 21/0017
USPC ..... 399/350, 123, 159, 346
See application file for complete search history.

(56) References Cited

U.S. PATENT DOCUMENTS

2002/0181983 A1 12/2002 Shakuto et al.
2003/0039494 A1 2/2003 Shakuto et al.
2005/0100375 A1 5/2005 Naruse et al.
2005/0164108 A1 7/2005 Murakami et al.
2005/0254868 A1 11/2005 Naruse et al.
2006/0099016 A1 5/2006 Watanabe et al.
2006/0285898 A1 12/2006 Watanabe et al.
2007/0105031 A1* 5/2007 Fukushima et al. ..... 399/159
2007/0242991 A1* 10/2007 Morita ..... 399/350
2008/0063448 A1 3/2008 Hozumi et al.
2008/0310897 A1 12/2008 Naruse et al.
2009/0123205 A1 5/2009 Watanabe et al.

(Continued)

FOREIGN PATENT DOCUMENTS

JP 63159865 A * 7/1988
JP 2011-197309 10/2011

OTHER PUBLICATIONS

JP 63159865 A, English Abstract, Rokutanzono et al., Jul. 1988.*

*Primary Examiner* — Ryan Walsh
(74) *Attorney, Agent, or Firm* — Harness, Dickey & Pierce P.L.C.

(57) ABSTRACT

A cleaner is provided. The cleaner includes a cleaning blade having an edge to be contacted with a surface of a member to be cleaned while moving relative to the member to clean the surface of the member. The cleaning blade includes the edge, and first and second side surfaces, wherein the edge is disposed between the first and second side surfaces. When the cleaning blade is not contacted with the surface of the member to be cleaned, the first side surface is opposed to the surface of the member, and when the cleaning blade is contacted with the surface of the member, the edge, and the first and second side surfaces of the cleaning blade are contacted with the surface of the member.

20 Claims, 11 Drawing Sheets

(56) References Cited

U.S. PATENT DOCUMENTS

| | | | | |
|---|---|---|---|---|
| 2009/0238589 | A1* | 9/2009 | Shigezaki et al. | 399/49 |
| 2010/0067945 | A1 | 3/2010 | Hozumi et al. | |
| 2010/0067949 | A1 | 3/2010 | Watanabe et al. | |
| 2010/0183972 | A1* | 7/2010 | Hasegawa et al. | 399/346 |
| 2011/0164908 | A1* | 7/2011 | Kashiwakura et al. | 399/346 |
| 2011/0229186 | A1 | 9/2011 | Okamoto et al. | |
| 2011/0229188 | A1 | 9/2011 | Watanabe et al. | |
| 2011/0229233 | A1 | 9/2011 | Watanabe et al. | |

* cited by examiner

PROJECTED IMAGE OF PARTICLE

PERIMETER: C1

AREA: S

CIRCLE WITH AREA OF S

PERIMETER: C2

AREA: S

CLEANER, AND PROCESS CARTRIDGE AND IMAGE FORMING APPARATUS USING THE CLEANER

CROSS-REFERENCE TO RELATED APPLICATIONS

This patent application is based on and claims priority pursuant to 35 U.S.C. §119 to Japanese Patent Applications Nos. 2013-002658, 2013-089621 and 2013-120003 filed on Jan. 10, 2013, Apr. 22, 2013 and Jun. 6, 2013, respectively, in the Japan Patent Office, the entire disclosure of which is hereby incorporated by reference herein.

TECHNICAL FIELD

This disclosure relates to a cleaner to clean a surface of a member to be cleaned, and to a process cartridge and an image forming apparatus using the cleaner.

BACKGROUND

In electrophotographic image forming apparatus, an image bearing member such as a drum-shaped photoreceptor is charged to form an electrostatic latent image, the electrostatic latent image is developed with toner to form a toner image on the image bearing member, the toner image is transferred onto a recording medium, and the toner image is then fixed to the recording medium. In this regard, foreign materials such as toner particles remain on the surface of the image bearing member after the toner image transferring process is performed. In order to prevent deterioration of image quality of the next toner image, a cleaner is provided to remove such foreign materials from the surface of the image bearing member. A cleaning blade, which is contacted with the surface of the image bearing member while moving relative to the image bearing member, has been typically used for the cleaner. JP-2011-197309-A discloses a cleaner which includes a cleaning blade in which plural layers including an edge layer are overlaid, wherein an edge of the edge layer is contacted with a surface of an image bearing member to clean the surface of the image bearing member. The cleaner has a property such that when the cleaner is used for a predetermined time while contacted with an image bearing member, the ratio (P160/P0) of the linear pressure (P160) of the edge layer to the image bearing member after 160 hours to the initial linear pressure (P0) is not lower than 90%, so that the cleaner can maintain the initial cleaning performance. In addition, physical properties of constitutional materials of the layers and thickness of the layers are specified therein.

FIG. 12A illustrates a conventional cleaning blade, and FIG. 12B is the cleaning blade cleaning a surface of an image bearing member. In an electrophotographic image forming apparatus, a photoreceptor 210 serving as an image bearing member moves (rotates) in a direction indicated by an arrow 220, and an electrostatic latent image is formed on the surface of the photoreceptor as the photoreceptor moves. After the electrostatic latent image is developed with toner to form a toner image on the photoreceptor, the toner image is transferred onto a recording medium such as a transfer paper. A cleaning blade 200 extends in a direction perpendicular to the moving direction 220 of the photoreceptor 210, and is arranged on a downstream side from a transferring device, which transfers the toner image from the photoreceptor to a recording medium, relative to the moving direction 220. The cleaning blade 200 rubs the surface of the photoreceptor 210 with the edge thereof to peel residual toner adhered to the surface of the photoreceptor, resulting in removal of the residual toner from the photoreceptor.

As illustrated in FIG. 12A, the cleaning blade 200 includes a right-angled edge 201, which is to be contacted with the surface of the photoreceptor 210, a first side surface 202, and a second side surface 203, wherein the edge 201 is present between the first and second side surfaces 202 and 203. When the cleaning blade 200 is in such a non-contact state as illustrated in FIG. 12A, the first side surface 202 is opposed to the surface of the photoreceptor 210. The cleaning blade 200 maintains this state when the cleaning blade is contacted with the surface of the photoreceptor 210.

FIG. 12B illustrates the cleaning blade 200 contacted with the surface of the photoreceptor 210. In this regard, the photoreceptor 210 moves in the direction 220, and when the edge 201 of the cleaning blade 200 is contacted with the surface of the photoreceptor 210, the edge is drawn by the photoreceptor toward the downstream side relative to the moving direction 220 (i.e., toward the first side surface 202) as illustrated in FIG. 12B. When the edge 201 is thus drawn by the photoreceptor 210, the edge portion is largely deformed and a wedge-shaped portion 204 is formed. The wedge-shaped portion 204, which is contacted with the surface of the photoreceptor 210, rubs the surface of the photoreceptor as the photoreceptor moves. In this case, the first side surface 202 is not contacted with the surface of the photoreceptor 210.

When the cleaning blade 200 is thus contacted with the photoreceptor 210, the contact area is relatively wide, and therefore the contact pressure is relatively low. Therefore, residual toner on the surface of the photoreceptor 210 tends to pass through the nip between the wedge-shaped portion 204 of the cleaning blade 200 and the surface of the photoreceptor, resulting in deterioration of the cleaning ability of the cleaning blade.

In this regard, when the hardness of the cleaning blade 200 is increased in order to prevent large deformation of the edge 201 and to decrease the area of contact of the cleaning blade with the surface of the photoreceptor 210, the cleaning blade tends to cause plastic deformation after long repeated use.

Recently, countermeasures such that a protective agent including an inorganic lubricant is applied on the surface of a photoreceptor, or toner including a lubricant including a fatty acid metal salt such as zinc stearate is used to enhance the abrasion resistance of the photoreceptor have been taken to enhance the cleaning property of the photoreceptor. However, even when such countermeasures are taken, it is hard to enhance the cleaning property of the photoreceptor if such a conventional cleaning blade as mentioned above, which forms a wedge-shaped portion at the edge thereof, is used.

FIGS. 13A and 13B illustrate the photoreceptor 210 on which a protective agent including an inorganic lubricant is applied to enhance the cleaning property of the photoreceptor, and the conventional cleaning blade 200 contacted with the surface of the photoreceptor. In FIGS. 13A and 13B, numerals 300 and 301 respectively denote residual toner and a protective agent.

As illustrated in FIG. 13A, when the edge 201 of the cleaning blade 200 is contacted with the surface of the photoreceptor 210, the edge 210 is largely deformed so as to have the wedge-shaped portion 204. Since the wedge-shaped portion 204 is contacted with the photoreceptor 210, the contact pressure of the cleaning blade 200 is relatively low, resulting in deterioration of the cleaning ability of the cleaning blade. Therefore, the protective agent 310 passes through the nip between the cleaning blade 200 and the surface of the photoreceptor 210 and remains on the surface of the photoreceptor 210.

FIG. 13B illustrates the state of the cleaning blade and the photoreceptor after the image forming operation is continued. Since the protective agent 310 continues to pass through the nip between the cleaning blade 200 and the surface of the photoreceptor 210, the protective agent 310 grows and enlarges on the surface of the photoreceptor, and therefore the residual toner 300 easily passes through the nip, thereby forming abnormal images such as white omissions and vertical streak images.

FIG. 14 illustrates an image forming apparatus in which a toner 340 including a lubricant including zinc stearate is used for improving the abrasion resistance of the photoreceptor 210 and which uses an intermediate transfer belt 250 moving in a direction indicated by an arrow 260 while being contacted with the surface of the photoreceptor. A toner image formed on the surface of the photoreceptor 210 by developing an electrostatic latent image thereon is transferred to the intermediate transfer belt 250. The toner image on the intermediate transfer belt 250 is then transferred onto a recording medium (not shown in FIG. 14). Numeral 270 denotes a developing roller to supply the toner 340 to the photoreceptor 210.

Such a toner 340 including a lubricant such as zinc stearate has a relatively low charge quantity (i.e., low charging ability), and when the toner is charged by the transfer current, the toner has a reverse charge (a positive (+) charge in FIG. 14), and the reversely charged toner is transferred to the intermediate transfer belt 250. Since the toner 340 has a relatively low charge quantity, the amount of the reversely charged toner and the charge quantity thereof are increased in the transferring process in which the toner image is transferred to the intermediate transfer belt 250. Therefore, the amount of residual toner, which remains on the surface of the photoreceptor 210 without being transferred, increases. Therefore, a relatively large amount of residual toner reaches the cleaning blade 200, i.e., the cleaning blade has to remove a relatively large amount of residual toner from the surface of the photoreceptor 210.

The cleaning blade 200 illustrated in FIG. 14 also causes such deformation as illustrated in FIG. 12 at the edge thereof, and the wedge-shaped portion 204 is formed. Since the wedge portion 204 is contacted with the surface of the photoreceptor 210, the contact pressure of the cleaning blade 200 is relatively low, resulting in deterioration of the cleaning ability of the cleaning blade. Therefore, the amount of toner passing through the nip between the cleaning blade 200 and the surface of the photoreceptor 210 increases, resulting in defective cleaning, thereby deteriorating the toner image quality.

FIG. 15 illustrates an image forming apparatus in which a toner 340 including a lubricant including zinc stearate is used to enhance the abrasion resistance of the photoreceptor 210 and the photoreceptor includes a particulate inorganic material 360 in a surface portion thereof to enhance the abrasion resistance thereof.

The photoreceptor 210 including the particulate inorganic material 360 has a rough surface 370. In addition, since the toner 340 including a lubricant such as zinc stearate has a relatively low charge quantity (i.e., low charging ability), the amount of toner, which is reversely charged by the transfer charger, increases. Therefore, the adhesion force of residual toner 340, which remains on the photoreceptor 210 without being transferred, increases.

The cleaning blade 200 illustrated in FIG. 15 also causes such deformation as illustrated in FIG. 12 at the edge thereof, and the wedge-shaped portion 204 is formed. Since the wedge portion 204 is contacted with the surface of the photoreceptor 210, the contact pressure of the cleaning blade 200 is relatively low. In addition, since the rough surface 370 is formed on the photoreceptor 210, the cleaning blade 200 is unevenly and unstably contacted with the surface of the photoreceptor 210, and therefore the amount of toner passing through the nip between the cleaning blade and the surface of the photoreceptor increases, resulting in defective cleaning, thereby deteriorating the toner image quality.

SUMMARY

This patent specification describes a novel cleaner. The cleaner includes a cleaning blade having an edge to be contacted with a surface of a member to be cleaned while moving relative to the member to clean the surface of the member. The cleaning blade includes the edge, and first and second side surfaces, wherein the edge is disposed between the first and second side surfaces. When the cleaning blade is not contacted with the surface of the member to be cleaned, the first side surface is opposed to the surface of the member, and when the cleaning blade is contacted with the surface of the member, the edge and the first and second side surfaces of the cleaning blade are contacted with the surface of the member to be cleaned.

This patent specification further describes a novel process cartridge. One example of the process cartridge includes an image bearing member to bear an electrostatic latent image on a surface thereof; a charger to charge the surface of the image bearing member; a developing device to develop the electrostatic latent image with toner to form a toner image on the surface of the image bearing member; and the above-mentioned cleaner to clean the surface of the image bearing member. The process cartridge is detachably attachable to an image forming apparatus.

This patent specification further describes a novel image forming apparatus. One example of the image forming apparatus includes an image bearing member to bear a toner image on a surface thereof; a transferring device to transfer the toner image onto a recording medium; and the above-mentioned cleaner to clean the surface of the image bearing member after the toner image on the image bearing member is transferred to the recording medium.

BRIEF DESCRIPTION OF THE SEVERAL VIEWS OF THE DRAWINGS

A more complete appreciation of aspects of the invention and many of the attendant advantage thereof will be readily obtained as the same become better understood by reference to the following detailed description when considered in connection with the accompanying drawings, wherein.

DETAILED DESCRIPTION

Figure 1:
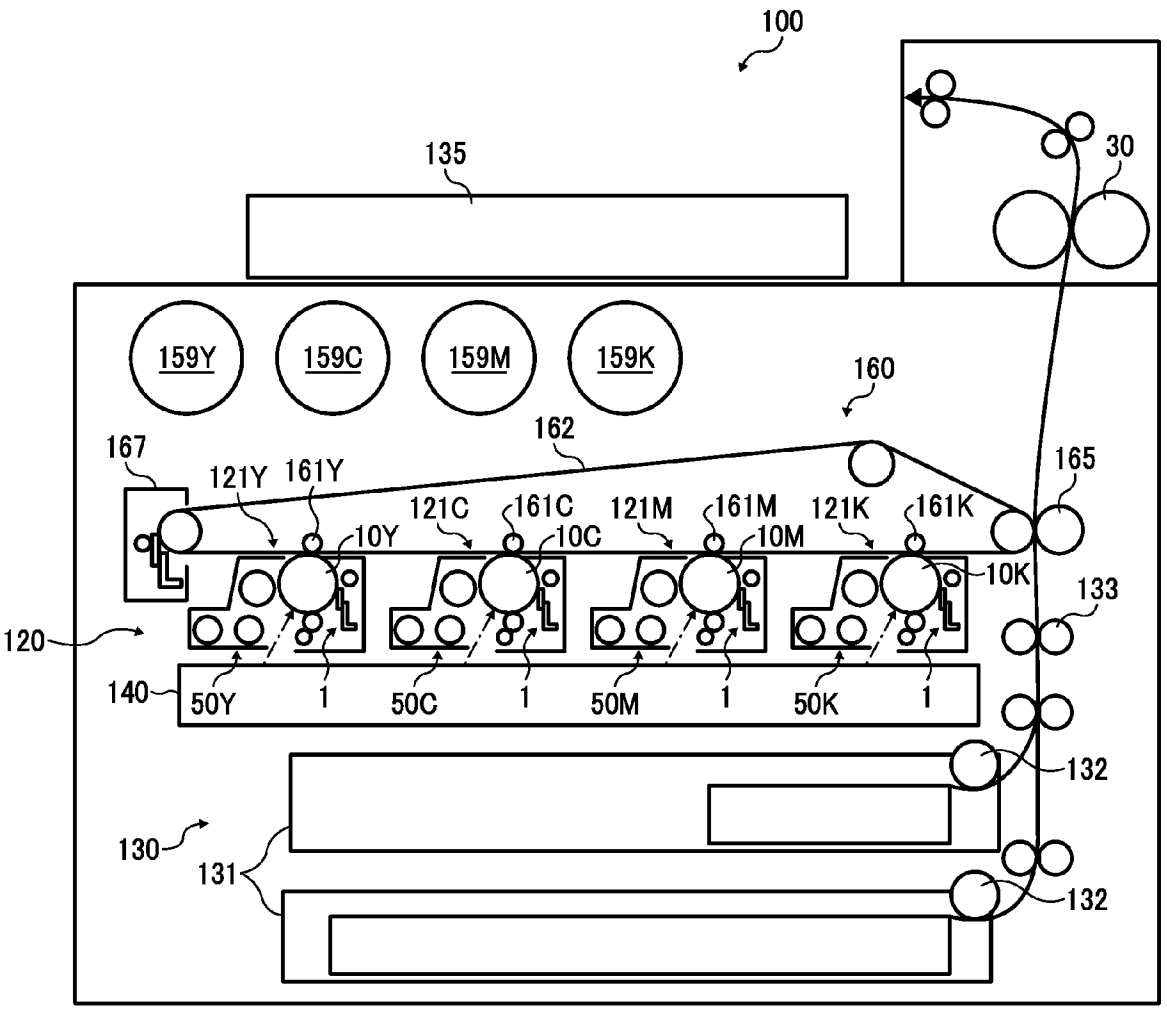
FIG. 1 is a schematic cross-sectional view illustrating a printer using a cleaner according to an embodiment.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

"Overlying" can include direct contact and allow for intermediate layers.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

The object of this disclosure is to provide a cleaner in which a cleaning blade is contacted with a member to be cleaned such as photoreceptors with a relatively large contact pressure without causing plastic deformation even after long repeated use, and to provide a process cartridge and an image forming apparatus using the cleaner.

Hereinafter, a first embodiment of this disclosure in which a cleaner according to an embodiment of this disclosure is applied to a printer serving as an electrophotographic image forming apparatus will be described. FIGS. 1-9 illustrate the first embodiment, and FIG. 1 illustrates a printer 100 as an image forming apparatus according to an embodiment.

The printer 100 is a full color printer, and includes an image forming section 120, a transferring device 160, and a recording medium feeding portion 130 as main devices. In the description below, members with a suffix Y, C, M or K are members for use in forming yellow, cyan, magenta or black images, respectively. The suffix is sometimes omitted when the suffix is not particularly necessary for description.

The image forming section 120 includes a process cartridge 121Y for forming yellow toner images, a process cartridge 121C for forming cyan toner images, a process cartridge 121M for forming magenta toner images, and a process cartridge 121K for forming black toner images, which are arranged side by side from the left side in FIG. 1. Each of the process cartridges 121 is detachably attached to the printer 100.

The transferring device 160 includes an endless intermediate transfer belt (a member to be cleaned) 162 supported by plural rollers, primary transfer rollers 161Y, 161C, 161M and 161K, and a secondary transfer roller 165. The intermediate transfer belt 162 is located above the process cartridges 121 and is arranged along drum-shaped photoreceptors 10Y, 10C, 10M and 10K of the process cartridges. The photoreceptors 10 serve as latent image bearing members (members to be cleaned), and rotate clockwise in FIG. 1. The intermediate transfer belt 162 moves in synchronization with movement of the surface of the photoreceptors 10. The primary transfer rollers 161 are arranged so as to be contacted with the inner surface of the intermediate transfer belt 162, and press the intermediate transfer belt 162 so that the outer surface of the intermediate transfer belt is weakly contacted with the outer surfaces of the photoreceptors 10.

The process cartridges 121 perform substantially the same image forming operation in which a toner image (Y, C, M or K toner image) is formed on the photoreceptor 10, and the toner image is transferred onto the intermediate transfer belt 162 except that a swing mechanism to swing the primary transfer roller 161 up and down is used for each of the primary transfer rollers 161Y, 161C and 161M, but the swing mechanism is not provided for the primary transfer roller 161K. The swing mechanisms operate to release the intermediate transfer belt 162 from the photoreceptors 10Y, 10C and 10M when black (K) images are formed.

An intermediate transfer belt cleaner 167 is provided on a downstream side from the secondary transfer roller 165 and on an upstream side from the process cartridge 121Y relative to the moving direction of the intermediate transfer belt 162 to remove foreign materials such as residual toner adhered to the surface of the intermediate transfer belt.

In addition, toner cartridges 159Y, 159C, 159M and 159K to supply Y, C. M and K color toners to the process cartridges 121Y, 121C, 121M and 121K, respectively, are arranged side by side over the transferring device 160 in substantially the horizontal direction.

Further, an irradiator 140 to irradiate the charged photoreceptors 10 with laser light beams, which are modulated by image data to form electrostatic latent images, is provided below the process cartridges 121.

The recording medium feeding portion 130 is provided under the irradiator 140, and includes cassettes 131 each of which contains sheets of a recording medium such as transfer paper, and feeding rollers 132 each of which feeds the recording medium sheets one by one to a pair of registration rollers 133. The pair of registration rollers 133 timely feeds the recording medium sheet to the secondary transfer nip between the intermediate transfer belt 162 and the secondary transfer roller 165 so that the toner image on the intermediate transfer belt is transferred onto a proper position of the recording medium sheet.

A fixing device 30 to fix the toner image to the recording medium is provided on a downstream side from the secondary transfer nip relative to the feeding direction of the recording medium. In addition, discharging rollers, and a copy storage 135 to store the recording medium, which bears the fixed toner image thereon and which is discharged by the discharging rollers, are provided on a downstream side from the fixing device 30.

Figure 2:
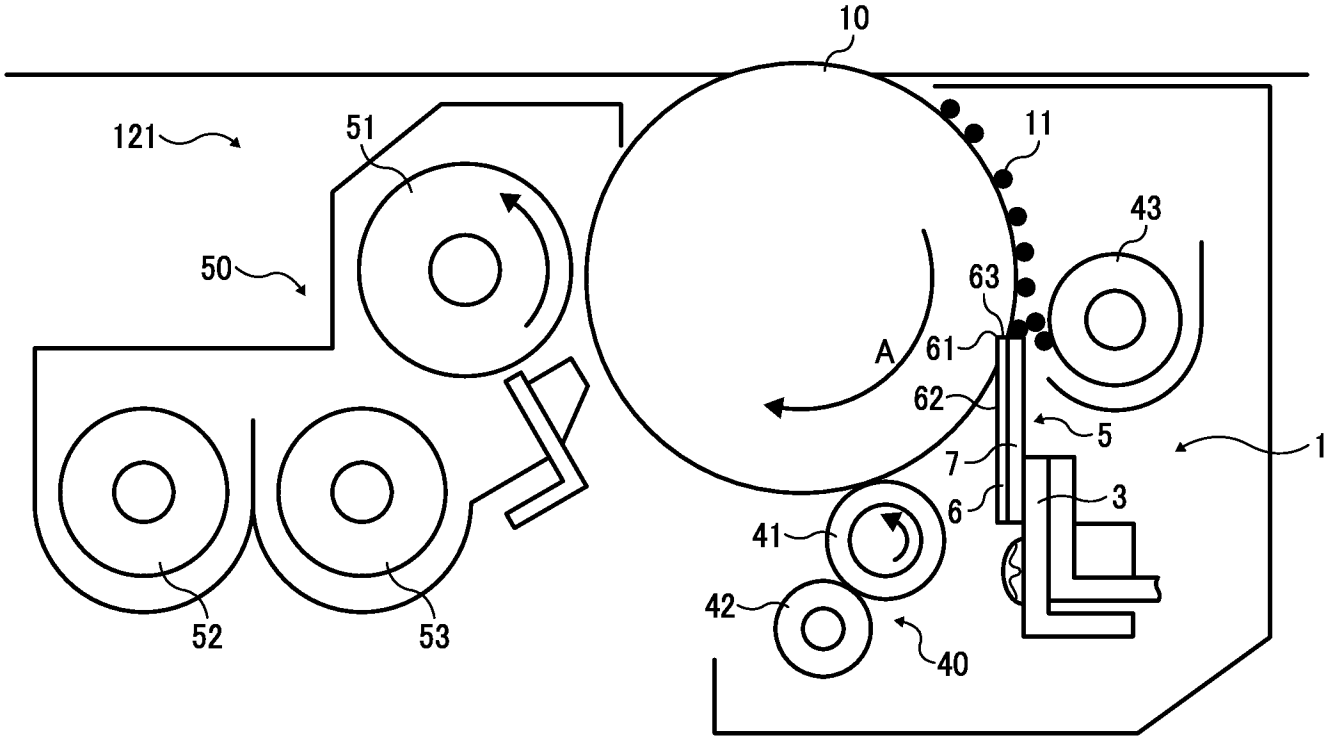
FIG. 2 is a schematic cross-sectional view illustrating a process cartridge of the printer in which an example of the cleaner is incorporated.

FIG. 2 illustrates the process cartridge 121 of the printer 100. In this regard, since the process cartridges 121Y, 121C, 121M and 121K have substantially the same configuration, hereinafter the structure and the operation of the process cartridge will be described by eliminating the suffixes Y, C, M and K.

The process cartridge 121 includes the drum-shaped photoreceptor 10, and a cleaner 1, a charger 40, and a developing device 50, which are arranged in the vicinity of the photoreceptor.

The cleaner 1 includes a cleaning blade 5, which is a long member made of an elastic material and extending in the direction parallel to the rotation axis of the photoreceptor 10, and an edge of the cleaning blade extending in the direction parallel to the rotation axis of the photoreceptor is pressed to a surface of the photoreceptor 10 to peel foreign materials (such as residual toner), which are adhered to the surface of the photoreceptor, from the surface of the photoreceptor. The foreign materials thus peeled off by the cleaner are discharged from the cleaner 1 by a screw 43.

The charger 40 includes a charging roller 41 opposed to the photoreceptor 10, a charging roller cleaner 42 which is contacted with the charging roller and is rotated thereby.

The developing device 50 visualizes an electrostatic latent image on the photoreceptor 10 by supplying a toner thereto, and includes a developing roller 51 serving as a developer bearing member to bear the developer including a toner and an optional carrier. In addition, the developing device 50 includes an agitation screw 52 to feed the developer contained in a developer container while agitating the developer, a supplying screw 53 to feed the agitated developer to supply the developer to the developing roller 51.

Each of the four process cartridges 121 can be detached from and attached to the printer 100 by a user or a service man. Each of the photoreceptor 10, the charger 40, the developing device 50 and the cleaner 1 of the process cartridge 121 detached from the printer 100 can be replaced with a new device. Alternatively, the process cartridge 121 detached from the printer 100 may be replaced with a new process cartridge. The process cartridge 121 can include a waste toner tank to contain the residual toner collected by the cleaner 1. In this regard, it is preferable that the waste toner tank can be detachably attachable to the process cartridge 121.

Next, the operation of the printer 100 will be described.

When the printer 100 receives a print order from an operation panel (not shown) or an external device such as personal computers, the photoreceptor 10 is rotated in a direction indicated by an arrow A (illustrated in FIG. 2), and the charging roller 41 of the charger 40 evenly charges the surface of the photoreceptor 10 so that the photoreceptor has a charge with a predetermined polarity. Next, the irradiator 140 irradiates the charged photoreceptor 40 with laser beams which are modulated by Y, C, M and K color image data to form electrostatic latent images corresponding to the color images on the corresponding photoreceptors. The developing rollers 51 of the developing devices 50 supply the color developers to the electrostatic latent images to develop the electrostatic latent images with the color toners included in the developers, thereby forming Y, C, M and K color toner images on the corresponding photoreceptors 10.

Next, a transfer voltage having a polarity opposite to that of the toners is applied to the primary transfer rollers 161 to form a primary transfer electric field between the photoreceptor 10 and the primary transfer rollers while the primary transfer roller is weakly contacted with the intermediate transfer belt 162 to form primary transfer nips, thereby primarily transferring efficiently the color toner images onto the intermediate transfer belt. In this regard, the Y, C, M and K color toner images are transferred onto the intermediate transfer belt 162 so as to be overlaid, resulting in formation of a combined color toner image on the intermediate transfer belt.

Meanwhile, the recording medium in the cassette 131 is timely fed by the feeding roller 132 and the pair of registration rollers 133 to receive the combined color toner image on the intermediate transfer belt 162. A transfer voltage having a polarity opposite to that of the toners is applied to the secondary transfer roller 165 to form a secondary transfer electric field between the intermediate transfer belt 162 and the secondary transfer roller 165, and thereby the combined color toner image on the intermediate transfer belt is transferred onto the recording medium. The recording medium bearing the toner image thereon is fed to the fixing device 30 to fix the toner image to the recording medium upon application of heat and pressure thereto. The recording medium bearing the fixed toner image thereon is discharged by the discharging rollers so as to be stacked on the copy storage 135. The residual toners remaining on the photoreceptors 10 without being transferred are removed by the respective cleaners 1.

Next, the cleaner 1 will be described by reference to FIGS. 2-4.

As illustrated in FIG. 2, the cleaner 1 includes a blade holder 3, and a cleaning blade 5 supported by one surface of the blade holder, and is provided on an upstream side from the charger 40. As illustrated in FIGS. 2 and 3, the cleaning blade 5 has a layered structure such that a backup layer 7 is formed on the backside of an edge layer 6, which is to be contacted with a surface of the photoreceptor 10, and an edge of the cleaning blade 5 opposite to the edge portion supported by the blade holder 3 extends toward the photoreceptor which is a member to be cleaned. The edge layer 6 is located so as to be closer to the photoreceptor 10 than the backup layer 7 so as to be contacted with a surface of the photoreceptor. Due to contact of the edge layer 6 with a surface of the photoreceptor 10, foreign materials adhered to the surface of the photoreceptor are scraped off the photoreceptor.

Each of the edge layer 6 and the backup layer 7 is made of an elastic material such as urethane rubbers, and the elastic material of the edge layer has a higher hardness than the elastic material of the backup layer. Specifically, in this embodiment, the 100% modulus value of the elastic material of the edge layer 6 at 23° C. is greater than that of the elastic material of the backup layer 7. The 100% modulus value of the elastic material of the edge layer 6 at 23° C. is preferably from 6 MPa to 12 MPa.

Figure 3:
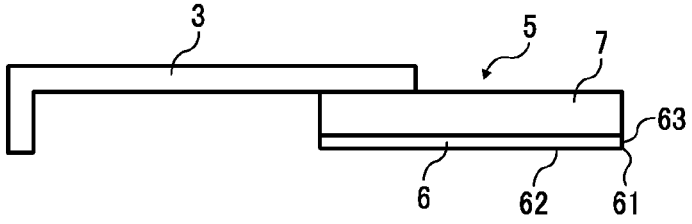
FIG. 3 is a schematic view illustrating a cleaning blade of the cleaner illustrated in FIG. 2.

As illustrated in FIG. 3, the edge layer 6 includes an edge (edge line) 61 extending in a direction perpendicular to the moving direction of the photoreceptor 10, and a first side surface 62 and a second side surface 63, which are located with the edge 61 therebetween. The edge 61 is contacted with a surface of the photoreceptor 10 to clean the surface of the photoreceptor. When the cleaning blade 5 is not contacted with the surface of the photoreceptor 10, the first side surface 62 is opposed to the surface of the photoreceptor. By using an elastic material having a greater 100% modulus value for the edge layer 6, the edge 61 contacted with the surface of the photoreceptor 10 deforms so as to be crushed as illustrated in FIG. 4, and therefore both of edge portions of the first and second side surfaces 62 and 63 close to the edge 61 contact the surface of the photoreceptor 10 at the same time.

Figure 4:
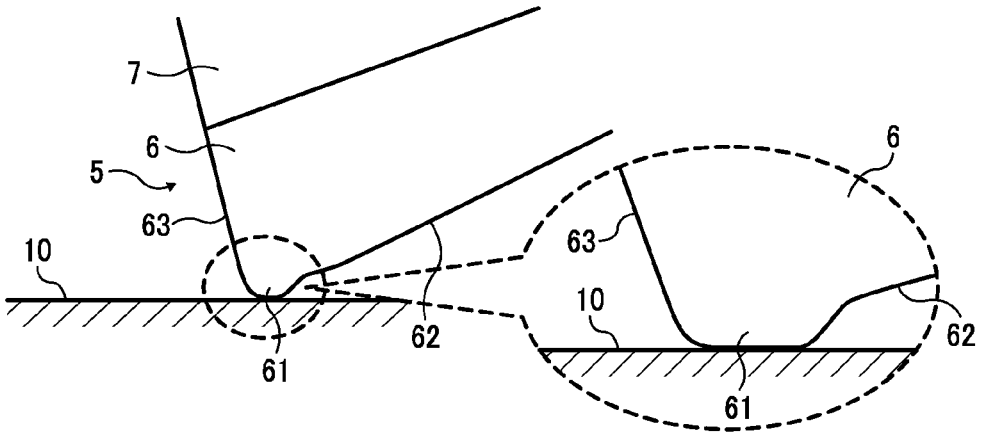
FIG. 4 is a cross-sectional view illustrating how the cleaning blade illustrated in FIG. 3 operates.

When the edge 61 is contacted with the surface of the photoreceptor 10 in such a manner that both the edge portions of the first and second side surfaces 62 and 63 are contacted with the surface of the photoreceptor at the same time as illustrated in FIG. 4, formation of the wedge-shaped portion 204 is prevented. Specifically, deformation of the edge 61 is relatively small, and increase in contact area of the cleaning blade 5 can be prevented. Therefore, the contact pressure of the cleaning blade 5 to the photoreceptor can be increased, thereby preventing foreign materials adhered to the surface of the photoreceptor 10 from passing through the nip between the cleaning blade and the surface of the photoreceptor, resulting in enhancement of the cleaning ability of the cleaner 1.

Since the 100% modulus value of the edge layer 6 at 23° C. is high, i.e., the edge layer has high hardness, deformation of the edge 61 contacted with the surface of the photoreceptor 10 can be reduced, thereby preventing increase in contact area of the cleaning blade 5 and increasing the contact pressure of the cleaning blade 5 to the photoreceptor, resulting in enhancement of the cleaning ability of the cleaner 1. In addition, since the backup layer 7 is made of an elastic material having lower hardness than the elastic material constituting the edge layer 6, occurrence of plastic deformation of the cleaning blade 5 can be prevented even after the cleaning blade is contacted with the photoreceptor for a long period of time, thereby preventing decrease in contact pressure of the cleaning blade 5. Therefore, the cleaner 1 can maintain good cleaning performance over a long period of time.

It is preferable to use a urethane rubber having a 100% modulus value at 23° C. of from 6 to 7 MPa for the edge layer 6 while using a urethane rubber having a 100% modulus value at 23° C. of from 4 to 5 MPa for the backup layer 7. Alternatively, it is possible to use a urethane rubber having a rubber hardness (JIS A hardness) of 80° for the edge layer 6 while using a urethane rubber having a rubber hardness (JIS A hardness) of 75° for the backup layer 7. In addition, the thickness of the edge layer 6 is, for example, 0.5 mm, and the thickness of the backup layer 7 is, for example, 1.3 mm.

In this embodiment, it is preferable that the elastic materials (rubbers) of the edge layer 6 and the backup layer 7, which have the above-mentioned 100% modulus values, have a tan δ peak temperature of lower than 10° C. Elastic materials having a tan δ peak temperature of lower than 10° C. can have a good rubber function even in a low temperature environment. Therefore, the cleaning blade 5 can serve as an elastic material even when the office in which the cleaner is used is in a low temperature environment, and the cleaning blade can be contacted with the surface of the photoreceptor 10 while having an elasticity, thereby making it possible for the cleaner 1 to attain good cleaning performance.

Table 1 below illustrates examples of a combination of an edge layer 6 and a backup layer 7. Each of the examples can be used for the cleaning blade 5 of the cleaner 1 of this disclosure.

TABLE 1

| | Example 1 | | Example 2 | | Example 3 | |
|---|---|---|---|---|---|---|
| | Edge layer | Backup layer | Edge layer | Backup layer | Edge layer | Backup layer |
| JIS A hardness (degree) | 80 | 73 | 81 | 73 | 80 | 64.5 |
| Impact resilience at 23° C. (%) | 25.5 | 34 | 15.5 | 34 | 25.5 | 12.5 |
| Young's modulus (Mpas) | 11 | 6.94 | 9.28 | 6.94 | 11 | 4.67 |
| 100% modulus (Mpas) | 6.4 | 3.9 | 6.1 | 3.9 | 6.4 | 2.4 |
| Permanent elongation rate (%) | 1.89 | 0.56 | 1.59 | 0.58 | 1.89 | 0.09 |
| tan δ peak temperature (° C.) | 5 | −7.7 | 15.7 | −7.7 | 5 | 8.8 |

Figure 5:
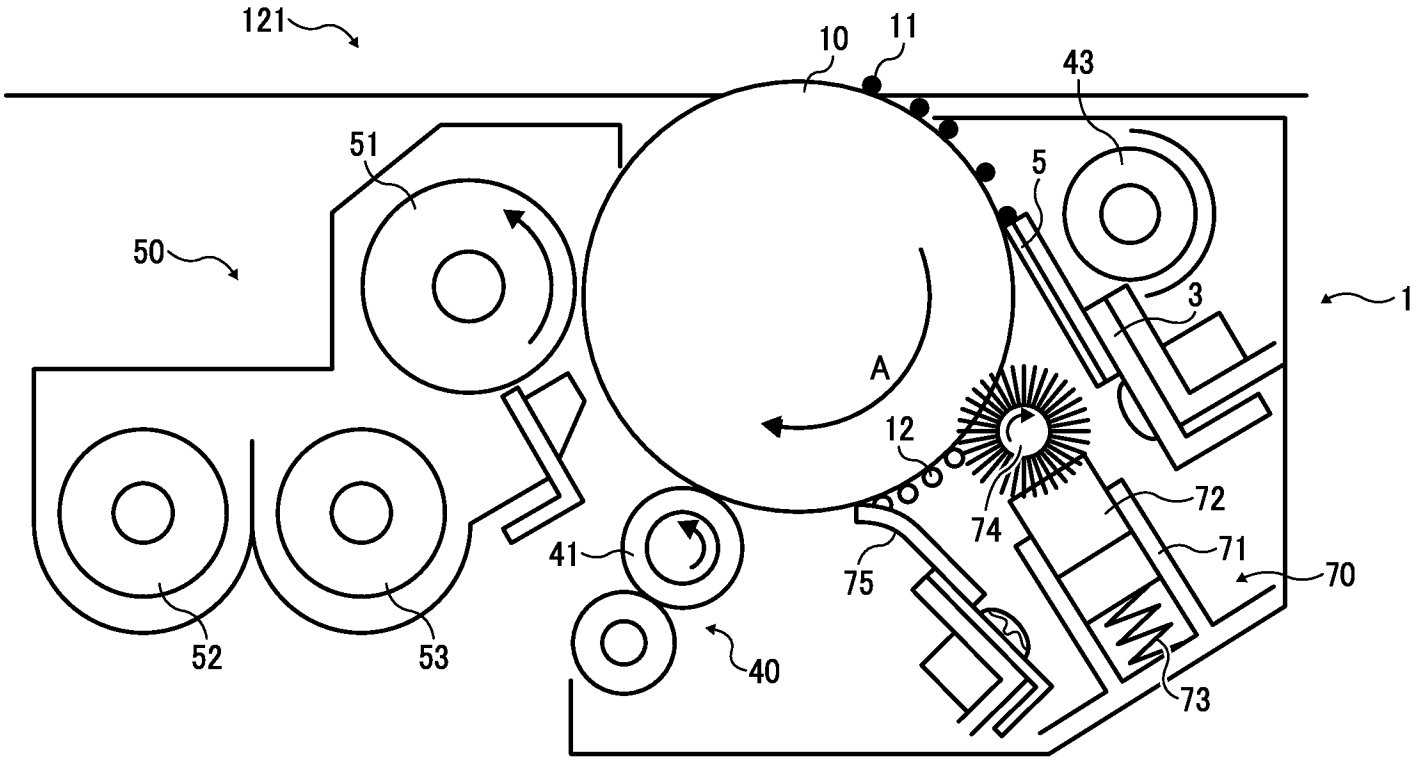
FIG. 5 is a schematic view illustrating another process cartridge in which the cleaner is incorporated.

FIG. 5 illustrates a process cartridge including a protective agent applicator 70 to apply a protective agent to a surface of the photoreceptor 10.

In the process cartridge 121, the charging roller 41 is a contact charging roller contacted with a surface of the photoreceptor 10, and an AC voltage is applied to the charging roller 41. The charging roller 41 may be a short range charging roller which is opposed to the photoreceptor with a small gap therebetween.

The protective agent applicator 70 is provided on a downstream side from the cleaner 1 relative to the moving direction A of the photoreceptor 10 to stably apply a protective agent to the surface of the photoreceptor.

In the protective agent applicator 70, a stick of a solid protective agent 72 is supported by a cylinder 71, and is biased to the photoreceptor 10 by a spring 73 in the cylinder. A rotatable brush roller 74 is arranged between the solid protective agent 72 and the photoreceptor 10 to scrape the protective agent while applying the protective agent to the surface of the photoreceptor, resulting in adhesion of a particulate protective agent 12. In addition, an application blade 75 made of polyurethane or the like is arranged on a downstream side from the brush roller 74 relative to the moving direction A of the photoreceptor 10 to form a thin layer of the protective agent 72 (12) on the surface of the photoreceptor.

Since the brush roller 74 is driven to rotate in a direction opposite to the rotation direction A of the photoreceptor 10, a large rubbing force is formed between the brush roller and the photoreceptor, thereby making it possible to efficiently apply the protective agent 72 to the surface of the photoreceptor. In addition, since the application blade 75 contacts the photoreceptor 10 while trailing the photoreceptor as illustrated in FIG. 5, a thin layer of the protective agent 72 can be well formed without scraping the protective agent off the photoreceptor.

The protective agent includes a fatty acid metal salt and an inorganic lubricant. When such a protective agent is applied on the photoreceptor 10, the fatty acid metal salt in the protective agent is damaged by a charging current and therefore the surface of the photoreceptor is prevented from being damaged by the charging current. In addition, since the inorganic lubricant is not damaged by the charging current, the surface of the photoreceptor has better lubricating property than in a case where only the fatty acid metal salt is used as the protective agent, thereby making it possible for the photoreceptor to maintain good cleaning property.

Specific examples of such a fatty acid metal salt include, but are not limited thereto, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate, and mixtures of these fatty acid metal salts. Among these fatty acid metal salts, zinc stearate is preferable because of having good film formability on photoreceptors.

Inorganic lubricants exhibit lubricity by being cleaved themselves or causing inner slipping. Specific examples thereof include talc, mica, boron nitride, molybdenum disulfide, kaolin, smectite, hydrotalcite compounds, calcium fluoride, graphite, plate alumna, sericite, and synthesized mica, but are not limited thereto. Among these inorganic lubricants, boron nitride is preferable because boron nitride has a structure such that hexagonal planes, in each of which atoms are firmly bonded with each other, are overlaid at relatively wide intervals, and therefore only a weak van der Waals force is present between the hexagonal planes, thereby making it possible for boron nitride to be easily cleaved and to exhibit lubricity. These inorganic lubricants may be subjected to a surface treatment to enhance the hydrophobicity thereof.

Figure 6A:
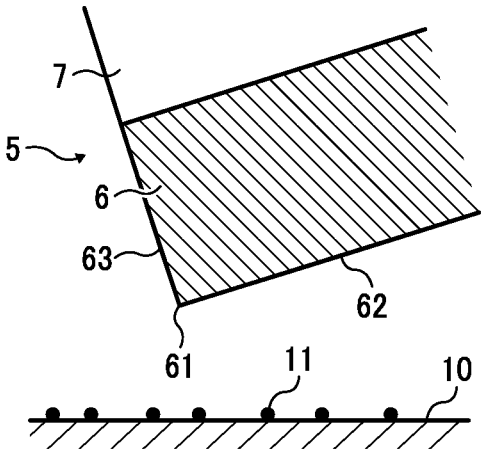
FIGS. 6A and 6B are schematic cross-sectional views illustrating how the cleaner operates in an image forming apparatus equipped with a protective agent applicator.
Figure 6B:
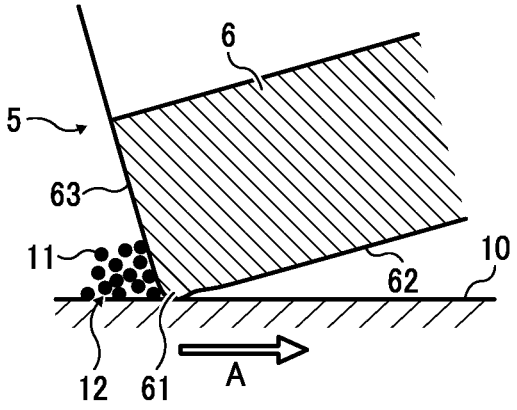

FIGS. 6A and 6B illustrate how the cleaner 1 operates in the process cartridge 121 having the protective agent applicator 70.

FIG. 6A illustrates the cleaning blade 5 and the photoreceptor 10 which are in the non-contact state. In this non-contact state, the first side surface 62 of the edge layer 6 is opposed to the surface of the photoreceptor 10.

Figure 12A:
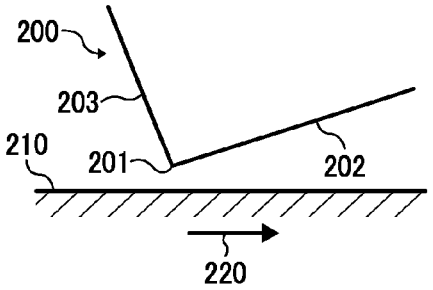
FIG. 12A PRIOR ART
FIGS. 12A and 12B are schematic views illustrating how a conventional cleaning blade operates.
Figure 12B:
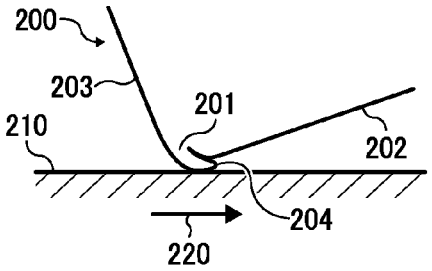
FIG. 12B PRIOR ART
Figure 13A:
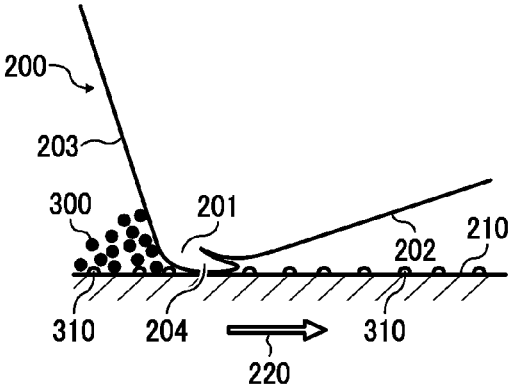
FIG. 13A PRIOR ART
FIGS. 13A and 13B are schematic views illustrating how a conventional cleaning blade operates on a photoreceptor on which a protective agent is applied.
Figure 13B:
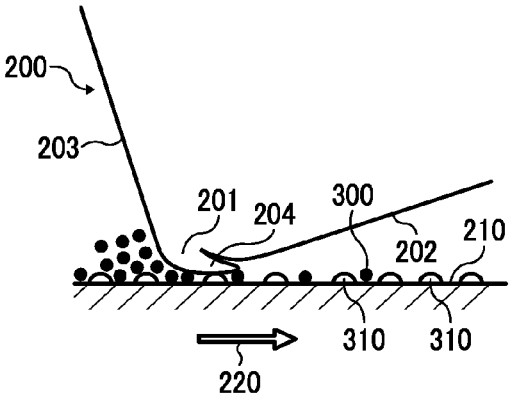
FIG. 13B PRIOR ART
Figure 14:
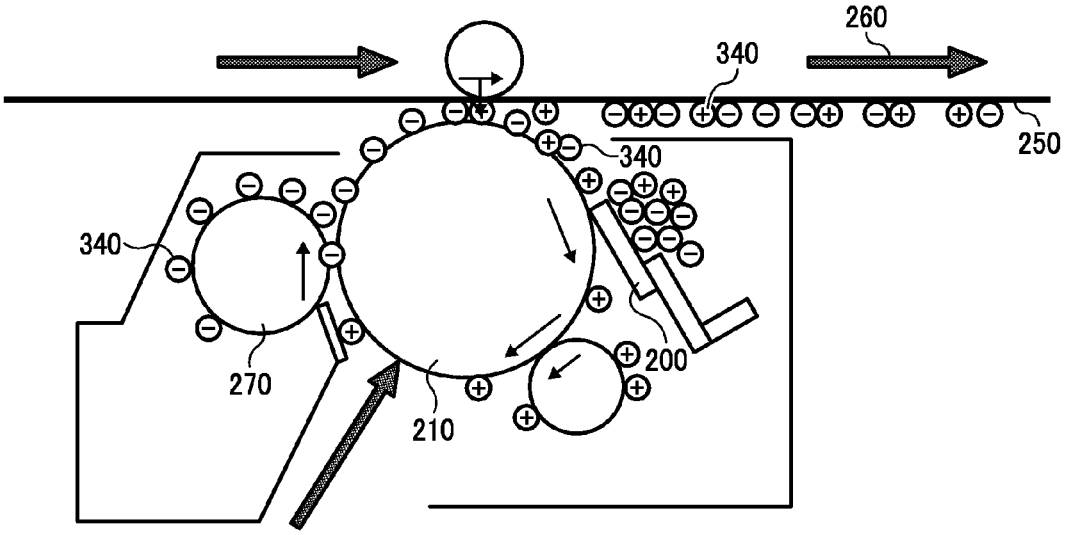
FIG. 14 PRIOR ART
FIG. 14 is a schematic view illustrating how a conventional cleaning blade operates in an image forming apparatus using a toner including a lubricant.
Figure 15:
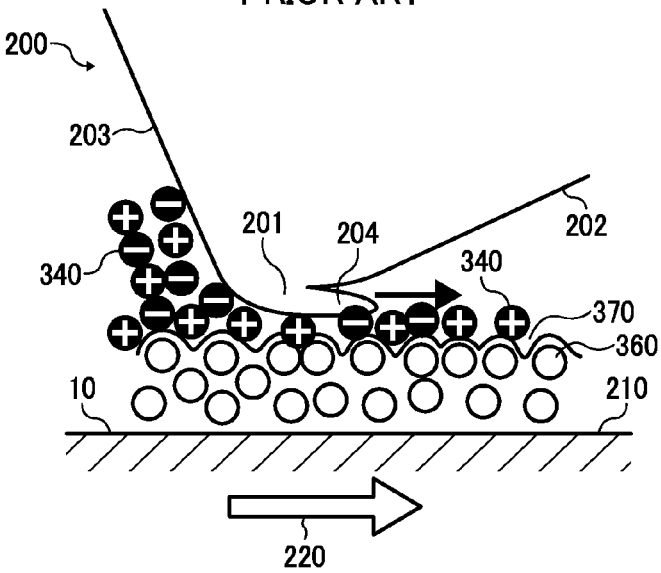
FIG. 15 PRIOR ART
FIG. 15 is a schematic view illustrating how a conventional cleaning blade operates on a photoreceptor including a particulate inorganic material in a surface portion thereof.

FIG. 6B illustrates the cleaning blade 5 and the photoreceptor 10 which are in the contact state. As mentioned above, since the edge layer 6 of the cleaning blade 5 is made of a urethane rubber, which has a high hardness and which has a 100% modulus value of from 6 MPa to 12 MPa at 23° C., the edge 61 is deformed when contacting the surface of the photoreceptor 10, and the first and second side surfaces 62 and 63 contact the surface of the photoreceptor at the same time. Therefore, such a wedge-shaped portion 204 as illustrated in FIG. 12B is not formed at the edge of the edge layer 6 contacting the surface of the photoreceptor 10. Therefore, the toner 11 and the particulate protective agent 12 on the photoreceptor 10 are prevented from passing through the nip between the cleaning blade 5 and the surface of the photoreceptor. In addition, since deformation of the edge 61 of the cleaning blade 5 is small, increase in area of the contact portion of the cleaning blade with the surface of the photoreceptor 10 can be prevented, thereby making it possible for the cleaning blade to maintain a high contact pressure. Therefore, the protective agent 12, which tends to easily grow on the surface of the photoreceptor 10, can be removed from the surface of the photoreceptor, thereby preventing formation of abnormal images such as white omissions (caused by grown protective agent) and vertical streak images (caused by defective cleaning). In addition, since the backup layer 7 has a lower hardness than the edge layer 6, plastic deformation of the cleaning blade 5 can be avoided even when the cleaning blade is contacted with the surface of the photoreceptor 10, and therefore the cleaner 1 can maintain good cleaning performance over a long period of time. Namely, formation of abnormal images due to adhesion of the grown protective agent 12 to the surface of the photoreceptor 10 and occurrence of defective cleaning due to passing of foreign materials through the nip between the cleaning blade 5 and the surface of the photoreceptor can be prevented over a long period of time.

Figure 7:
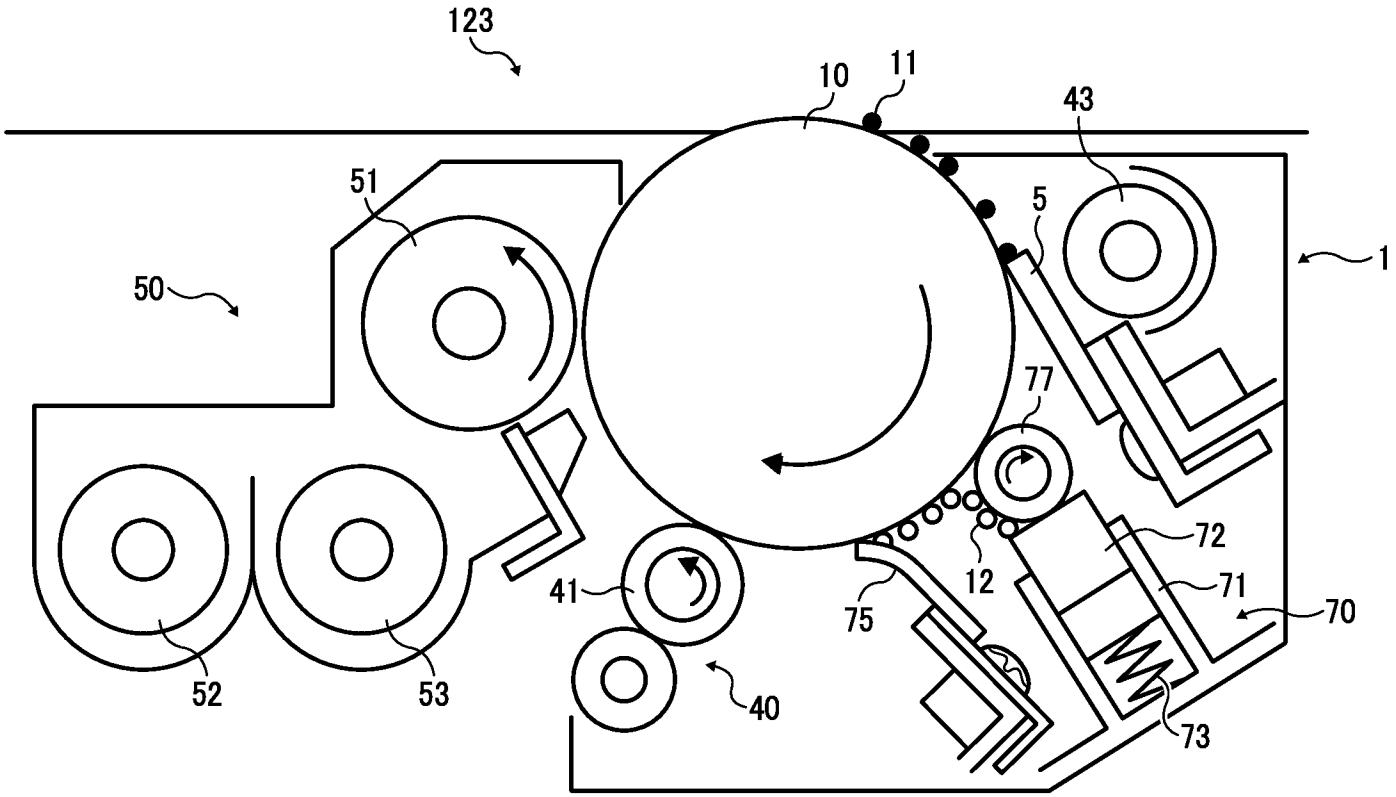
FIG. 7 is a schematic view illustrating yet another process cartridge in which the cleaner is incorporated.

FIG. 7 illustrates another process cartridge 123 which has the same configuration as that of the process cartridge 121 illustrated in FIG. 5 except that a foamed urethane roller 77 is used instead of the brush roller 74. The foamed urethane roller 77 is driven to rotate in a direction opposite to the moving direction A of the photoreceptor 10 to apply the solid protective agent 72 (i.e., particulate protective agent 12) to the surface of the photoreceptor. By using the foamed urethane roller 77, occurrence of a problem in that deformation of a brush roller is caused after long repeated use, and thereby the protective agent application ability of the protective agent applicator 70 is deteriorated can be prevented, namely, the protective agent can be stably applied to the surface of the photoreceptor. Therefore, it is unnecessary to determine the application amount of the protective agent in such a manner that the initial application amount is set to a relatively large amount compared to the desired application amount so that even after the protective agent applicator 70 is used over a long period of time (i.e., even after the application amount decreases due to deformation of a brush roller), the application amount can be maintained so as to be not less than the desired application amount. Namely, by using the foamed urethane roller 77, the protective agent can be effectively applied while reducing the total application amount.

In this embodiment, a photoreceptor including a particulate inorganic material in an outermost portion thereof can be used as an image bearing member. By using such a particulate inorganic material for the outermost portion, the abrasion resistance of the surface of the photoreceptor can be enhanced.

Specific examples of such a particulate inorganic material include powders of metal such as copper, tin, aluminum and indium; metal oxides such as silicon oxide, silica, tin oxide, zinc oxide, aluminum oxide, titanium oxide, indium oxide, antimony oxide, bismuth oxide, antimony-doped tin oxide, and tin-doped indium oxide; potassium titanate, etc. Among these, metal oxides are preferable, and silicon oxide, aluminum oxide, and titanium oxide are more preferable.

The average primary particle diameter of the particulate inorganic material is preferably from 0.01 μm to 0.5 μm so that the outermost layer 93 (illustrated in FIGS. 11B-11D) has a good combination of optical transmittance and abrasion resistance. When the average primary particle diameter is less than 0.01 μm, the abrasion resistance of the outermost layer 93 tends to deteriorate and the particulate inorganic material cannot be well dispersed in the outermost layer. When the average primary particle diameter is greater than 0.5 μm, problems such that the particulate inorganic material precipitates in a coating liquid, and a film of toner is formed on the outermost layer 93 tend to be caused.

With respect to the added amount of such a particulate inorganic material, the larger the added amount, the better the abrasion resistance of the outermost layer 93. However, if the added amount is too large, problems such that the residual potential of the photoreceptor increases and optical transmittance of the outermost layer decreases, resulting in deterioration of image qualities are caused. From this point of view, the added amount of a particulate inorganic material is generally not greater than 30% by weight, and preferably not greater than 20% by weight, based on the total weight of solid components included in the outermost layer. The lower limit of the added amount is generally 3% by weight.

The particulate inorganic material is preferably subjected to a surface treatment using at least one surface treatment agent to enhance the dispersibility thereof. When the particulate inorganic material is poorly dispersed in the outermost layer, not only the residual potential of the photoreceptor increases, but also problems such that the transparency and abrasion resistance of the outermost layer deteriorate, and coating defects are formed are caused. Therefore, it becomes impossible for the photoreceptor to have good durability and to produce high quality images.

Figure 8:
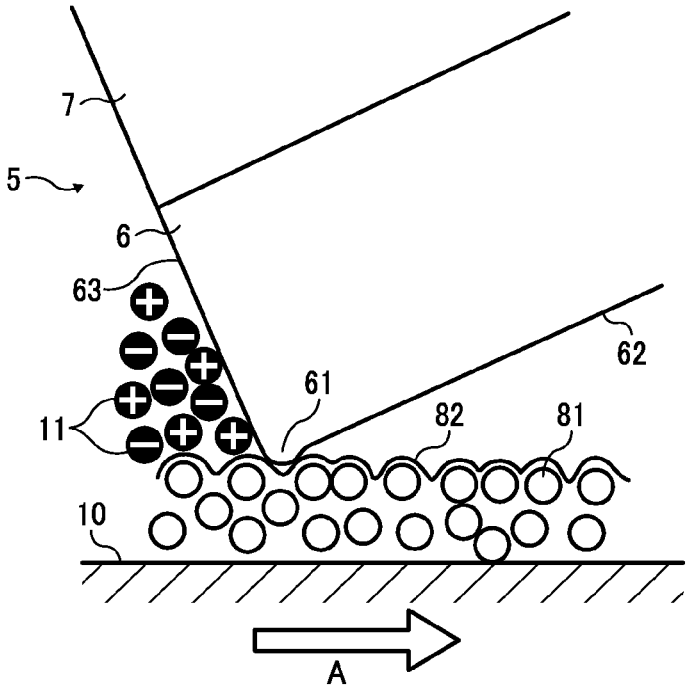
FIG. 8 is a schematic cross-sectional view illustrating how the cleaning blade operates on a photoreceptor including a particulate inorganic material in a surface portion thereof.

FIG. 8 is a view for describing the operation of the cleaner 1 on the photoreceptor 10 including a particulate inorganic material 81 in the outermost portion thereof.

Since the photoreceptor 10 includes the particulate inorganic material 81 in the outermost portion thereof, minor convexes and concaves 82 are formed on the surface of the photoreceptor 10. The cleaning blade 5 is contacted with the roughened surface. Since the edge layer 6 of the cleaning blade 5 is made of a urethane rubber having a 100% modulus value of from 6 MPa to 12 MPa, the edge layer has high hardness. Therefore, the edge 61 is deformed such that the first and second side surfaces 62 and 63 are contacted with the surface of the photoreceptor 10 at the same time, and formation of the wedge-shaped portion on the contact portion of the cleaning blade 5 is prevented. Namely, since the edge 61 is hardly deformed, the edge is hardly drawn downstream by the surface of the photoreceptor 10, and is stably contacted with the surface of the photoreceptor even when the surface has uneven convexes and concaves. In addition, since the wedge-shaped portion is not formed on the edge 61 of the cleaning blade 5, increase in the contact area of the edge can be prevented, and thereby decrease in contact pressure of the edge can be prevented, resulting in enhancement of the foreign material blocking ability of the cleaning blade 5. Therefore, even when the minor convexes and concaves 82 are formed by the particulate inorganic material 81 on the surface of the photoreceptor 10, the toner 11 is prevented from passing through the nip between the cleaning blade 5 and the surface of the photoreceptor, thereby preventing occurrence of defective cleaning. In addition, since the backup layer 7 has lower hardness than the edge layer 6, plastic deformation of the cleaning blade 5 can be prevented even when the cleaning blade is used over a long period of time, and therefore the cleaner 1 can maintain good cleaning ability over a long period of time.

In the image forming apparatus of this disclosure, a toner including a fatty acid metal salt can be used. Specifically, the developing device 50 develops an electrostatic latent image on the photoreceptor 10 with the toner including a fatty acid metal salt. In this case, good lubricity can be imparted to the surface of the photoreceptor 10.

Specific examples of such a fatty acid metal salt for use in the toner include the fatty acid metal salts mentioned above for use in the photoreceptor 10, but are not limited thereto. Among these fatty acid metal salts, zinc stearate is preferable because of being capable of forming a film on the surface of the photoreceptor in a developing process.

The toner for use in the image forming apparatus of this disclosure is preferably a polymerization toner prepared by a polymerization method, and the developing device 50 develops an electrostatic latent image with a polymerization toner. Such a polymerization toner is used to enhance the image qualities, and is prepared by a method such as suspension polymerization methods, emulsion polymerization methods, and dispersion polymerization methods, by which a toner having a small particle diameter and a high average circularity can be easily prepared. Among polymerization toners, toner having an average circularity of not less than 0.97 and a volume average particle diameter of not greater than 5.5 μm is preferable to produce high resolution images.

The average circularity of toner can be measured using a flow particle image analyzer FPIA-2000 from Sysmex Corp. The procedure is as follows:

(1) Initially, 100 to 150 ml of water, from which solid foreign materials have been removed, 0.1 to 0.5 ml of a surfactant (preferably, alkylbenzenesulfonate) and 0.1 to 0.5 g of a sample (i.e., toner) are mixed to prepare a dispersion;

(2) The dispersion is further subjected to a supersonic dispersion treatment for 1 to 3 minutes using a supersonic dispersion machine to prepare a dispersion including particles at a concentration of from 3,000 to 10,000 pieces/μl;

(3) The dispersion is set in the analyzer so as to pass through a detection area formed on a plate in the analyzer; and (4) The particles of the sample passing through the detection area are optically detected by a CCD camera and then the shapes of the toner particles and the distribution of the shapes are analyzed with an image analyzer to determine the average circularity of the sample.

Figure 9A:
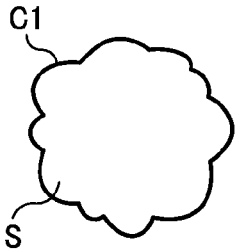
FIGS. 9A and 9B are schematic views for describing the circularity of a toner particle.
Figure 9B:
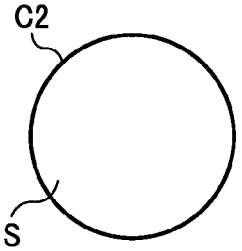

The method for determining the circularity of a toner particle will be described by reference to FIGS. 9A and 9B. When the projected image of a toner particle has a perimeter C1 and an area S as illustrated in FIG. 9A, and the perimeter of a circle having the same area S is C2 as illustrated in FIG. 9B, the circularity of the toner particle can be determined by the following equation.

$$\text{Circularity}=C2/C1$$

The average circularity of a toner is determined by averaging circularities of toner particles of the toner.

The volume average particle diameter of toner can be determined, for example, by an instrument such as COULTER MULTISIZER 2e manufactured by Beckman Coulter Inc. Specifically, the number-based particle diameter distribution data and the volume-based particle diameter distribution data are sent to a personal computer via an interface manufactured by Nikkaki Bios Co., Ltd. to be analyzed. The procedure is as follows:

(1) A surfactant serving as a dispersant, preferably 0.1 to 5 ml of a 1% aqueous solution of an alkylbenzenesulfonic acid salt, is added to an electrolyte such as 1% aqueous solution of first class NaCl;
(2) Two (2) to 20 mg of a sample (toner) to be measured is added into the mixture;
(3) The mixture is subjected to an ultrasonic dispersion treatment for about 1 to 3 minutes; and
(4) The dispersion is added to 100 to 200 ml of an aqueous solution of an electrolyte in a beaker so that the mixture includes the particles at a predetermined concentration; and
(5) The diluted dispersion is set in the instrument to measure particle diameters of 50,000 particles using an aperture of 100 μm to determine the volume average particle diameter of the sample.

In this regard, the following 13 channels are used:
(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted.

In this regard, the volume average particle diameter is obtained by the following equation.

$$\text{Volume average particle diameter}=\Sigma XfV/\Sigma fV,$$

wherein X represent the representative particle diameter of each channel, V represents the volume of the particle having the representative particle diameter, and f represents the number of particles having particle diameters in the channel.

By developing an electrostatic latent image with such a polymerization toner, high resolution images can be produced.

When a toner image is formed on the photoreceptor 10 using a toner including a fatty acid metal salt, or a polymerization toner, the surface of the photoreceptor is cleaned by the cleaner 1 after the toner image is transferred.

As mentioned above, the edge layer 6 of the cleaning blade 5 is made of a urethane rubber having a 100% modulus value of from 6 MPa to 12 MPa at 23° C. and has a high hardness. Therefore, when the cleaning blade 5 is contacted with a surface of the photoreceptor 10, the edge 61 is deformed and the first and second side surfaces 62 and 63 are contacted with the surface of the photoreceptor at the same time, and formation of the wedge-shaped portion 204 illustrated in FIG. 12B can be prevented. Therefore, passing of the toner 11 through the nip between the cleaning blade 5 and the surface of the photoreceptor 10 can be prevented. In addition, since deformation of the edge 61 is small, increase in area of the contact portion of the edge with the surface of the photoreceptor 10 can be prevented, and the contact pressure of the cleaning blade can be maintained, thereby making it possible for the cleaner 1 to attain good cleaning performance. In addition, since the backup layer 7 has lower hardness than the edge layer 6, plastic deformation of the cleaning blade 5 can be prevented even when the cleaning blade is used over a long period of time, and therefore the cleaner 1 can maintain good cleaning ability over a long period of time.

In the above-mentioned embodiment, the cleaning blade 5 of the cleaner 1 has a layered structure such that the edge layer 6 and the backup layer 7 are overlaid. However, the cleaning blade 5 may have a single-layer structure such that the cleaning blade is constituted of only the edge layer 6. In this case, a rubber having a 100% modulus value of from 6 MPa to 12 MPa at 23° C. is used for the edge layer 6 to enhance the cleaning ability of the cleaning blade 5. In addition, by using a rubber having a tan δ peak temperature of lower than 10° C. for the cleaning blade 5, the cleaning blade can maintain good cleaning ability even in a low temperature environment.

Next, a second embodiment will be described.

FIG. 10 illustrates cross-sections of the photoreceptor 10 for use as an image bearing member of an image forming apparatus of this disclosure. The photoreceptor 10 in this embodiment is a photoreceptor having high durability.

When a photoreceptor having high durability is used for the photoreceptor 10, the surface of the photoreceptor is hardly abraded even after long repeated use. When an external additive of the toner used for development is adhered to the surface of such a photoreceptor, a phenomenon in that both the surface of the photoreceptor and the external additive adhered thereto are abraded at the same time, resulting in disappearance of the surface of the photoreceptor and the external additive hardly occurs, thereby easily forming abnormal images such as white omissions. In this regard, adhesion of an external additive of toner to a surface of a photoreceptor is often caused when the edge of a cleaning blade operates unstably and rubs the external additive against the surface of the photoreceptor. Even when the edge of a cleaning blade operates unstably, abnormal images are not formed if the surface of the photoreceptor is abradable, because both the external additive and the surface of the photoreceptor are abraded. However, when a photoreceptor having high durability is used, the external additive adhered to the surface of the photoreceptor is further adhered strongly to the surface of the photoreceptor by unstable behavior of the cleaning blade 5 after the photoreceptor is repeatedly used. In this second embodiment, even when a photoreceptor having high durability is used, the edge of the cleaning blade 5 stably operates, thereby preventing formation of abnormal images such as white omissions even if the cleaning blade 5 and the photoreceptor are repeatedly used over a long period of time.

The photoreceptor 10 used for this second embodiment has a structure such that at least a photosensitive layer and an outermost layer are formed in this order on an electroconductive support, and other layers are optionally formed. The outermost layer includes a specific material while having a specific surface resistivity. Conventional photosensitive layers and other layers can be used for the photosensitive layer and the other optional layers.

Figure 10A:
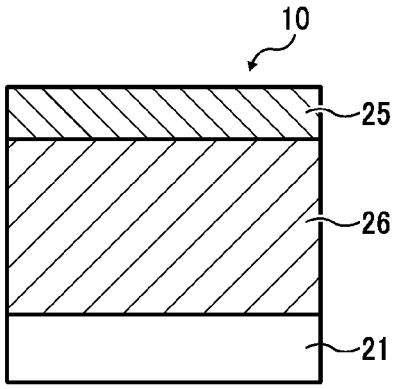
FIGS. 10A-10D are schematic views illustrating examples of a photoreceptor for use in an image forming apparatus according to an embodiment.
Figure 10B:
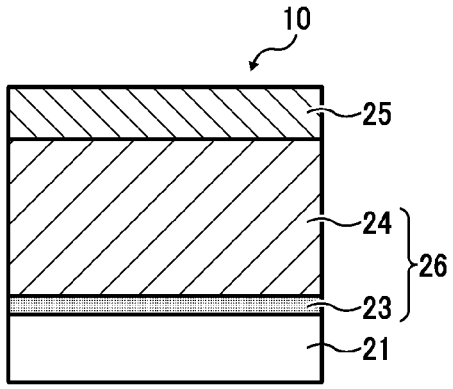
Figure 10C:
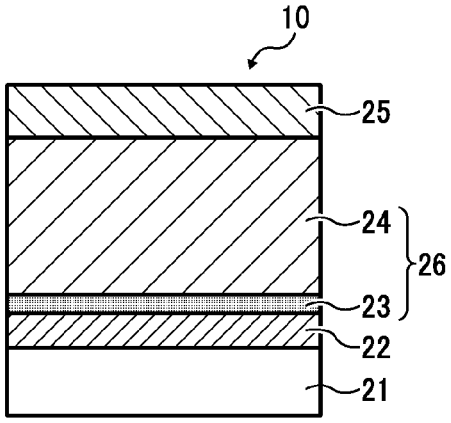
Figure 10D:
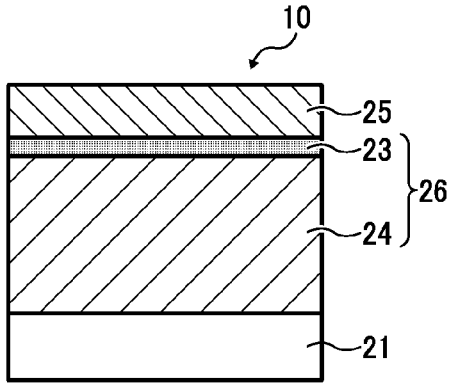

FIG. 10A illustrates a photoreceptor having a single-layered photosensitive layer, and the photoreceptor has a structure such that a single-layered photosensitive layer 26 and an outermost layer 25 are formed in this order on an electroconductive support 21. FIG. 10B illustrates another photoreceptor having a structure such that a charge generation layer 23, a charge transport layer 24, and the outermost layer 25 are formed in this order on the electroconductive support 21. FIG. 10C illustrates another photoreceptor having a structure such that an intermediate layer 22, the charge generation layer 23, the charge transport layer 24, and the outermost layer 25 are formed in this order on the electroconductive support 21. FIG. 10D illustrates another photoreceptor having a structure such that the charge transport layer 24, the charge generation layer 23, and the outermost layer 25 are formed in this order on the electroconductive support 21. In the photoreceptors illustrated in FIGS. 10B-10D, the charge generation layer 23 and the charge transport layer 24 constitute the photosensitive layer 26. Hereinafter, each layer will be described.

The outermost layer 25 includes at least a resin having no charge transportability, and a particulate inorganic material, and optionally includes other additives. In addition, the outermost layer 25 has the below-mentioned surface resistivity and preferably has the below-mentioned hardness and elastic work.

Initially, the surface resistivity of the outermost layer 25 will be described.

In order that a photoreceptor having an outermost layer including a charge transport material in as small an amount as possible has good electrophotographic properties, the photoreceptor has to have a good combination of charging property, charge transportability, and electrostatic latent image maintainability. Since it is easy to impart a good charging property to the outermost layer, it is important to impart a good combination of charge transportability, and electrostatic latent image maintainability to the outermost layer. The present inventors discover that even when the content of a charge transport material in the outermost layer is decreased, the photoreceptor can have a good combination of charge transportability and electrostatic latent image maintainability if the outermost layer has a relatively high surface resistivity in an electric field strength range ($1\times10^4$V/cm to $3\times10^4$V/cm) lower than that in a process, in which the photoreceptor is operated, while having a relatively low surface resistivity at an electric field strength ($1.5\times10^5$V/cm) substantially equal to that in the photoreceptor operating process.

The surface resistivity will be described in detail. The surface resistivity of the outermost layer 25 at an electric field strength of $1\times10^4$V/cm is referred to as surface resistivity R1. The surface resistivity R1 is not lower than $10^{13}$ Ω/cm$^2$, and is preferably not lower than $10^{14}$ Ω/cm$^2$ to impart good electrostatic latent image maintainability to the outermost layer. When the surface resistivity is lower than $1\times10^{13}$ Ω/cm$^2$, the outermost layer has insufficient electrostatic latent image maintainability, and problems such that images whose dot images have a diameter smaller than that of the desired dot images are formed, and blurred images are formed are often caused. When a photoreceptor has an electrostatic latent image thereon, the electric field strength for the photoreceptor is close to $1\times10^4$V/cm, and therefore good electrostatic latent image maintainability can be imparted to the outermost layer by blocking flow of charges if the resistivity of the outermost layer is relatively high at that electric field strength.

The surface resistivity of the outermost layer 25 at an electric field strength of $3\times10^4$V/cm is referred to as surface resistivity R3. The surface resistivity R3 is preferably not lower than $10^{14}$ Ω/cm$^2$ to impart good electrostatic latent image maintainability to the outermost layer. When a photoreceptor has an electrostatic latent image thereon, the electric field strength for the photoreceptor is close to $3\times10^4$V/cm, and therefore good electrostatic latent image maintainability can be imparted to the outermost layer by blocking flow of charges if the resistivity of the outermost layer is relatively high at that electric field strength.

The surface resistivity of the outermost layer 25 at an electric field strength of $1.5\times10^5$V/cm is referred to as surface resistivity R15. The surface resistivity R15 is preferably from $1\times10^9$ Ω/cm$^2$ to $1\times10^{11}$ Ω/cm$^2$ so that the potential of the photoreceptor properly decreases when the photoreceptor is irradiated with light.

The ratio R1/R3 of the surface resistivity R1 to the surface resistivity R3 of the outermost layer 25 is preferably from 0.1 to 10, and more preferably from 0.1 to 2 in order to minimize change in resistivity. When the R1/R3 ratio is less than 0.1, the charge transportability of the outermost layer tends to deteriorate, and the residual potential of the photoreceptor often increases. When the R1/R3 ratio is greater than 10, the electrostatic latent image maintainability of the photoreceptor tends to deteriorate, and images whose dot images have a diameter smaller than that of the desired dot images are often formed.

The ratio R1/R15 of the surface resistivity R1 to the surface resistivity R15 of the outermost layer 25 is preferably from 100 to 5,000, and more preferably from 100 to 1,000. When the ratio R1/R15 is less than 100, the charge transportability of the outermost layer 25 is not sufficient, and the residual potential of the photoreceptor often increases, thereby forming abnormal images. When the ratio R1/R15 is greater than 5,000, the charging property of the photoreceptor deteriorates, and problems such that images with background development and/or images having poor half-tone (graduation) property are formed are often caused. The present inventors discover that when the surface resistivity R15 is sufficiently low compared to the surface resistivity R1, good charge transportability can be imparted to the outermost layer. In addition, the present inventors discover that when the electric field strength is not lower than $1.5\times10^5$V/cm, the charge transportability is largely influenced thereby, and when the outermost layer has a relatively high resistivity in the electric field strength range, the outermost layer can smoothly transport charges.

In this application, the surface resistivity is measured by a method based on JIS-C2139:2008 (method for measuring volume resistivity and surface resistivity of solid electric insulating material) or the like method. In general, photoreceptors have a cylindrical form, and if the resistivity cannot be measured by the method of JIS-C2139:2008, the method mentioned below can be used.

When measuring a current flowing through a sample by applying a voltage to the sample, an ammeter/voltmeter (voltammeter) is used. The voltammeter is not particularly limited as long as measurements can be performed at the electric field strengths ($1\times10^4$V/cm-$1.5\times10^5$V/cm). For example, a micro ammeter (Source Measure Unit type 2410 from Keithley Instruments Inc.) can be used.

The method for preparing the electrode for use in measurement of the surface resistivity is not particularly limited, but vacuum deposition methods are preferably used because constitutional materials of the photoreceptor are hardly degraded by the methods.

The material used for the electrode is not particularly limited as long as an electrode can be formed on the surface of a photoreceptor, and for example metals such as gold, silver, copper, aluminum, nickel, platinum, chromium and zinc, and carbon can be used. It is preferable that the opposite electrode is made of the same material as that used for the electrode.

The shape of the electrode is not particularly limited, and is determined based on the capacity of the DC power source and accuracy of the ammeter used for the measurement. For example, an electrode in which two electrodes each having a length of from 10 mm to 30 mm are arranged in parallel with a gap of 25 μm to 100 μm is used.

The power source for forming the electric field is not particularly limited, and DC voltage sources having good stability can be used.

The polarity of the voltage applied to the photoreceptor to measure the surface resistivity is not particularly limited. It is preferable that when measuring the surface resistivity of a negatively-chargeable photoreceptor, a negative voltage is applied thereto, and when measuring the surface resistivity of a positively-chargeable photoreceptor, a positive voltage is applied thereto.

The method for measuring the current flowing through a sample in measuring the surface resistivity R1 is not particularly limited. However, it is preferable that after a voltage is applied to a sample for 60 seconds or more, the current 60 seconds after application of the voltage is measured to calculate the surface resistivity therefrom.

The method for setting the electric field strength to $1\times10^4$V/cm in measuring the surface resistivity R1 is not particularly limited, and for example a method in which a bias determined from the gap between the opposed electrodes is applied to a sample so that the electric field strength becomes $1\times10^4$V/cm can be used.

The position of the outermost layer on which the surface resistivity R1 is measured is not particularly limited. It is preferable that any positions of the photoreceptor have the above-mentioned resistivity R1. It is possible to use a method in which the surface resistivity R1 of portions of the photoreceptor apart from the upper end thereof by 70 mm, 170 mm and 270 mm, respectively, is measured, and the three surface resistivity data are averaged to obtain the average surface resistivity R1.

When measuring the surface resistivities R3 and R15, the method for measuring the surface resistivity R1 can be used except that the bias applied to the sample is changed depending on the electric field strength (i.e., $3\times10^4$V/cm or $1.5\times10^5$V/cm).

Next, the hardness of the outermost layer 25 of the photoreceptor 10 will be described. The mechanical durability and contamination resistance of a photoreceptor depend on the physical properties of a small area of the surface of the photoreceptor. Therefore, a universal hardness of an outermost layer of a photoreceptor is preferably measured to evaluate the mechanical durability and contamination resistance of the photoreceptor (outermost layer).

The universal hardness of the outermost layer 25 is preferably not less than 200 N/mm$^2$, and more preferably not less than 250 N/mm$^2$. When the universal hardness is not less than 200 N/mm$^2$, an external additive included in the toner hardly sticks in the outermost layer, and therefore the photoreceptor has a good combination of mechanical durability and contamination resistance. The upper limit of the universal hardness of the outermost layer is not particularly determined, but is preferably not greater than 500 N/mm$^2$ so that the outermost layer is well adhered to the lower layer such as the photosensitive layer 26.

The universal hardness is defined as follows. Specifically, when an indenter is contacted with a sample at a maximum load F and the contact area of the indenter with the sample is A, the universal hardness is defined as F/A. The universal hardness can be measured with an ultramicro hardness tester. The contact area A is calculated from the indentation length (depth) h of the indenter. The indenter is not particularly limited, and for example, a Vickers indenter having a four-sided pyramid shape, and a Berkovich indenter having a three-sided pyramid shape can be used. Specific examples of the instrument for use in measuring the universal hardness include FISCHER SCOPE H-100 from Fischer Instruments K.K., but are not limited thereto.

For example, the following method can be used for measuring the universal hardness of a photoreceptor. Specifically, the universal hardness of a photoreceptor is measured 5 times under the following conditions, and the five data are averaged to determine the universal hardness of the photoreceptor.

Instrument used: FISCHER SCOPE H-100 from Fischer Instruments K.K.

Software: WIN-HCU from Fischer Instruments K.K.

Maximum load: 1 mN

Load application time: 30 seconds

Load increasing rate: 1 mN/30 seconds

Creep at the maximum load: 5 seconds

Load decreasing rate: 1 mN/30 seconds

Creep after removing load: 5 seconds

Indenter: SMC117

Next, the elastic work of the outermost layer will be described.

The elastic work of the outermost layer is preferably not less than 50%, and more preferably not less than 55%. The elastic work can be measured by the method mentioned above for use in measuring the universal hardness. The elastic work (EW) can be calculated from the following equation 1:

$$EW\ (\%)=100\times(MD-PD)/MD \qquad \text{equation 1,}$$

wherein MD represents the maximum displacement, and PD represents the plastic displacement.

When the outermost layer of a photoreceptor has a universal hardness of not less than 200 N/mm$^2$, and preferably not less than 250 N/mm$^2$ while having an elastic work of not less than 50%, and preferably not less than 55%, the photoreceptor has a good combination of mechanical durability and contamination resistance.

The outermost layer 25 includes a resin having no charge transportability (i.e., a resin having no charge transport structure). Examples of such a resin include resins which do not have a positive hole transport structure such as triarylamine, hydrazone, pyrazoline, and carbazole, and an electron transport structure such as condensed polycyclic quinone, diphenoquinone, and aromatic rings having an electron accepting group such as cyano and nitro groups.

Specific examples of resins having no charge transportability include thermoplastic resins, thermosetting resins and light crosslinking resins such as acrylic resins, phenolic resins, urethane resins, silicone resins, epoxy resins, polycarbonate resins, polyarylate resins, polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, phenoxy resins, cellulose acetate resins, ethyl cellulose resins, polyvinyl butyral resins, polyvinyl formal resins, polyvinyl ketone resins, and poly-N-vinylcarbazole resins. These resins can be used alone or in combination.

Among these resins, polycarbonate resins and polyarylate resins are preferable because the resultant outermost layer has a good combination of charge transportability and electrostatic latent image maintainability. Crosslinked resins obtained by irradiating a compound having a radically polymerizable functional group with light such as phenolic resins, urethane resins, silicone resins, and epoxy resins are more preferable, and crosslinked acrylic resins are even more preferable.

The acrylic resin for use as a resin having no charge transportability is not particularly limited. Specific examples of such acrylic resins include polymers and copolymers of methyl acrylate, ethyl acrylate, n-propyl acrylate, isopropyl acrylate, n-butyl acrylate, isobutyl acrylate, sec-butyl acrylate, t-butyl acrylate, n-hexyl acrylate, cyclohexyl acrylate, 2-ethylhexyl acrylate, n-octyl acrylate, methyl methacrylate, ethyl methacrylate, n-propyl methacrylate, isopropyl methacrylate, n-butyl methacrylate, isobutyl methacrylate, sec-butyl methacrylate, t-butyl methacrylate, n-hexyl methacrylate, cyclohexyl methacrylate, 2-ethylhexyl methacrylate, and n-octyl methacrylate.

Marketed acrylic resins and synthesized acrylic resins can be used for the acrylic resin. The synthesizing method is not particularly limited, but a synthesizing method in which energy such as heat and light is applied to a mixture of a polymerizable acrylic compound and a radical polymerization initiator to crosslink the acrylic compound can be preferably used.

The polymerizable functional group of such an acrylic compound is not particularly limited, but acryloyloxy group and methacryloyloxy group are preferable because of having good crosslinking ability.

The number of polymerizable functional groups of an acrylic compound is not particularly limited, but is preferably not less than 2 because the resultant outermost layer 25 has good strength and film property.

Specific examples of acrylic compounds having two polymerizable functional groups include, but are not limited thereto, 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacrylate, neopentyl glycol diacrylate, ethyleneoxy (EO)-modified bisphenol A diacrylate, EO-modified bisphenol F diacrylate, and neopentyl glycol diacrylate.

Specific examples of acrylic compounds having three polymerizable functional groups include, but are not elimited thereto, trimethylol propane triacrylate (TMPTA), trimethylolpropane trimethacylate, alkylene-modified trimethylolpropane triacrylate, EO-modified trimethylolpropane triacrylate, propyleneoxy (PO)-modified trimethylolpropane triacrylate, caprolactone-modified trimethylolpropane triacrylate, alkylene-modified trimethylolpropane trimethacrylate, pentaerythritol triacrylate, pentaerythritol tetraacrylate (PETTA), glycerol triacrylate, epichlorohydrin (ECH)-modified glycerol triacrylate, EO-modified glycerol triacrylate, PO-modified glycerol triacrylate, tris(acryloxyethyl)isocyanurate, dipentaerythritol hexaacrylate (DPHA), caprolactone-modified dipentaerythritol hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerhythritol ethoxytetracrylate, EO-modified triacryl phosphate, 2,2,5,5-tetrahydroxymethylcyclopentanone tetraacrylate, etc. These compounds can be used alone or in combination.

Suitable radical polymerization initiators for use in polymerizing such an acrylic compound include heat polymerization initiators such as peroxide type polymerization initiators, and azo type polymerization initiators; light polymerization initiators such as acetophenone type polymerization initiators, ketal type polymerization initiators, benzoin ether type polymerization initiators, thioxanthone type polymerization initiators, titanocene type polymerization initiators, acridine type polymerization initiators, triazine type polymerization initiators, and imidazole type polymerization initiators; etc. These initiators can be used alone or in combination. Among these, light polymerization initiators are preferable.

Radical polymerization initiators can be used alone or in combination with a light polymerization accelerator. Specific examples of the light polymerization accelerator include triethanolamine, methyl diethanolamine, ethyl 4-dimethylaminobenzoate, isoamyl 4-dimethylamino benzoate, (2-dimethylamino)ethyl benzoate, 4,4'-dimethylaminobenzophenone, etc.

The added amount of such a radical polymerization initiator is preferably from 0.5 to 40 parts by weight, and more preferably from 1 to 20 parts by weight, based on 100 parts by weight of the acrylic compound used The phenolic resin for use as the resin having no charge transportability is not particularly limited. For example, novolac resins and resol resins can be used. Among these, resol resins are preferable because of having good electrostatic latent image maintainability and being capable of making a crosslinking reaction without an initiator unlike novolac resins which need an initiator such as acid catalysts.

Marketed phenolic resins and synthesized phenolic resins can be used for the phenolic resin. The synthesizing method is not particularly limited, but a synthesizing method in which a phenol derivative having one or more methylol groups in one unit thereof is heated to be crosslinked can be preferably used.

The phenol derivative having one or more methylol groups is not particularly limited, and any known phenol derivatives can be used. Among these, phenol derivatives having two or more methylol groups in one unit thereof are preferable because the resultant outermost layer has good mechanical strength and good film property.

Examples of such phenol derivatives having two or more methylol groups include dimethylol compounds of phenolic monomers, trimethylol compounds of phenolic monomers, and phenolic dimmers. These can be used alone or in combination.

Specific examples of the dimethylol compounds of phenolic monomers include 2,6-dihydroxymethyl-4-methyl phenol, 2,4-dihydroxymethyl-6-methyl phenol, 2,6-dihydroxymethyl-3,4-dimethyl phenol, 4,6-dihydroxymethyl-2,3-dimethyl phenol, 4-t-butyl-2,6-dihydroxymethyl phenol, 4-cyclohexyl-2,6-dihydroxymethyl phenol, 2-cyclohexyl-4,6-dihydroxymethyl phenol, 2,6-dihydroxymethyl-4-ethyl phenol, 4,6-dihydroxymethyl-2-ethyl phenol, 4,6-dihydroxymethyl-2-isopropyl phenol, 6-cyclohexyl-2,4-dihydroxymethyl-3-methyl phenol, etc.

Specific examples of the trimethylol compounds of phenolic monomers include 2,4,6-trihydroxymethyl phenol, etc.

The urethane resin having no charge transportability is not particularly limited, and for example, ester type urethane resins and ether type urethane resins can be used. These can be used alone or in combination.

Marketed urethane resins and synthesized urethane resins can be used for the urethane resin. The synthesizing method is not particularly limited, but a synthesizing method in which energy such as heat and light irradiation is applied to a mixture of a polyol compound and an isocyanate compound to crosslink the mixture can be preferably used.

The polyol compound is not particularly limited, but di- or more-functional polyol compounds are preferably used because the resultant outermost layer has good mechanical strength and good film property. The di- or more-functional polyol compound is not particularly limited. Specific examples thereof include diol compounds such as alkylene glycols, alkylene ether glycols, alicyclic diols, and alkylene oxide adducts of alicyclic diols, and alkylene oxide adducts of bisphenols; polyol compounds having three or more hydroxyl groups such as aliphatic polyalcohols (e.g., glycerin, trimethylol ethane, trimethylol propane, pentaerythritol and sorbitol), tri- or more-functional phenolic compounds (e.g., phenol novolac, and cresol novolac), and alkylene oxide adducts of tri- or more-functional phenolic compounds; etc. These can be used alone or in combination.

The isocyanate compound is not particularly limited, but di- or more-functional isocyanate compounds are preferably used because the resultant outermost layer has good mechanical strength and good film property. The di- or more-functional isocyanate compound is not particularly limited. Specific examples thereof include tolylene diisocyanate (TDI), diphenylmethane diisocyanate, xylene diisocyanate (XDI), hexamethylene diisocyanate (HDI), isophorone diisocyanate (IPDI), bis(isocyanatemethyl)cyclohexane, trimethylhexamethylene diisocyanate, HDI isocyanurate materials, HDI Biuret materials, trimethylolpropane adducts of XDI, trimethylolpropane adducts of IPDI, IPDI isocyanurate materials, etc. These can be used alone or in combination.

The added amount of such an isocyanate compound is not particularly limited, and is preferably from 0.5 to 40 parts by weight, and more preferably from 1 to 20 parts by weight, based on 100 parts by weight of the polyol compound used. The added amount is preferably determined based on the OH value of the polyol compound used and the NCO value of the isocyanate compound used.

The epoxy resin having no charge transportability is not particularly limited, and for example, bisphenol A type epoxy resins, bisphenol F type epoxy resins, cresol novolac type epoxy resins, and phenol novolac type epoxy resins can be used. These can be used alone or in combination.

Marketed epoxy resins and synthesized epoxy resins can be used for the epoxy resin. The synthesizing method is not particularly limited, but a synthesizing method in which energy such as heat and light irradiation is applied to a mixture of a compound having one or more epoxy rings in a molecule and a crosslinking agent to crosslink the epoxy compound can be preferably used.

The epoxy ring-including compound is not particularly limited. Specific examples thereof include polyalkylene glycol diglycidyl ethers, bisphenol A diglycidyl ether, glycerin triglycidyl ether, diglycerol triglycidyl ether, diglycidyl hexahydrophthalate, trimethylolpropane diglycidyl ether, allyl glycidyl ether, phenyl glycidyl ether, etc. These can be used alone or in combination.

The crosslinking agent is not particularly limited. For example, thermal acid generators and photoacid generators can be used. Specific examples thereof include aliphatic amine compounds, alicyclic amine compounds, aromatic amine compounds, modified amine compounds, polyamide amine, imidazole, polymercaptans, acid anhydrides, etc.

The added amount of such a crosslinking agent is preferably from 0.5 to 20 parts by weight, and more preferably from 1 to 10 parts by weight, based on 100 parts by weight of the epoxy ring-including compound used.

The silicone resin having no charge transportability is not particularly limited. Specific examples thereof include dimethyl polysiloxane, methyl phenyl polysiloxane, octamethyl cyclotetrasiloxane, decamethylene cyclopentasiloxane, vinyl silicone, polyether modified silicone, polyglycerin modified silicone, amino modified silicone, epoxy modified silicone, mercapto modified silicone, methacryl modified silicone, carboxylic acid modified silicone, fatty acid ester modified silicone, alcohol modified silicone, alkyl modified silicone, fluoroalkyl modified silicone, etc. These can be used alone or in combination.

Marketed silicone resins and synthesized silicone resins can be used for the silicone resin. The synthesizing method is not particularly limited, but a synthesizing method in which energy such as heat and light irradiation is applied to a reactive silicone compound in which one or more hydrolyzable groups are connected to a silicon atom or a mixture of such a silicone compound and a condensation catalyst to crosslink the silicone compound can be preferably used.

The reactive silicone compound is not particularly limited, and reactive silicone compounds in which two or more hydrolyzable groups are connected to a silicon atom are preferable because the resultant outermost layer has good mechanical strength. Specific examples of such a hydrolyzable group include methoxy group, ethoxy group, methyl ethyl ketoxime group, diethylamino group, acetoxy group, propenoxy group, propoxy group, butoxy group, methoxy ethoxy group, etc.

The condensation catalyst is not particularly limited, and for example catalysts which cause a condensation reaction by contacting a compound, and catalysts which move the reaction equilibrium of a condensation reaction to the generation system can be preferably used. Specific examples thereof include alkali metal salts of organic carboxylic acids, nitrous acid, sulfurous acid, aluminic acid, carbonic acid, and thiocyanic acid; organic amine salts such as hydroxylated tetramethylammonium, and tetramethylammonium acetate; organic acid tin salts such as stannous octoate, dibutyltin diacetate, dibutyltin dilaurate, dibutyltin mercaptide, dibutyltin thiocarboxylate, and dibutyltin maleate; etc.

The added amount of such a condensation catalyst is preferably from 0.5 to 20 parts by weight, and more preferably from 1 to 10 parts by weight, based on 100 parts by weight of the reactive silicone compound used.

The present inventors discover that even when the content of a charge transport material in the outermost layer 25 is relatively low, by including a particulate inorganic material in the outermost layer, the surface resistivity of the outermost layer can be controlled, and a good combination of charge transportability and electrostatic latent image maintainability can be imparted to the resultant photoreceptor.

In addition, by using a zinc oxide doped with a thirteenth group element, the surface resistivity of the outermost layer 25 can be satisfactorily controlled, namely, an outermost layer with good temporal stability, which has a relatively high electroconductivity and a stable electric property in the atmosphere for a long period of time can be formed.

The zinc oxide is not particularly limited as long as the zinc oxide is doped with a thirteenth group element. Specific examples thereof include gallium-doped zinc oxide, boron-doped zinc oxide, aluminum-doped zinc oxide, and indium-doped zinc oxide. These can be used alone or in combination. Among these, gallium-doped zinc oxide is preferable because the resultant outermost layer can have a good electric property, i.e., a good combination of charge transportability and electrostatic latent image maintainability.

The method for doping zinc oxide with a thirteenth group element is not particularly limited. For example, a calcination method, in which a mixture of a zinc oxide or a precursor which becomes zinc oxide by being calcined and a dope metal is calcined in a high temperature environment, can be used. In this regard, "doping" means that a thirteenth group element is added to zinc oxide so that the element is included in zinc oxide at a predetermined concentration.

The method for determining whether a particulate inorganic material (such as zinc oxide) is doped with a thirteenth group element is not particularly limited, and for example, known element analyzing methods such as X-ray photoelectron spectrometry (XPS), Auger electron spectroscopy (AES), and energy dispersive X-ray spectrometry (EDX) can be used.

The content of a thirteenth group element in the particulate inorganic material is preferably from 0.001 to 0.2 moles, and more preferably from 0.01 to 0.1 moles, per 1 mole of zinc oxide. When the content is less than 0.001 moles, stability of the electric property of the zinc oxide tends to deteriorates. In contrast, when the content is greater than 0.2 moles, the stability of the electric property and electroconductivity enhancing effect tend to be saturated. When the element is included in an excess amount, a compound of the element tends to precipitate in the grain boundary portions of the particulate inorganic material, thereby often deteriorating the photographic property of the photoreceptor.

The content of a thirteenth group element in the particulate inorganic material can be determined by the above-mentioned element analyzing methods.

The average primary particle diameter of a particulate inorganic material (such as zinc oxide doped with a thirteenth group element) is preferably from 10 nm to 50 nm to impart a good combination of optical transmittance and abrasion resistance to the outermost layer 25. When the average primary particle diameter is less than 10 nm, the inorganic material tends to aggregate, thereby making it impossible to stably control the surface resistivity of the outermost layer. In contrast, when the average primary particle diameter is greater than 50 nm, the charge transportability of the outermost layer 25 tends to be unstable, thereby making it impossible to stably perform formation of electrostatic latent images. In addition, roughness of the outermost layer 25 tends to increase, and thereby the outermost layer is easily abraded by a cleaning blade, resulting in occurrence of deficient cleaning. In addition, depending on the specific gravity of the particulate inorganic material, the inorganic material easily precipitates in a dispersion of the inorganic material, thereby deteriorating the life of the outermost layer coating liquid.

The average primary particle diameter of a particulate inorganic material (such as zinc oxide doped with a thirteenth group element) can be determined by a method in which a photograph of particles of a particulate inorganic material taken by a scanning electronic microscope of 3,000 to 10,000 power magnification is obtained and images of 200 particles are subjected to image analysis using image analyzing software.

The content of such a particulate inorganic material in the outermost layer 25 is not particularly limited as long as the surface resistivity of the outermost layer falls in the above-mentioned range. The content is preferably from 7 to 40% by volume to easily control the surface resistivity of the outermost layer while preventing deterioration of the film property and abrasion resistance of the outermost layer. When the content is less than 7% by volume, it often becomes impossible to control the surface resistivity of the outermost layer in the preferable range. In contrast, when the content is greater than 40% by volume, the film property and the abrasion resistance of the outermost layer tend to deteriorate.

The method for determining the content of such a particulate inorganic material (such as zinc oxide doped with a thirteenth group element) in the outermost layer 25 is not particularly limited, and for example a method for quantitative determination using elemental analysis and mapping can be used.

The elemental analysis and mapping method is not particularly limited, and for example, a method using a combination of an energy dispersive X-ray detector and a scanning electron microscope (EDS-SEM) can be used. In this regard, the EDS-SEM is a device such that a sample is scanned with a narrowed electron beam, and the amount of secondary electrons emitted thereby is detected to observe the surface of the sample with 50 to 300,000 power magnification. In addition, by detecting character X-rays, which are emitted from the sample by the electron irradiation, in this device, the ratio of elements in a minor area of the surface of the sample can be determined and mapping of a specific element can be performed.

Measurements of the content of a particulate inorganic material (such as zinc oxide doped with a thirteenth group element) in the outermost layer will be described in detail.

Initially, the cross section of a photoreceptor is obtained by a method such as microtome and FIB (focused ion beam) methods, and then elemental mapping of the particulate inorganic material in the cross section is performed. By dividing the detection area of the element of the inorganic material by the observation area, the ratio of the area of organic/inorganic complex particles to the observation area can be obtained. By converting the area ratio to a volume ratio (i.e., 3/2 power of the area ratio), the ratio of the organic/inorganic complex particles in the outermost layer 25 can be determined.

The method for dispersing such a particulate inorganic material in the outermost layer 25 is not particularly limited, and for example, the below-mentioned dispersing method or the like can be used for preparing the outermost layer coating liquid. The dispersing method is not particularly limited, and ball mills, sand mills, Keddy mills, triple roll mills, pressure homogenizers, ultrasonic dispersing machines, etc. can be used.

The combination of the resin having no charge transportability and the particulate inorganic material is not particularly limited, but combinations of a resin selected from acrylic resins, polycarbonate resins, polyarylate resins, styrene resins, phenolic resins, and silicone resins, and a zinc oxide doped with gallium are preferable.

An additive can be optionally added to the combinations. Specific examples of such an additive include particulate metals and metal compounds, compounds having a reactive organic group, dispersants, surfactants, charge transport materials, plasticizers, leveling agents, etc.

The particulate metals and metal compounds for use as an additive is not particularly limited. Specific examples thereof include gold, silver, copper, aluminum, titanium oxide, tin oxide, zirconium oxide, indium oxide, antimony oxide, calcium oxide, ITO (indium tin oxide), silicon oxide, colloidal silica, aluminum oxide, yttrium oxide, cobalt oxide, copper oxide, iron oxide, manganese oxide, niobium oxide, vanadium oxide, selenium oxide, boron nitride, silicon nitride, etc.

The compounds having a reactive organic group are used for subjecting zinc oxide doped with a thirteenth group element to surface modification to control the surface resistivity of the outermost layer 25 and to enhance the functions of the photoreceptor and the dispersing property of the zinc oxide.

The compounds having a reactive organic group are not particularly limited as long as the compounds can react with a group such as hydroxyl group on the surface of a particulate inorganic material, and for example, organic metal coupling agents can be used. Specific examples thereof include silane coupling agents such as hexytrimethoxy silane, octyltrimethoxy silane, and methacryloxypropyltrimethoxy silane; titanate coupling agents such as isopropyltris(dioctylpyrophosphate) titanate, tetra(2,2-diallyloxymethyl-1-butyl)bis(ditridecyl)phosphite titanate, and isopropyltriisostearoyl titanate; aluminum coupling agents such as acetoalcoxyaluminum disopropylate; etc. These can be used alone or in combination.

The method for subjecting zinc oxide doped with a thirteenth group element to surface modification using a compound having a reactive organic group is not particularly limited. For example, the following methods can be used.

(1) A dry method in which an aqueous or alcoholic solution of an organic metal coupling agent is added to zinc oxide doped with a thirteenth group element, which is agitated by a high speed agitator such as HENSCHEL MIXER, and the mixture is agitated to well mix the components, followed by drying the mixture.

(2) A wet method in which zinc oxide doped with a thirteenth group element is dispersed in water or alcohol to prepare a slurry, and the slurry is added to an aqueous or alcoholic solution of an organic metal coupling agent while agitating the mixture, followed by agitation of the mixture, filtering, washing and drying.

The added amount of such a compound having a reactive organic group for use in covering the particulate inorganic material is not particularly limited, and is determined based on the purpose of the compound such as enhancement of the functions of the photoreceptor and dispersing property of the particulate inorganic material. However, in general, the added amount is preferably from 0.01 to 30% by weight, and more preferably from 0.05 to 15% by weight, based on the total weight of the particulate inorganic material used. When the added amount is less than 0.01% by weight, the effects of the compound having a reactive organic group (such as enhancement of the functions of the photoreceptor and dispersing property of the particulate inorganic material) are hardly produced. In contrast, when the added amount is greater than 30% by weight, an excess amount of the compound is adhered to the particulate inorganic material, thereby often deteriorating the electric property of the photoreceptor.

The dispersant used for satisfactorily dispersing a particulate inorganic material (such as zinc oxide doped with a thirteenth group element) in the outermost layer 25 is not particularly limited, and any known dispersants can be used. In addition, the added amount of such a dispersant is not also particularly limited, but is preferably from 0.5 to 30% by weight, and more preferably from 1 to 15% by weight, based on the total weight of the particulate inorganic material used. When the added amount is less than 0.5% by weight, the effect to well disperse the particulate inorganic material is hardly produced. In contrast, when the added mount is greater than 30% by weight, the residual potential of the photoreceptor tends to seriously increase.

A surfactant can be optionally used for satisfactorily dispersing a particulate inorganic material (such as zinc oxide doped with a thirteenth group element) in the outermost layer 25. The surfactant is not particularly limited, and one or more proper surfactants are used depending on the purpose. In addition, the added amount of such a surfactant is not also particularly limited, but is preferably from 0.5 to 30% by weight, and more preferably from 1 to 15% by weight, based on the total weight of the particulate inorganic material used. When the added amount is less than 0.5% by weight, the effect to well disperse the particulate inorganic material is hardly produced. In contrast, when the added mount is greater than 30% by weight, the residual potential of the photoreceptor tends to seriously increase.

A charge transport compound can be used as an additive for the outermost layer 25. The charge transport compound is not particularly limited, and known positive hole transport materials which have a positive hole transport structure such as triarylamine, hydrozone, pyrazoline and carbazole, and known electron transport materials which have an electron transport structure such as condensed polycyclic quinone, diphenoquinone, and aromatic rings having an electron accepting group such as cyano and nitro groups can be used. These can be used alone or in combination.

When the above-mentioned crosslinked polymers are used as the resin having no charge transportability, charge transport compounds which have a functional group reactive with such a crosslinked polymer such as hydroxyl group, acryloyloxy group and methacryloyloxy group can be used.

The added amount of such a charge transport compound is not particularly limited, but is preferably not greater than 20 parts by weight based on 100 parts by weight of the resin having no charge transportability used, to prevent deterioration of the properties of the photoreceptor due to deterioration of the charge transport compound.

The method for determining the content of a charge transport compound in the outermost layer 25 is not particularly limited. For example, methods using elemental analysis such as XPS, EDX, and WDX (wavelength dispersive X-ray spectroscopy); methods in which the amount is determined based on the intensity of the charge transport compound dyed with a reagent; and Fourier transform infrared spectroscopy (FT-IR) can be used. Among these methods, FT-IR is preferable because quantitative determination can be easily performed thereby and the method has good versatility. In this regard, quantitative determination is preferably performed using a working curve previously prepared by using strength ratios of peaks of FT-IR.

The working curve is prepared, for example, by the following method. Specifically, outermost layers are prepared by using a charge transport compound while changing the added amounts, and then subjected to FT-IR to measure the strength (peak height or peak area) of the vibration peak specific to the charge transport compound. The working curve is prepared based on the ratios of the peaks. In order to enhance the accuracy of the working curve, it is preferable to change the added amount in two to five levels. The vibration peak is preferably a vibration peak specific to the charge transport compound, and more preferably a vibration peak specific to the carbonyl group, which has poor reactivity and whose content in the layer is known.

The method of measuring the content of a charge transport compound in the outermost layer 25 will be described in detail.

Initially, the method for preparing a working curve will be described in detail.

The area ($\alpha x$) of a vibration peak specific to the carbonyl group in an outermost layer to which a charge transport compound is not added is calculated. In addition, the area ($\beta x$) of the vibration peak specific to the carbonyl group in an outermost layer to which a charge transport compound is added is calculated. The areas ($\alpha 20$, $\alpha 40$, $\alpha 60$; $\beta 20$, $\beta 40$, $\beta 60$) of the vibration peak specific to the carbonyl group in outermost layers to which the charge transport compound is added by 20%, 40% and 60% by weight based on the total weight of the outermost layer are measured. Next, the vibration strength ratio ($\beta x/\alpha x$) and the added amount of the charge transport compound are plotted to prepare a working curve.

Next, a sample of the outermost layer, which includes the charge transport compound in an unknown amount, is subjected to the FT-IR ATR to determine the vibration strength ratio. The content of the charge transport compound in the sample outermost layer is calculated using the working curve. When the content of a charge transport compound in the outermost layer 25 is determined, the portion of the outermost layer to be measured with respect to the content is exposed by a method such as etching and cross section forming methods such as microtome, and the content is determined by the method mentioned above.

The plasticizer optionally used for the outermost layer as an additive is not particularly limited, and for example, dibutyltin phthalate and dioctyltin phthalate can be used. These can be used alone or in combination. The added amount of such a plasticizer is not particularly limited, but is preferably from 0 to 30 parts by weight based on 100 parts by weight of the resin having no charge transportability used.

The leveling agent optionally used for the outermost layer as an additive is not particularly limited, and for example, silicone oils such as dimethyl silicone oils and methyl phenyl silicone oils; polymers and oligomers having a perfluoroalkyl group in a side chain thereof; etc. can be used. The added amount of such a leveling agent is not particularly limited, but is preferably from 0 to 1 part by weight based on 100 parts by weight of the resin having no charge transportability used.

The method for preparing the outermost layer 25 is not particularly limited, and a proper method fulfilling the purpose is selected from known methods. For example, a method which includes preparing an outermost layer coating liquid including a resin having no charge transportability, a particulate inorganic material, and optional additives; applying the coating liquid on a photosensitive layer 26; drying the coated liquid by heating; and then crosslinking the layer to form a crosslinked outermost layer can be used.

The coating method is not particularly limited, and a proper coating method is selected in consideration of the viscosity of the coating liquid and the targeted thickness of the outermost layer. Specific examples of the coating method include dip coating methods, spray coating methods, bead coating methods, ring coating methods, etc.

Since the materials used for the outermost layer are a solid or a viscous liquid, it is preferable to dissolve the materials in a solvent. The solvent is not particularly limited as long as the solvent can dissolve or disperse the constitutional materials therein. Specific examples of such a solvent include alcohols such as methanol, ethanol, propanol and butanol; ketones such as acetone, methyl ethyl ketone, methyl isobutyl ketone, and cyclohexanone; esters such as ethyl acetate, and butyl acetate; ethers such as tetrahydrofuran, dioxane and propyl ether; halogen-containing solvents such as dichloromethane, dichloroethane, trichloroethane and chlorobenzene; aromatic solvents such as benzene, toluene and xylene; cellosolves such as methyl cellosolve, ethyl cellosolve, and cellosolve acetate; etc. These solvents can be used alone or in combination.

In order to remove the solvent remaining in the outermost layer after forming the outermost layer by the method mentioned above, the outermost layer is preferably heated to be dried. The heating method is not particularly limited, and for example, heated gases (such as air and nitrogen), heated steam, heating media, infrared rays, and electromagnetic rays can be used. By heating the outermost layer from the side of the coated layer or from the backside (i.e., the side of the electroconductive support 21) of the photoreceptor, the outermost layer can be dried.

The heating temperature is not particularly limited, but is preferably from 100 to 170° C. When the heating temperature is lower than 100° C., a relatively large amount of solvents tends to remain in the outermost layer, thereby often deteriorating the electrophotographic property of the photoreceptor. In contrast, when the heating temperature is higher than 170° C., low molecular components included in the lower layer (such as the photosensitive layer 26) tend to migrate into the outermost layer 25, thereby making it impossible to control the surface resistivity, or deteriorating other properties of the outermost layer.

The thickness of the outermost layer 25 is not particularly limited, but is preferably not greater than 10 μm, and more preferably not greater than 8 μm, so that the resultant photoreceptor can form high resolution images while having high responsiveness. The lower limit of the thickness changes depending on the system for which the photoreceptor is used, but is generally not less than 3 μm so that the resultant photoreceptor has a good combination of charging property and abrasion resistance.

The photosensitive layer 26 may be a single-layered photosensitive layer illustrated in FIG. 10A, or a layered photosensitive layer illustrated in FIG. 10B, 10C or 10D.

The single-layered photosensitive layer is a layer having both a charge generation function and a charge transport function at the same time. The single-layered photosensitive layer includes a charge generation material, a charge transport material, and a binder resin, and optionally includes an additive such as plasticizers, leveling agents and antioxidants.

The charge generation material included in the single-layered photosensitive layer is not particularly limited, and materials mentioned below for use in the layered photosensitive layer can be used. The content of such a charge generation material is not particularly limited, but is preferably from 5 to 40 parts by weight based on 100 parts by weight of the binder resin included in the photosensitive layer.

The charge transport material included in the single-layered photosensitive layer is not particularly limited, and materials mentioned below for use in the layered photosensitive layer can be used. The content of such a charge transport material is not particularly limited, but is preferably not greater than 190 parts by weight, and preferably from 50 to 150 parts by weight, based on 100 parts by weight of the binder resin included in the photosensitive layer.

The binder resin included in the single-layered photosensitive layer is not particularly limited, and resins mentioned below for use in the layered photosensitive layer can be used.

The method for preparing the single-layered photosensitive layer is not particularly limited. For example, a method which includes dissolving or dispersing a charge generation material, a charge transport material, a binder resin, and optional other components in a solvent (such as tetrahydrofuran, dioxane, dichloroethane and cyclohexane) to prepare a photosensitive layer coating liquid; coating the coating liquid; and drying the coated liquid to form a photosensitive layer can be used.

The coating method is not particularly limited, and a proper coating method is selected. Specific examples of the coating method include dip coating methods, spray coating methods, bead coating methods, ring coating methods, etc. The coating liquid can optionally include an additive such as plasticizers, leveling agents, and antioxidants.

The thickness of the single-layered photosensitive layer is not particularly limited, but is preferably from 5 μm to 25 μm.

Next, the layered photosensitive layer will be described. In the layered photosensitive layer, independent layers respectively having a charge generation function and a charge transport function are formed. Specifically, at least a charge generation layer 23 and a charge transport layer 24 are formed, and another layer is optionally formed if desired. Any known charge generation layers, charge transport layers, and other layers can be used for the charge generation layer 23, the charge transport layer 24, and the other layers. The order of forming the charge generation layer 23, and the charge transport layer 24 is not particularly limited, and is determined depending on the image forming conditions of the image forming apparatus for which the photoreceptor is used. Since charge generation materials have poor chemical stability, the charge generation efficiency of the charge generation materials deteriorate when being exposed to acidic gasses such as discharge products formed in the vicinity of a charger used for charging the surface of the photoreceptor, and therefore it is preferable that the charge transport layer 24 is overlaid on the charge generation layer 23 as illustrated in FIGS. 10B and 10C.

The charge generation layer 23 includes a charge generation material, and preferably includes a binder resin. In addition, the charge generation layer can optionally include other components such as antioxidants.

The charge generation material included in the charge generation layer 23 is not particularly limited, and for example, inorganic and organic charge generation materials can be used.

Specific examples of the inorganic charge generation materials include crystalline selenium, amorphous selenium, selenium-tellurium compounds, selenium-tellurium-halogen compounds, selenium-arsenic compounds, and amorphous silicon. In addition, amorphous silicon in which a dangling bond is terminated with a hydrogen atom or a halogen atom or which is doped with a boron atom, or a phosphorous atom can be used.

Specific examples of the organic charge generation materials include phthalocyanine pigments such as metal Phthalocyanine, and metal-free phthalocyanine; azulenium salt type pigments; squaric acid methyne pigments; azo pigments having a carbazole skeleton; azo pigments having a triphenylamine skeleton; azo pigments having a diphenylamine skeleton; azo pigments having a dibenzothiophene skeleton; azo pigments having a fluorenone skeleton; azo pigments having an oxadiazole skeleton; azo pigments having a bisstilbene skeleton; azo pigments having a distyryloxadiazole skeleton; azo pigments having a distyrylcarbazole skeleton; perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoide pigments, and benzimidazole pigments. These can be used alone or in combination.

The binder resin optionally included in the charge generation layer is not particularly limited. Specific examples of the binder resin include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, etc. These resins can be used alone or in combination. In addition, charge transport polymers having a charge transport function such as (1) polymers (e.g., polycarbonate, polyester, polyurethane, polyether, polysiloxane, and acrylic resins), which have an arylamine skeleton, a benzidine skeleton, a hydrazone skeleton, a carbazole skeleton, a stilbene skeleton, and/or a pyrazoline skeleton, and (2) polymers having a polysilane skeleton can also be used alone or in combination as the binder resin.

The other components optionally included in the charge generation layer 23 are not particularly limited, and for example, low molecular weight charge transport materials, solvents, leveling agents, and antioxidants can be included therein. The added amount of such a component is preferably from 0.01% by weight to 10% by weight based on the total weight of the charge generation layer.

The low molecular weight charge transport material optionally included in the charge generation layer is not particularly limited, and known electron transport materials and positive hole transport materials can be used. Specific examples of the electron transport materials include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrobenzothiophene-5,5-dioxide, and diphenoquinone derivatives. These electron transport materials can be used alone or in combination.

Specific examples of the positive hole transport materials include oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. These positive hole transport materials can be used alone or in combination.

The solvent optionally included in the charge generation layer is not particularly limited, and for example, solvents such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, and butyl acetate can be used. These solvents can be used alone or in combination.

The leveling agent optionally included in the charge generation layer is not particularly limited, and for example, silicone oils such as dimethyl silicone oils, and methyl phenyl silicone oils can be used. These can be used alone or in combination.

The method for preparing the charge generation layer 23 is not particularly limited. For example, a method which includes dissolving or dispersing a charge generation material, and a binder resin in another component such as a solvent to prepare a charge generation layer coating liquid; coating the coating liquid on an electroconductive support 21; drying the coated liquid to form a charge generation layer can be used.

The coating methods mentioned above for use in preparing the single-layered photosensitive layer can be used for forming the charge generation layer.

The thickness of the charge generation layer 23 is not particularly limited, but is preferably from 0.01 μm to 5 μm, and more preferably from 0.05 μm to 2 μm.

Next, the charge transport layer will be described.

The charge transport layer 24 is a layer, which maintains on the surface thereof charges applied by a charger and which transports charges generated in the charge generation layer 23 by irradiation to couple the charges with the charges that the charge transport layer maintains on the surface thereof, resulting in formation of an electrostatic latent image. In order to maintain charges applied by a charger, the charge transport layer has to have a high electric resistance. In addition, in order to obtain a high surface potential from the same amount of charges, the charge transport layer has to have a low dielectric constant, and a high charge mobility.

The charge transport layer 24 includes a charge transport material and preferably includes a binder resin. In addition, the charge transport layer 24 can optionally include other components.

The charge transport material included in the charge transport layer 24 is not particularly limited, and for example, electron transport materials, positive hole transport materials, and charge transport polymers can be used as the charge transport material.

The content of a charge transport material in the charge transport layer 24 is not particularly limited, but is preferably from 20 to 80% by weight, and more preferably from 30 to 70% by weight, based on the total weight of the charge transport layer. When the content is less than 20% by weight, the charge transportability of the charge transport layer often deteriorates, and thereby the desired photo-decaying property cannot be imparted to the photoreceptor. In contrast, when the content is greater than 80% by weight, the photoreceptor tends to be easily abraded by various stresses that the photoreceptor receives from the image forming apparatus. Namely, when the content is in the above-mentioned more preferable range (30 to 70% by weight), the resultant photoreceptor has the desired photo-decaying property, and the abrasion loss of the photoreceptor is little even when the photoreceptor is used over a long period of time.

Specific examples of the electron transport materials (i.e., electron accepting materials) used as the charge transport material include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrobenzothiophene-5,5-dioxide, etc. These electron transport materials can be used alone or in combination.

Specific examples of the positive hole transport materials (i.e., electron donating materials) used as the charge transport material include oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives, and thiophene derivatives. These can be used alone or in combination.

The charge transport polymer which can be included in the charge transport layer 24 is a material having both the below-mentioned binder resin function and the charge transport function. Particularly, it is discovered by the present inventors that when an amorphous oxide is used for an intermediate layer 22 (illustrated in FIG. 10C), a charge transport polymer used as a charge transport material in the charge transport layer 24 prevents deterioration of the charging property and formation of image with background development. Therefore, a charge transport polymer is preferably used for such a case.

The charge transport polymer is not particularly limited, and for example, polymers having a carbazole ring, polymers having a hydrozone structure, polysilylene polymers, polymers having a triarylamine structure (disclosed in JP-3852812-B1 (i.e., JP-2000-275880-A), and JP-3990499-B1 (i.e., JP-H11-344819-A)), and polymers having an electron donating group can be used. These can be used alone or in combination. In addition, these can be used in combination with a binder resin to enhance the abrasion resistance and film property of the charge transport layer.

The content of such a charge transport polymer in the charge transport layer 24 is not particularly limited, but is preferably from 40 to 90% by weight, and more preferably from 50 to 80% by weight, based on the total weight of the charge transport layer to impart a good combination of charge transportability, abrasion resistance and film formability to the photoreceptor when the charge transport polymer is used in combination with a binder resin.

The binder resin optionally included in the charge transport layer 24 is not particularly limited, and a proper resin is selected depending on the purpose. Specific examples of the binder resin include polycarbonate resins, polyester resins, methacrylic resins, acrylic resins, polyethylene resins, polyvinyl chloride resins, polyvinyl acetate resins, polystyrene resins, phenolic resins, epoxy resins, polyurethane resins, polyvinylidene chloride resins, alkyd resins, silicone resins, polyvinyl carbazole resins, polyvinyl butyral resins, polyvinylformal resins, polyarylate resins, polyacrylamide resins, phenoxy resins, etc. These can be used alone or in combination.

In addition, the charge transport layer 24 can include a copolymer of a crosslinkable binder resin and a crosslinkable charge transport material.

The other components optionally included in the charge transport layer 24 are not particularly limited, and for example, solvents, plasticizers and leveling agents can be included therein. The added amount of such a component is preferably from 0.01% by weight to 10% by weight based on the total weight of the charge transport layer.

The solvent to be optionally included in the charge transport layer 24 is not particularly limited, and for example, such solvents as mentioned above for use in the charge generation layer 23 can be used alone or in combination. Among these solvents, solvents capable of dissolving the charge transport material and the binder resin used are preferable.

The plasticizer to be optionally included in the charge transport layer 24 is not particularly limited, and for example, conventional plasticizers for use in plasticizing a resin such as dibutyltin phthalate, and dioctyltin phthalate can be used.

The leveling agent to be optionally included in the charge transport layer 24 is not particularly limited, and for example, silicone oils such as dimethyl silicone oils, and methyl phenyl silicone oils; polymers and oligomers having a perfluoroalkyl group in a side chain thereof; etc. can be used.

The method for preparing the charge transport layer 24 is not particularly limited, and a proper method fulfilling the purpose is selected from known methods. For example, a method which includes dissolving or dispersing a charge transport material, and a binder resin in other components such as a solvent to prepare a coating liquid; applying the coating liquid on the charge generation layer 23; and drying the coated liquid by heating to form a charge transport layer can be used.

The coating method is not particularly limited, and a proper coating method is selected in consideration of the viscosity of the coating liquid and the targeted thickness of the charge transport layer. Specific examples of the coating method include dip coating methods, spray coating methods, bead coating methods, ring coating methods, etc.

In order to remove the solvent remaining in the charge transport layer after forming the layer by the method mentioned above, the charge transport layer is preferably heated to be dried. The heating method is not particularly limited, and for example, heated gases (such as air and nitrogen), heated steam, heating media, infrared rays, and electromagnetic rays can be used. By heating the charge transport layer from the side of the coated layer or from the backside (i.e., the side of the electroconductive support 21) of the photoreceptor, the charge transport layer can be dried.

The heating temperature is not particularly limited, but is preferably from 100 to 170° C. When the heating temperature is lower than 100° C., the solvent remaining in the charge transport layer cannot be sufficiently removed, thereby often deteriorating the electrophotographic property and the abrasion resistance of the photoreceptor. In contrast, when the heating temperature is higher than 170° C., the coated layer tends to have defects such as orange peel and cracks, or a problem in that the coated layer is peeled from the lower layer (charge generation layer) is caused. In addition, when the solvent included in the charge transport layer evaporates, the electric property of the photoreceptor tends to deteriorate.

The thickness of the charge transport layer 24 is not particularly limited, but is preferably not greater than 50 μm, and more preferably not greater than 45 μm, so that the resultant photoreceptor can form high resolution images while having high responsiveness. The lower limit of the thickness changes depending on the system for which the photoreceptor is used, but is preferably not less than 5 μm so that the resultant photoreceptor has good charging property (such as charge potential).

The photoreceptor can optionally include other layers such as an undercoat layer and an intermediate layer.

An undercoat layer can be formed between the electroconductive support 21 and the photosensitive layer 26. The undercoat layer typically includes a resin, and optionally includes other components such as antioxidants, fine pigment powders, and coupling agents.

The resin included in the undercoat layer is not particularly limited. Specific examples of the resin include water soluble resins such as polyvinyl alcohol, casein, and sodium polyacrylate; alcohol soluble resins such as nylon copolymers, and methoxymethylated nylon; crosslinkable resins capable of forming a three-dimensional network such as polyurethane resins, melamine resins, phenolic resins, alkyl-melamine resins, and epoxy resins; etc.

Among these resins, resins having good resistance to popular organic solvents (particularly solvents used for forming the photosensitive layer) are preferable because the photosensitive layer is typically prepared by applying a coating liquid including an organic solvent on the undercoat layer.

The fine pigment powder to be optionally included in the undercoat layer is not particularly limited as long as the powder can prevent formation of moiré while decreasing the residual potential of the photoreceptor. Specific examples of such a fine pigment powder include powders of metal oxides such as titanium oxide, silica, alumina, zirconium oxide, tin oxide, indium oxide, etc.

The coupling agent to be optionally included in the undercoat layer is not particularly limited, and for example, silane coupling agents, titanium coupling agents and chromium coupling agents can be used.

The structure of the undercoat layer is not particularly limited, and may have a single-layered structure or a layered structure.

The method for preparing the undercoat layer is not particularly limited, and for example, methods which include preparing a coating liquid including at least a resin using a solvent; applying the coating liquid on the electroconductive support 21 using such a method as mentioned above for use in preparing the photosensitive layer; and drying the coated liquid to form an undercoat layer can be used. In addition, a method including forming a layer of aluminum oxide by an anodic oxidation method; or a method including forming a layer of an organic compound such as polyparaxylylene or an inorganic compound such as $SiO_2$, $SnO_2$, $TiO_2$, ITO or $CeO_2$ by a vacuum evaporation method can also be used.

The thickness of the undercoat layer is not particularly limited, and is determined depending on the purpose of the layer. However, the thickness is generally 1 μm to 5 μm.

The intermediate layer is formed between the photosensitive layer 26 (or charge transport layer 24) and the outermost layer 25 to prevent the charge transport material included in the photosensitive (charge transport) layer from migrating into the outermost layer and to enhance adhesion between the layers. It is preferable that the intermediate layer is hardly dissolved or is not dissolved in the outermost layer coating liquid. The intermediate layer includes a resin as a main component, and optionally includes other components such as antioxidants. Specific examples of such a resin include polyamide resins, alcohol soluble nylon resins, water soluble polyvinyl butyral resins, polyvinyl butyral resins, polyvinyl alcohol resins, etc. The method for preparing the intermediate layer is not particularly limited, and for example, the methods mentioned above for use in preparing the photosensitive layer can be used. The thickness of the intermediate layer is generally from 0.05 μm to 2 μm.

The electroconductive support 21 is not particularly limited as long as the support has a volume resistivity of not greater than $10^{10}$ Ω·cm. Specific examples of such materials include plastic cylinders, plastic films or paper sheets, on the surface of which a layer of a metal such as aluminum, nickel, chromium, nichrome, copper, gold, silver and platinum, or a layer of a metal oxide such as tin oxides and indium oxides, is formed by vapor deposition or sputtering. In addition, a plate of a metal such as aluminum, aluminum alloys, nickel and stainless steel can be used. A metal cylinder, which is prepared by tubing a metal such as aluminum, aluminum alloys, nickel and stainless steel using a method such as impact ironing or direct ironing, and then subjecting the surface of the tube to one or more treatments such as cutting, super finishing and polishing, can also be used as the support. Further, endless belts (such as endless nickel belts or stainless steel belts disclosed in JP-52-36016-A can also be used as the electroconductive support 21.

An electroconductive layer may be formed on the electroconductive support 21. The method for forming such an electroconductive layer is not particularly limited. For example, a method including dissolving or dispersing an electroconductive powder and a resin in an organic solvent to prepare a coating liquid; applying the coating liquid to the electroconductive support 21; and drying the coated liquid to form an electroconductive layer can be used. In addition, a method including forming an electroconductive layer using a heat-shrinkable resin tube, which is made of a combination of a resin (such as polyvinyl chloride, polypropylene, polyesters, polyvinylidene chloride, polyethylene, chlorinated rubber and fluorine-containing resins (such as TEFLON)) and an electroconductive material, can also be used.

Specific examples of the electroconductive powder used for preparing the electroconductive layer include carbon black, acetylene black, powders of metals such as aluminum, nickel, iron, nichrome, copper, zinc and silver, and powders of metal oxides such as electroconductive tin oxides, and ITO.

Specific examples of the binder resin used for preparing the electroconductive layer include known thermoplastic resins, thermosetting resins, and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene resins, poly-N-vinyl carbazole, acrylic resins, silicone resins, epoxy resins, melamine resins, urethane resins, phenolic resins, and alkyd resins.

Specific examples of the solvent used for preparing the electroconductive layer include tetrahydrofuran, dichloromethane, methyl ethyl ketone, and toluene.

Next, examples of the photoreceptor for use in the image forming apparatus of this disclosure will be described.

FIGS. 11A-11D illustrate cross sections of photoreceptors for use in the first embodiment of this disclosure.

Figure 11A:
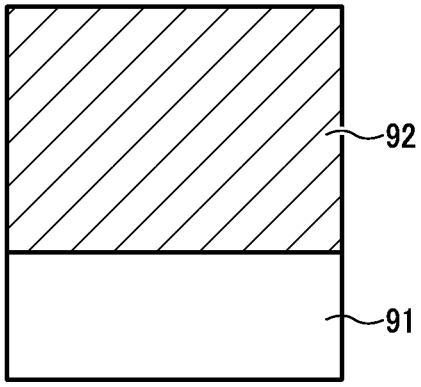
FIGS. 11A-11D are schematic views illustrating examples of another photoreceptor for use in an image forming apparatus according to an embodiment.
Figure 11B:
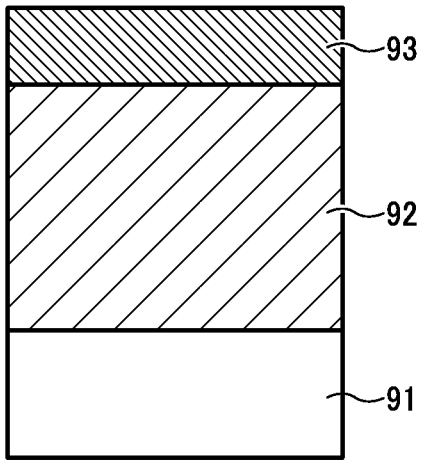
Figure 11C:
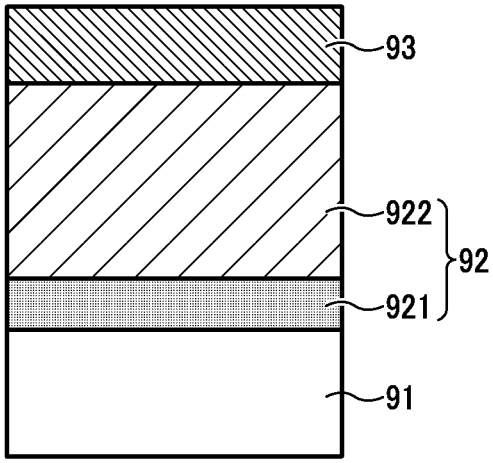
Figure 11D:
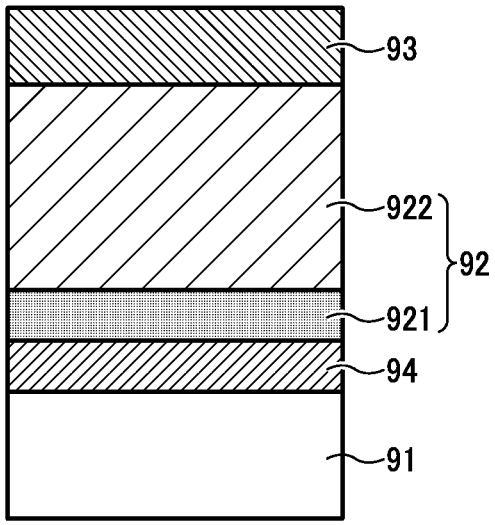

FIG. 11A illustrates a photoreceptor having a structure such that a photosensitive layer 92 including a particulate inorganic material in a surface portion thereof is formed on an electroconductive support 91. FIG. 11B illustrates a photoreceptor having a structure such that the photosensitive layer 92 and an outermost layer 93 including a particulate inorganic material are formed in this order on the electroconductive support 91. FIG. 11C illustrates a photoreceptor having a structure such that a charge generation layer 921, a charge transport layer 922, and the outermost layer 93 including a particulate inorganic material are formed in this order on the electroconductive support 91. FIG. 11D illustrates a photoreceptor having a structure such that an undercoat layer 94, the charge generation layer 921, the charge transport layer 922, and the outermost layer 93 including a particulate inorganic material are formed in this order on the electroconductive support 91. In FIGS. 11C and 11D, a combination of the charge generation layer 921 and the charge transport layer 922 serves as the photosensitive layer 92.

The photoreceptor 10 serving as an image bearing member of the image forming apparatus of this disclosure has a structure such that at least the photosensitive layer 92 and the outermost layer 93 are overlaid on the electroconductive support 91, and other layers can be optionally formed.

The electroconductive support 91 is made of a material having a volume resistivity of not greater than $10^{10}$ Ω·cm. Specific examples of such materials include plastic cylinders, plastic films or paper sheets, on the surface of which a layer of a metal such as aluminum, nickel, chromium, nichrome, copper, gold, silver and platinum, or a layer of a metal oxide such as tin oxides and indium oxides, is formed by deposition or sputtering. In addition, a plate of a metal such as aluminum, aluminum alloys, nickel and stainless steel can be used. A metal cylinder, which is prepared by tubing a metal such as aluminum, aluminum alloys, nickel and stainless steel using a method such as impact ironing or direct ironing, and then subjecting the surface of the tube to one or more treatments such as cutting, super finishing and polishing, can also be used as the substrate.

In addition, endless belts (such as endless nickel belts or stainless steel belts disclosed in JP-52-36016-A can also be used as the electroconductive support 91.

Further, electroconductive materials in which an electroconductive layer is formed on the above-mentioned supports by coating a coating liquid in which an electroconductive powder is dispersed in a resin can also be used as the electroconductive support 91.

Specific examples of the electroconductive powder include carbon black, acetylene black, powders of metals such as aluminum, nickel, iron, nichrome, copper, zinc and silver, and powders of metal oxides such as electroconductive tin oxides and ITO.

Specific examples of the binder resin used in combination with the electroconductive powder include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, and alkyd resins.

The electroconductive layer is typically formed by coating a coating liquid in which the electroconductive powder and the binder resin are dissolved or dispersed in a proper solvent such as tetrahydrofuran, dichloromethane, methyl ethyl ketone and toluene.

In addition, cylindrical supports on which an electroconductive layer is formed using a heat-shrinkable resin tube which is made of a combination of a resin (such as polyvinyl chloride, polypropylene, polyesters, polyvinylidene chloride, polyethylene, chlorinated rubber and fluorine-containing resins (such as TEFLON)) and an electroconductive material can also be used as the electroconductive support 91.

Next, the photosensitive layer 92 will be described.

The photosensitive layer 92 may have a single-layered structure or a layered structure. Initially, the layered photosensitive layer will be described for the purpose of explanation.

The charge generation layer 921 is a layer including a charge generation material as a main component. Any known charge generation materials can be used for the charge generation layer 921. Specific examples thereof include monazo pigments, disazo pigments, trisazo pigments, perylene pigments, perynone pigments, quinacridone pigments, polycyclic quinone pigments, squaric acid dyes, phthalocyanine pigments, naphthalocyanine pigments, azulenium salt type pigments, etc. These can be used alone or in combination.

In the photoreceptor of this embodiment, azo pigments and/or Phthalocyanine pigments are preferably used. Among Phthalocyanine pigments, titanyl phthalocyanine having an X-ray diffraction spectrum such that a maximum diffraction peak is observed at a Bragg 2θ angle of 27.2° (±0.2°) when using a CuKα X-ray having a wavelength of 1.514 Å) is preferable.

The charge generation layer 921 can be prepared, for example, by a method which includes dissolving or dispersing a charge generation material, and a binder resin in a solvent to prepare a charge generation layer coating liquid; coating the coating liquid on an electroconductive support 91; and drying the coated liquid to form the charge generation layer.

Specific examples of the binder resin optionally used for forming the charge generation layer 921 include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, polysulfone resins, poly-N-vinylcarbazole resins, polyacrylamide resins, polyvinyl benzal resins, polyester resins, phenoxy resins, vinyl chloride-vinyl acetate copolymers, polyvinyl acetate resins, polyphenylene oxide resins, polyvinyl pyridine resins, cellulose resins, casein, polyvinyl alcohol resins, and polyvinyl pyrrolidone.

The added amount of such a binder resin is from 0 to 500 parts by weight, and preferably from 10 to 300 parts by weight, based on 100 parts by weight of the charge generation material used.

Specific examples of the solvent used for forming the charge generation layer 921 include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, etc. Among these, ketone solvents, ester solvents, and ether solvents are preferably used.

Specific examples of the coating method for use in preparing the charge generation layer 921 include dip coating methods, spray coating methods, bead coating methods, nozzle coating methods, spinner coating methods, ring coating methods, etc.

The thickness of the charge generation layer 921 is from 0.01 μm to 5 μm, and preferably from 0.1 μm to 2 μm.

The charge transport layer 922 can be prepared, for example, by a method which includes dissolving or dispersing a charge transport material, and a binder resin in a solvent to prepare a charge transport layer coating liquid; coating the coating liquid on the charge generation layer 921; and drying the coated liquid to form the charge transport layer.

The charge transport layer 922 optionally includes other components such as plasticizers, leveling agents, and antioxidants.

Charge transport materials are broadly classified into positive hole transport materials and electron transport materials.

Specific examples of the electron transport materials include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrobenzothiophene-5,5-dioxide, and benzoquinone derivatives.

Specific examples of the positive hole transport materials include poly-N-vinylcarbazole and derivatives thereof, poly-γ-carbazolylethylglutamate and derivatives thereof, pyrene-formaldehyde condensation products and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc.

These charge transport materials can be used alone or in combination.

Specific examples of the binder resin for use in the charge transport layer 922 include known thermoplastic resins and thermosetting resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonate, cellulose acetate resins, ethyl cellulose resins, polyvinyl butyral, polyvinyl formal, polyvinyl toluene, poly-N-vinyl carbazole, acrylic resins, silicone resins, epoxy resins, melamine resins, urethane resins, phenolic resins, alkyd resins, etc.

The added amount of such a charge transport material in the charge transport layer 922 is from 20 to 300 parts by weight, and preferably from 40 to 150 parts by weight, based on 100 parts by weight of the binder resin used.

The thickness of the charge transport layer 922 is preferably not greater than 25 μm so that the resultant photoreceptor can form high resolution images while having high responsiveness. The lower limit of the thickness changes depending on the conditions (particularly charge potential) of the system for which the photoreceptor is used, but is preferably not less than 5 μm.

Specific examples of the solvent used for forming the charge transport layer 922 include tetrahydrofuran, dioxane, toluene, dichloromethane, monochlorobenzene, cyclohexanone, methyl ethyl ketone, acetone, etc.

The charge transport layer 922 can optionally include other components such as plasticizers and leveling agents.

Any known plasticizers for use in plasticizing resins, such as dibutyltin phthalate and tioctyltin phthalate, can be used for the charge transport layer 922. The added amount of such a plasticizer is from 0 to 30% by weight based on the weight of the binder resin.

Silicone oils such as dimethyl silicone oils and methyl phenyl silicone oils; polymers and oligomers having a perfluoroalkyl group in a side chain thereof; etc. can be used as the leveling agent. The added amount of such a leveling agent is preferably from 0 to 1% by weight based on the weight of the binder resin used.

When the charge transport layer 922 is the outermost layer, the charge transport layer can include a particulate inorganic material. Specific examples of such a particulate inorganic material include powders of metals such as copper, tin, aluminum and indium; metal oxides such as silicon oxide, silica, tin oxide, zinc oxide, aluminum oxide, titanium oxide, indium oxide, antimony oxide, bismuth oxide, antimony-doped tin oxide, and tin-doped indium oxide; potassium titanate, etc. Among these, powders of metal oxides are preferable, and particularly powders of silicone oxide, aluminum oxide and titanium oxide are preferable.

The average primary particle diameter of the particulate inorganic material in the charge transport layer 922 is preferably from 0.01 μm to 0.5 μm so that the charge transport layer 922 has a good combination of optical transmittance and abrasion resistance. When the average primary particle diameter is less than 0.01 μm, the abrasion resistance of the charge transport layer 922 tends to deteriorate and the particulate inorganic material cannot be well dispersed in the charge transport layer. When the average primary particle diameter is greater than 0.5 μm, problems such that the particulate inorganic material precipitates in a coating liquid, and a film of toner is formed on the charge transport layer 922 tend to be caused.

With respect to the added amount of such a particulate inorganic material in the charge transport layer 922, the larger the added amount, the better the abrasion resistance of the charge transport layer 922. However, when the added amount is too large, problems such that the residual potential of the photoreceptor increases and optical transmittance of the charge transport layer decreases, resulting in deterioration of image qualities are caused. From this point of view, the added amount of a particulate inorganic material is generally not greater than 30% by weight, and preferably not greater than 20% by weight, based on the total weight of solid components included in the charge transport layer. The lower limit of the added amount is generally 3% by weight.

The particulate inorganic material to be included in the charge transport layer 922 is preferably subjected to a surface treatment using a surface treatment agent so that the particulate inorganic material have good dispersing property. When the particulate inorganic material is poorly dispersed in the charge transport layer 922, not only the residual potential of the photoreceptor increases, but also problems such that the transparency and abrasion resistance of the charge transport layer deteriorate, and coating defects are formed are caused. Therefore, it becomes impossible for the photoreceptor to have good durability and to produce high quality images.

Next, a case where the photosensitive layer 92 is a single-layered photosensitive layer will be described.

The single-layered photosensitive layer includes at least a charge generation material, and a binder resin, and preferably includes a charge transport material. When a charge transport material is included in the single-layered photosensitive layer, the photosensitive layer is a functionally separated photosensitive layer.

The single-layered photosensitive layer is typically prepared by a method including preparing a coating liquid by dissolving or dispersing a charge generation material, a charge transport material, and a binder resin in a solvent; coating the coating liquid; and then drying the coated liquid to prepared the single-layered photosensitive layer.

When the single-layered photosensitive layer 92 is the outermost layer, such a particulate inorganic material as mentioned above for use in the charge transport layer 922 can be included in the single-layered photosensitive layer 92. The single-layered photosensitive layer 92 can optionally include other components such as plasticizers, leveling agents, and antioxidants.

The resins mentioned above for use as the binder resin of the charge transport layer 922 can be used for the single-layered photosensitive layer 92. In addition, the resins mentioned above for use as the binder resin of the charge generation layer 921 can be used in combination with the resins mentioned above for use as the binder resin of the charge transport layer 922.

The added amount of a charge generation material in the single-layered photosensitive layer 92 is preferably from 5 to 40 parts by weight based on 100 parts by weight of the binder resin used, and the added amount of a charge transport material in the single-layered photosensitive layer 92 is preferably from 0 to 190 parts by weight, and more preferably from 50 to 150 parts by weight, based on 100 parts by weight of the binder resin used.

The single-layered photosensitive layer is typically prepared by applying a coating liquid prepared by dissolving or dispersing a charge generation material, an optional charge transport material, and a binder resin in a solvent (such as tetrahydrofuran, dioxane, dichloroethane and cyclohexane) using a dispersing machine; coating the coating liquid by a method such as dip coating methods, spray coating methods, and bead coating methods; and then drying the coated liquid to prepared the single-layered photosensitive layer.

The thickness of the single-layered photosensitive layer 92 is preferably from 5 μm to 25 μm.

The undercoat layer 94 is optionally formed between the electroconductive support 91 and the photosensitive layer 92. The undercoat layer includes a resin as a main component.

The resin included in the undercoat layer preferably has good resistance to popular organic solvents because the photosensitive layer is typically formed by applying a coating liquid including an organic solvent on the undercoat layer. Specific examples of the resin include water soluble resins such as polyvinyl alcohol, casein, and sodium polyacrylate; alcohol soluble resins such as nylon copolymers and methoxymethylated nylon; crosslinkable resins capable of forming a three-dimensional network such as polyurethane resins, melamine resins, phenolic resins, alkyl-melamine resins, and epoxy resins; etc.

In order to prevent formation of moiré while decreasing the residual potential of the photoreceptor, a particulate metal oxide such as titanium oxide, silica, alumina, zirconium oxide, tin oxide, and indium oxide can be included in the undercoat layer 94.

The undercoat layer 94 can be prepared using such solvents and coating methods as mentioned above for use in preparing the photosensitive layer 92.

In addition, silane coupling agents, titanium coupling agents and chromium coupling agents can be used for forming the undercoat layer 94. Further, a layer of aluminum oxide prepared by an anodic oxidation method, a layer of an organic compound such as polyparaxylylene or an inorganic compound such as $SiO_2$, $SnO_2$, $TiO_2$, ITO or $CeO_2$ prepared by a vacuum evaporation method, and other known undercoat layers can also be used as the undercoat layer 94.

The thickness of the undercoat layer 94 is generally 0 to 5 μm.

The outermost layer 93 including a particulate material can be formed on the photosensitive layer 92.

The outermost layer 93 includes at least a particulate material and a binder resin. Specific examples of the binder resin include thermoplastic resins such as polyarylate resins and polycarbonate resins; crosslinkable resins such as urethane resins and phenolic resins; etc.

Organic and inorganic materials are used for the particulate material. Specific examples of the particulate organic materials include particulate fluorine-containing resins, and particulate carbons. Specific examples of the particulate inorganic materials include powders of metal such as copper, tin, aluminum and indium; powders of metal oxides such as silicon oxide, silica, tin oxide, zinc oxide, aluminum oxide, titanium oxide, indium oxide, antimony oxide, bismuth oxide, antimony-doped tin oxide, and tin-doped indium oxide; powders of potassium titanate, etc. Among these, powders of metal oxides are preferable, and powders of silicon oxide, aluminum oxide, and titanium oxide are more preferable.

These particulate materials can be used alone or in combination.

The average primary particle diameter of the particulate inorganic material is preferably from 0.01 μm to 0.5 μm so that the outermost layer 93 has a good combination of optical transmittance and abrasion resistance. When the average primary particle diameter is less than 0.01 μm, the abrasion resistance of the outermost layer 93 tends to deteriorate and the particulate inorganic material cannot be well dispersed in the outermost layer. When the average primary particle diameter is greater than 0.5 μm, problems such that the particulate inorganic material precipitates in a coating liquid, and a film of toner is formed on the outermost layer 93 tend to be caused.

With respect to the added amount of such a particulate inorganic material, the larger the added amount, the better the abrasion resistance of the outermost layer 93. However, if the added amount is too large, problems such that the residual potential of the photoreceptor increases and optical transmittance of the outermost layer decreases, resulting in deterioration of image qualities are caused. From this point of view, the added amount of a particulate inorganic material is generally not greater than 50% by weight, and preferably not greater than 30% by weight, based on the total weight of solid components included in the outermost layer. The lower limit of the added amount is generally 5% by weight.

The particulate inorganic material is preferably subjected to a surface treatment using at least one surface treatment agent to enhance the dispersing property thereof.

When the particulate inorganic material is poorly dispersed in the outermost layer, not only the residual potential of the photoreceptor increases, but also problems such that the transparency and abrasion resistance of the outermost layer deteriorate, and coating defects are formed are caused. Therefore, it becomes impossible for the photoreceptor to have good durability and to produce high quality images.

Conventional surface treatment agents can be used for the surface treatment for the particulate inorganic materials. Among these surface treatment agents, surface treatment agents which do not deteriorate the insulating property of the particulate inorganic materials are preferable. Specific examples thereof include titanate coupling agents, aluminum coupling agents, zircoaluminate coupling agents, higher fatty acids. In addition, surface treatments using a combination of such a surface treatment agent and a silane coupling agent, and surface treatments using $Al_2O_3$, $TiO_2$, $ZrO_2$, silicone, and aluminum stearate can also be used. Further, combinations of these surface treatments can also be used. By performing these surface treatments, the dispersing property of particulate inorganic materials can be enhanced, and in addition formation of blurred images can be prevented.

When only a silane coupling agent is used for the surface treatment, a problem in that the resultant photoreceptor forms blurred images tends to be caused. However, by using a combination of a silane coupling agent and another surface treatment agent, it is often possible to prevent occurrence of the blurred image problem.

The amount of a surface treatment agent used for treating a particulate inorganic material changes depending on the average primary particle diameter of the particulate inorganic material, but is preferably from 3 to 30% by weight, and more preferably from 5 to 20% by weight, based on the weight of the particulate inorganic material. When the amount is less than the range, the dispersing effect of the surface treatment agent cannot be satisfactorily produced. In contrast, when the amount is greater than the range, the residual potential of the photoreceptor tends to increase.

The thickness of the outermost layer 93 is preferably from 1.0 μm to 8.0 μm.

The image bearing member (such as photoreceptor) to be repeatedly used for a long period of time preferably has a good combination of mechanical durability and abrasion resistance.

In general, chargers in image forming apparatus generate ozone and NOx gasses, and such gasses are adhered to a photoreceptor of the image forming apparatus, and thereby blurred images are formed by the photoreceptor.

In order to prevent formation of such blurred images, the surface of the photoreceptor is preferably abraded at a predetermined speed or more. Therefore, when the photoreceptor is repeatedly used for a long period of time, the thickness of the outermost layer 93 is preferably not less than 1.0 μm.

When the thickness of the outermost layer 93 is greater than 8.0 μm, problems such that the residual potential of the photoreceptor increases, resulting in deterioration of reproducibility of fine dot images tend to be caused.

The particulate inorganic materials mentioned above can be dispersed by a proper dispersing machine. The average particle diameter of a particulate inorganic material in a dispersion used for forming the outermost layer coating liquid is preferably not greater than 1 μm, and preferably not greater than 0.5 μm so that the outermost layer 93 has good optical transmittance.

Dip coating methods, ring coating methods, and spray coating methods can be preferably used as the method for forming the outermost layer 93 on the photosensitive layer 92. Among these coating methods, a spray coating method in which a coating liquid is ejected from a nozzle having a micro opening to form micro droplets of the coating liquid, so that the droplets are adhered to the surface of the photosensitive layer 92 can be preferably used.

Specific examples of the solvent used for such a coating liquid includes tetrahydrofuran, dioxane, toluene, dichloromethane, monochlorobenzene, dichloroethane, cyclohexanone, methyl ethyl ketone, acetone, etc.

The outermost layer 93 can include a charge transport material to reduce the residual potential of the resultant photoreceptor and to impart high responsiveness to the photoreceptor. Specific examples of the charge transport material include the charge transport materials for use in the charge transport layer 922.

When a low molecular charge transport material is used, concentration gradient of the low molecular charge transport material may be formed in the outermost layer 93.

The outermost layer 93 can preferably include a charge transport polymer, which has both the charge transport function and the binder resin function.

The outermost layer including such a charge transport polymer has good abrasion resistance. Any known charge transport polymers can be used for the charge transport polymer. Among these, charge transport polymers having a structure such as polycarbonate, polyurethane, polyester, and polyether are preferable, and polycarbonate having a triarylamine structure in the main chain and/or a side chain is more preferable.

The outermost layer 93 preferably has a Martens hardness of not less than 190 N/mm$^2$, and an elastic work (We/Wt) of not less than 37.0%. The Martens hardness and the elastic work are measured under the following conditions.

Instrument used: FISCHER SCOPE H-100 from Fischer Instruments K.K.

Test method: Loading and unloading are repeated once

Indenter: Micro-Vickers indenter

Maximum load: 9.8 mN

Loading/unloading time: 30 seconds

Retention time: 5 seconds

When the Martens hardness of the outermost layer 93 is less than 190 N/mm$^2$, a problem in that toner is adhered to the surface of the photoreceptor tends to be caused. In addition, when the elastic work is less than 37.0%, a problem in that when images whose image area proportion is different in the axial direction of the photoreceptor are formed, the abrasion loss of the outermost layer 93 changes in the axial direction of the photoreceptor, thereby forming uneven images is caused. Therefore, it is preferable to control the hardness and the elastic work of the outermost layer 93 by adjusting the added amount of the particulate inorganic material and choosing a proper binder resin. The hardness and the elastic work of polycarbonate and polyarylate are enhanced by incorporating a rigid structure into the resin skeleton. In addition, by using the above-mentioned charge transport polymers, the hardness and the elastic work can be enhanced.

Next, the toner for use in the image forming apparatus of this disclosure will be described by reference to examples. In the descriptions in the following examples, the numbers represent weight ratios in parts, unless otherwise specified.

Preparation Example 1

Preparation of Fatty Acid Metal Salt (Zinc Stearate 1)

Initially, 140 parts of stearic acid was fed into 1,000 parts of ethanol, and the mixture was heated to 75° C. Next, 50 parts of zinc hydroxide was gradually added to the mixture, and the mixture was agitated for one hour. The mixture was then cooled to 20° C. to obtain the precipitate (reaction product). The precipitate was dried at 150° C. to remove ethanol therefrom. The thus prepared solid zinc stearate was crushed using a hammer mill, and then pulverized using a jet pulverizer (1-20 JET MILL from Nippon Pneumatic Mgf. Co., Ltd.). The pulverized zinc stearate was classified by an air classifier (DS-20/DS-10 classifier from Nippon Pneumatic Mgf. Co., Ltd.), wherein the cut point was 5.6 μm. Thus, a zinc stearate 1 having a volume average particle diameter of 5.0 μm was prepared.

Preparation Example 2

Preparation of Fatty Acid Metal Salt (Zinc Stearate 2)

The procedure for preparation of the zinc stearate 1 was repeated except that the cut point was changed to 1.0 μm in the air classification treatment. Thus, a zinc stearate 2 having a volume average particle diameter of 0.7 μm was prepared.

Preparation Example 3

Preparation of Fatty Acid Metal Salt (Zinc Stearate 3)

The procedure for preparation of the zinc stearate 1 was repeated except that the cut point was changed to 0.9 μm in the air classification treatment. Thus, a zinc stearate 3 having a volume average particle diameter of 0.65 μm was prepared.

Preparation Example 4

Preparation of Fatty Acid Metal Salt (Zinc Stearate 4)

The procedure for preparation of the zinc stearate 1 was repeated except that the cut point was changed to 7.5 μm in the air classification treatment. Thus, a zinc stearate 4 having a volume average particle diameter of 7.0 μm was prepared.

Preparation Example 5

Preparation of Fatty Acid Metal Salt (Zinc Stearate 5)

The procedure for preparation of the zinc stearate 1 was repeated except that the air classification treatment was not performed. Thus, a zinc stearate 5 having a volume average particle diameter of 7.5 μm was prepared.

Preparation Example 6

Preparation of Fatty Acid Metal Salt (Magnesium Stearate)

The procedure for preparation of the zinc stearate 1 was repeated except that the zinc hydroxide was replaced with 30 parts of magnesium hydroxide. Thus, a magnesium stearate having a volume average particle diameter of 5.0 μm was prepared.

Preparation Example 7

Preparation of Fatty Acid Metal Salt (Zinc Behenate)

The procedure for preparation of the zinc stearate 1 was repeated except that the stearic acid was replaced with 140 parts of behenic acid. Thus, a zinc behenate having a volume average particle diameter of 5.0 μm was prepared.

Preparation Example 8

Synthesis of Ester Waxes

A fatty acid component and an alcoholic component were fed into a reaction vessel in such a molar ratio as illustrated in Table 2 below together with a catalyst (in an effective amount). The components were subjected to an esterification reaction at 240° C. under a nitrogen gas flow. Thus, ester waxes 1-6 were prepared as illustrated in Table 2.

TABLE 2

| | Endothermic peak | Fatty acid component (molar ratio) | | | Alcoholic component (molar ratio) | |
|---|---|---|---|---|---|---|
| Ester wax | temperature (° C.) | Palmitic acid | Stearic acid | Behenic acid | Stearyl alcohol | Behenyl alcohol |
| 1 | 69 | 10 | 70 | 20 | 80 | 20 |
| 2 | 83 | 60 | 40 | | 70 | 30 |
| 3 | 67 | | 40 | 60 | 80 | 20 |
| 4 | 62 | | 40 | 60 | | 100 |
| 5 | 57 | | 50 | 50 | 50 | 50 |
| 6 | 87 | 80 | 20 | | 70 | 30 |

Preparation Example 9

Synthesis of Crystalline Polyester Resin 1

The following components were fed into a 5-liter four-necked flask equipped with a nitrogen feed pipe, a dewatering conduit, an agitator and a thermocouple.

| | |
|---|---|
| 1,10-Decanedioic acid | 2,120 g |
| 1,8-Octanediol | 1,520 g |
| 1,6-hexanediol | 1,200 g |
| Hydroquinone | 4.9 g |

The mixture was reacted for 10 hours at 180° C., followed by a reaction for 3 hours at 200° C. and a reaction for 2 hours under a pressure of 8.3 kPa. Thus, a crystalline polyester resin 1 was prepared. The properties of the crystalline polyester resin 1 are described in Table 3 below.

Preparation Example 10

Synthesis of Crystalline Polyester Resin 2

The procedure for preparation of the crystalline polyester resin 1 was repeated except that the following components were used.

| | |
|---|---|
| 1,10-Decanedioic acid | 1,600 g |
| 1,8-Octanediol | 1,250 g |
| Hydroquinone | 4.9 g |

Thus, a crystalline polyester resin 2 was prepared. The properties of the crystalline polyester resin 2 are described in Table 3 below.

Preparation Example 11

Synthesis of Crystalline Polyester Resin 3

The procedure for preparation of the crystalline polyester resin 1 was repeated except that the following components were used, and the reaction under a pressure of 8.3 kPa was performed for 1.5 hours.

| | |
|---|---|
| 1,10-Decanedioic acid | 2,120 g |
| 1,8-Octanediol | 1,000 g |

-continued

| | |
|---|---|
| 1,4-Butanediol | 1,520 g |
| Hydroquinone | 3.9 g |

Thus, a crystalline polyester resin 3 was prepared. The properties of the crystalline polyester resin 3 are described in Table 3 below.

TABLE 3

| Crystalline polyester | Endothermic peak temperature (° C.) | Weight average molecular weight (Mw) | Molecular weight distribution (Mw/Mn) |
|---|---|---|---|
| 1 | 68 | 15,000 | 3.7 |
| 2 | 60 | 11,000 | 3.9 |
| 3 | 77 | 26,000 | 5.6 |

Examples 1-21 and Comparative Examples 1-12

Toners of Examples 1-21 and Comparative examples 1-12 were prepared as follows.

Example 1

(1) Preparation of Toner Component Liquid (a) Synthesis of Non-Crystalline Polyester Resin 1

The following components were fed into a reaction vessel equipped with a condenser, an agitator and a nitrogen feed pipe to perform a polycondensation reaction for 8 hours at 230° C. under normal pressure.

| | |
|---|---|
| Ethylene oxide adduct (2 mole) of bisphenol A | 67 parts |
| Propylene oxide adduct (3 mole) of bisphenol A | 84 parts |
| Terephthalic acid | 274 parts |
| Dibutyl tin oxide | 2 parts |

The reaction was further continued for 5 hours under a reduced pressure of from 10 mmHg to 15 mmHg (1,333 Pa to 2,000 Pa).

Thus, a crystalline polyester resin 1 was prepared. It was confirmed that the crystalline polyester resin 1 has a number average molecular weight (Mn) of 2,100, a weight average molecular weight (Mw) of 5,600, and a glass transition temperature (Tg) of 55° C.

(b) Preparation of Master Batch

The following components are mixed using a HENSCHEL MIXER mixer (from Mitsui Mining Co., Ltd.) to prepare a mixture.

| | |
|---|---|
| Carbon black (PRINTEX 35 from Degussa AG, having DBP absorption of 42 ml/100 g, and pH of 9.5) | 540 parts |
| Non-crystalline polyester resin 1 prepared above | 1,200 parts |
| Water | 1,000 parts |

The mixture was kneaded for 30 minutes using a twin roll mill in which the rollers was heated to 150° C., and the kneaded mixture was cooled by roll cooling, followed by pulverization using a pulverizer (Hosokawa Micron Corporation) to prepare a master batch.

(c) Preparation of Toner Component Liquid

Initially, 100 parts of the non-crystalline polyester resin 1 was agitated in 130 parts of ethyl acetate to be dissolved therein. Next, 10 parts of a carnauba wax (having a molecular weight of 1,800, an acid value of 2.5 mgKOH/g, and a penetration of 1.5 mm (at 40° C.)), and 10 parts of the above-prepared master batch were added to the beaker. The mixture was subjected to bead milling under the following conditions.

Bead mill: ULTRAVISCOMILL from Aimex Co., Ltd.

Liquid feeding speed: 1 kg/hour

Peripheral speed of disc: 6 msec

Dispersion media: zirconia beads with a diameter of 0.5 mm

Filling factor of beads: 80% by volume

Repeat number of dispersing operation: 3 times (3 passes)

Thus, a toner component liquid (i.e., oil phase liquid) was prepared.

(2) Preparation of Particulate Resin Dispersion A1

The following components were fed into a reaction vessel equipped with an agitator and a thermometer.

| | |
|---|---|
| Water | 683 parts |
| Sodium salt of sulfate of an ethylene oxide adduct of methacrylic acid (ELEMINOL RS-30 from Sanyo Chemical Industries Ltd.) | 16 parts |
| Styrene | 83 parts |
| Methacrylic acid | 83 parts |
| Butyl acetate | 110 parts |
| Ammonium persulfate | 1 part |

The mixture was agitated for 15 minutes by the agitator rotated at a revolution of 400 rpm. Thus, a white emulsion was prepared. The emulsion was heated to 75° C. to perform a reaction for 5 hours. Further, 30 parts of a 1% by weight aqueous solution of ammonium persulfate was added thereto, and the mixture was aged for 5 hours at 75° C. Thus, an aqueous dispersion (particulate resin dispersion A1) of a vinyl resin (copolymer of styrene-methacrylic acid-butyl acrylate-sodium salt of sulfate of an ethylene oxide adduct of methacrylic acid) was prepared. The volume average particle diameter of particles of the particulate resin dispersion A1, which was measured with an instrument LA-920 from Horiba, Ltd, was 9 nm.

(3) Preparation of Toner 1

(a) Preparation of Aqueous Phase Liquid

The following components were mixed in a vessel using a mixer.

| | |
|---|---|
| Water | 660 parts |
| Particulate resin dispersion A1 | 25 parts |
| Sodium salt of dodecyl diphenyl ether disulfonic acid (ELEMINOL MON-7 from Sanyo Chemical Industries Ltd., solid content of 48.5 %) | 25 parts |
| Ethyl acetate | 60 parts |

Thus, an aqueous phase liquid, which is a milk white liquid, was prepared.

(b) Preparation of Emulsion

Initially, 150 parts of the above-prepared aqueous phase liquid was fed into a container, and the aqueous phase liquid was agitated by a TK HOMOMIXER mixer (PRIMIX Corp.), whose rotor was rotated at a revolution of 12,000 rpm. Next, 100 parts of the above-prepared toner component liquid was added thereto, and the mixture was agitated for 10 minutes to prepare an emulsion (emulsion slurry).

(c) Removal of Organic Solvent

One hundred (100) parts of the emulsion was fed into a flask equipped with a deaeration tube, an agitator and a thermometer, and the emulsion was agitated by the agitator, whose rotor was rotated at a peripheral speed of 20 m/min, for 12 hours at 30° C. to remove the organic solvent (i.e., ethyl acetate). Thus, a slurry A, from which the organic solvent had been removed, was prepared.

(d) Washing

The slurry A was subjected to filtering under a reduced pressure to obtain a cake, and 300 parts of ion-exchanged water was added to the cake. After the mixture was agitated for 10 minutes by a TK HOMOMIXER mixer, whose rotor was rotated at a revolution of 12,000 rpm, the mixture was filtered to obtain a cake. Next, 300 parts of ion exchange water was added to the cake, and the mixture was agitated for 10 minutes by a TK HOMOMIXER mixer, whose rotor was rotated at a revolution of 12,000 rpm, followed by filtering to prepare a cake. This washing operation was repeated three times to prepare a washed slurry.

(e) Heat Treatment

After the washed slurry was aged for 10 hours at 45° C., the slurry was filtered to prepare a cake, which had been subjected to a heat treatment.

(f) Drying

The cake subjected to the heat treatment was dried for 48 hours at 45° C. using a circulation dryer, followed by sieving using a screen with openings of 75 μm. Thus, toner particles A (mother toner A) were prepared.

(g) Addition of External Additive

The following components were mixed for 1 minute using a HENSCHEL MIXER mixer (Mitsui Mining Co., Ltd.), which was rotated at a peripheral speed of 13 m/s.

| | |
|---|---|
| Toner particles A prepared above | 100 parts |
| Silica A (UFP-35 from Denki Kagaku Kogyo K.K.) | 1.5 parts |

Further, the mixture was agitated for 10 minutes by the HENSCHEL MIXER mixer, which was rotated at a peripheral speed of 40 m/s.

Next, 0.5 parts of titanium oxide having a volume average particle diameter of 20 nm was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. Further, 2.0 parts of a silica B (H1303 from Clariant Japan K.K.) was added thereto, and the mixture was agitated for 1 minute by the HENSCHEL MIXER mixer rotated at a peripheral speed of 13 m/s, followed by agitation for 10 minutes using the HENSCHEL MIXER mixer rotated at a peripheral speed of 40 m/s. Furthermore, 0.2 parts of zinc stearate 1 prepared above was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. The mixture was filtered using a screen with openings of 500 μm to remove coarse particles.

Thus, a toner 1 to which the fatty acid metal salt (zinc stearate 1) and the particulate inorganic materials (silicas A and B and titanium oxide) were added was prepared.

The content (C1) of perfectly-free particles of the fatty acid metal salt in the toner and the content (C2) of particles of the fatty acid metal salt, which are weakly adhered to the toner, in the toner were measured as follows.

Specifically, 3.75 g of the toner was fed into a 5% by weight aqueous solution of a surfactant (NOIGEN ET-165 from DAI-ICHI KOGYO SEIYAKU CO., LTD.) in a container, and the mixture was agitated for 30 minutes by an agitator at a revolution such that the mixture did not foam, to prepare a toner dispersion A. Ultrasonic waves were applied for 1 minute to the toner dispersion A using an ultrasonic homogenizer (VCX750 from Sonics & Materials, Inc.) having a power of 40 W, wherein the height of the ultrasonic vibrator from the bottom of the container was 1.0 cm. Thus, a toner dispersion B was prepared.

The toner dispersion B was transferred to a centrifuge tube to be subjected to centrifugal separation for 2 minutes at 2,000 rpm. After the supernatant fluid was removed from the centrifuged toner dispersion B, 60 ml of pure water was added to the precipitate (i.e., toner) to prepare a dispersion slurry, followed by suction filtration using a filter paper having a diameter of 60 mm (No. 5C from Kiriyama Glass Co.). The toner on the filter paper was dispersed in 60 ml of pure water to prepare a dispersion slurry, and the dispersion slurry was subjected to suction filtration to wash the toner. The toner on the filter paper was collected and then dried for 8 hours at 40° C. in a thermostatic chamber. Next, 3 g of the toner was pelletized using an automatic pressing machine (BRE-32 from Maekawa Testing Machine Mfg. Co., Ltd.) under conditions of 6.0 tons in load and 60 seconds in pressing time, thereby forming a pellet of the toner having a diameter of 30 mm and a thickness of 2 mm. Thus, a pellet 1 of the toner from which free fatty acid metal salt was removed (i.e., toner subjected to the free fatty acid metal salt removing treatment) was prepared.

Next, the toner not subjected to the above-mentioned free fatty acid metal salt removing treatment was pelletized by the same pelletizing method as mentioned above to prepare a pellet 2 of the toner which was not subjected to the free fatty acid metal salt removing treatment.

Next, the toner pellets 1 and 2 were subjected to quantitative analysis using an X-ray fluorescence spectrometer to determine the content of the metal element (Zn) in each of the toner pellets 1 and 2. In this regard, the working curve was preliminarily prepared. The content (C1) of perfectly-free fatty acid metal salt in the toner was calculated from the following equation.

$$C1(\%)=(M1/M2)\times 100,$$

wherein M1 represents the content of the metal element in the toner pellet 1 (i.e., the pellet of the toner subjected to the free fatty acid metal salt removing treatment), and M2 represents the content of the metal element in the toner pellet 2 (i.e., the pellet of the toner not subjected to the free fatty acid metal salt removing treatment).

In addition, the toner was subjected to the above-described treatment except that application of ultrasonic waves was not performed, and the content (C1') of perfectly-free particles of the fatty acid metal salt in the toner was determined by the same method as mentioned above. The content (C2) of particles of the fatty acid metal salt, which are weakly adhered to the toner, in the toner was calculated from the following equation.

$$C2(\%)=C1'(\%)-C1(\%).$$

Example 2

The procedure for preparation of the toner 1 in Example 1 was repeated except that when the fatty acid metal salt was mixed with the toner, the mixture was agitated for 1 minute by the HENSCHEL MIXER mixer at a peripheral speed of 13 m/s, followed by agitation for 12 minutes using the HENSCHEL MIXER mixer rotated at a peripheral speed of 40 m/s.

Thus, a toner 2 was prepared.

Example 3

The procedure for preparation of the toner 1 in Example 1 was repeated except that when the fatty acid metal salt was mixed with the toner, the mixture was agitated for 1 minute by the HENSCHEL MIXER mixer at a peripheral speed of 13 m/s, followed by agitation for 12 minutes using the HENSCHEL MIXER mixer rotated at a peripheral speed of 33 m/s.

Thus, a toner 3 was prepared.

Example 4

The following components were mixed for 1 minute using a HENSCHEL MIXER mixer (Mitsui Mining Co., Ltd.), which was rotated at a peripheral speed of 13 m/s.

| | |
|---|---|
| Toner particles A prepared above | 100 parts |
| Silica A (UFP-35 from Denki Kagaku Kogyo K.K.) | 1.5 parts |
| Fatty acid metal salt (zinc stearate 1 prepared above) | 0.2 parts |

Further, the mixture was agitated for 10 minutes by the HENSCHEL MIXER mixer, which was rotated at a peripheral speed of 40 m/s.

Next, 0.5 parts of titanium oxide having a volume average particle diameter of 20 nm was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. Further, 2.0 parts of a silica B (H1303 from Clariant Japan K.K.) was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. The mixture was filtered using a screen with openings of 500 μm to remove coarse particles. Thus, a toner 4 to which the fatty acid metal salt (zinc stearate 1) and the particulate inorganic materials (silicas A and B and titanium oxide) were added was prepared.

Example 5

The following components were mixed for 1 minute using a HENSCHEL MIXER mixer (Mitsui Mining Co., Ltd.), which was rotated at a peripheral speed of 13 m/s.

| | |
|---|---|
| Toner particles A prepared above | 100 parts |
| Silica A (UFP-35 from Denki Kagaku Kogyo K.K.) | 1.5 parts |

Further, the mixture was agitated for 10 minutes by the HENSCHEL MIXER mixer, which was rotated at a peripheral speed of 40 m/s.

Next, 0.5 parts of titanium oxide having a volume average particle diameter of 20 nm was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. Further, 2.0 parts of a silica B (H1303 from Clariant Japan K.K.) and 0.2 parts of the zinc stearate 1 prepared above (fatty acid metal salt) were added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. The mixture was filtered using a screen with openings of 500 μm to remove coarse particles. Thus, a toner 5 to which the fatty acid metal salt (zinc stearate 1) and the particulate inorganic materials (silicas A and B and titanium oxide) were added was prepared.

Example 6

The procedure for preparation of the toner 1 in Example 1 was repeated except that the zinc stearate 1 was replaced with the zinc stearate 2 prepared above to prepare a toner 6.

Example 7

The procedure for preparation of the toner 1 in Example 1 was repeated except that the zinc stearate 1 was replaced with the zinc stearate 3 prepared above to prepare a toner 7.

Example 8

The procedure for preparation of the toner 1 in Example 1 was repeated except that the zinc stearate 1 was replaced with the zinc stearate 4 prepared above to prepare a toner 8.

Example 9

The procedure for preparation of the toner 1 in Example 1 was repeated except that the zinc stearate 1 was replaced with the zinc stearate 5 prepared above to prepare a toner 9.

Example 10

The procedure for preparation of the toner 1 in Example 1 was repeated except that the added amount of the zinc stearate 1 was changed to 0.50 parts to prepare a toner 10.

Example 11

The procedure for preparation of the toner 1 in Example 1 was repeated except that the added amount of the zinc stearate 1 was changed to 0.55 parts to prepare a toner 11.

Example 12

The procedure for preparation of the toner 1 in Example 1 was repeated except that the added amount of the zinc stearate 1 was changed to 0.05 parts to prepare a toner 12.

Example 13

The procedure for preparation of the toner 1 in Example 1 was repeated except that the added amount of the zinc stearate 1 was changed to 0.03 parts to prepare a toner 13.

Example 14

The procedure for preparation of the toner 1 in Example 1 was repeated except that the zinc stearate 1 was replaced with the magnesium stearate prepared above to prepare a toner 14.

Example 15

The procedure for preparation of the toner 1 in Example 1 was repeated except that the zinc stearate 1 was replaced with the zinc behenate prepared above to prepare a toner 15.

Example 16

In this example, the toner was prepared by a pulverization method. Specifically, the following components were mixed by a SUPERMIXER mixer (SMV-200 from KAWATA MFG Co., Ltd.) to prepare a powdery toner component mixture.

| | |
|---|---|
| Crystalline polyester resin 1 prepared above (binder resin) | 8 parts |
| Non-crystalline polyester resin 1 prepared above (binder resin) | 72 parts |
| Carbon black (colorant) (PRINTEX 35 from Degussa AG) | 6 parts |
| Carnauba wax (wax) | 6 parts |

The powdery toner component mixture was fed to a raw material supplying hopper of a kneader, KO-KNEADER TCS-100 from Buss AG, to be kneaded at a kneading speed of 120 kg/h.

After the kneaded mixture was cooled by a double-belt cooler, the mixture was crushed by a hammer mill, and then pulverized by a jet pulverizer (I-20 JET MILL from Nippon Pneumatic Mgf. Co., Ltd.) The pulverized mixture was classified by an air classifier (DS-20/DS-10 classifier from Nippon Pneumatic Mgf. Co., Ltd.). Thus, toner particles C (mother toner C) were prepared.

The following components were mixed for 1 minute using a HENSCHEL MIXER mixer (Mitsui Mining Co., Ltd.), which was rotated at a peripheral speed of 13 m/s.

| | |
|---|---|
| Toner particles C prepared above | 100 parts |
| Silica A (UFP-35 from Denki Kagaku Kogyo K.K.) | 1.5 parts |

Further, the mixture was agitated for 10 minutes by the HENSCHEL MIXER mixer, which was rotated at a peripheral speed of 40 m/s.

Next, 0.5 parts of titanium oxide having a volume average particle diameter of 20 nm was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. Further, 2.0 parts of a silica B (H1303 from Clariant Japan K.K.) was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. Furthermore, 0.2 parts of zinc stearate 1 prepared above was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. The mixture was filtered using a screen with openings of 500 μm to remove coarse particles. Thus, a toner 16 to which the fatty acid metal salt (zinc stearate 1) and the particulate inorganic materials (silicas A and B and titanium oxide) were added was prepared.

Example 17

(1) Preparation of Crystalline Polyester Resin Dispersion

Initially, 100 g of the crystalline polyester resin 1 prepared above and 400 g of ethyl acetate were fed to a 2-liter metal container, and the mixture was heated to 70° C. to dissolve the polyester resin in the solvent. The polyester resin solution was cooled in an ice water bath at a cooling speed of 20° C./min to prepare a polyester resin dispersion. Next, 100 g of the crystalline polyester resin 1 was dissolved in the dispersion, and the mixture was subjected to milling for 10 hours using a batch sand mill (from Kampe Hapio Co., Ltd.) including 500 ml of glass beads with a diameter of 3 mm while maintaining the temperature of the liquid at 24° C. in average. Thus, a crystalline polyester resin dispersion 1 having a volume average particle diameter of 0.3 μm was prepared.

(2) Preparation of Polyester Prepolymer

The following components were fed into a reaction vessel equipped with a condenser, an agitator, and a nitrogen feed pipe to be reacted for 8 hours at 230° C. under normal pressure.

| | |
|---|---|
| Ethylene oxide adduct (2 mole) of bisphenol A | 682 parts |
| Propylene oxide adduct (2 mole) of bisphenol A | 81 parts |
| Terephthalic acid | 283 parts |
| Trimellitic anhydride | 22 parts |
| Dibutyl tin oxide | 2 parts |

The reaction was further continued for 5 hours under a reduced pressure of from 10 mmHg to 15 mmHg (1,333 Pa to 2,000 Pa). Thus, an intermediate polyester 1 was prepared.

It was confirmed that the intermediate polyester 1 has a number average molecular weight of 2,100, a weight average molecular weight (Mw) of 9,500, a glass transition temperature (Tg) of 55° C., an acid value of 0.5 mgKOH/g, and a hydroxyl value of 51 mgKOH/g.

Next, the following components were fed into a reaction vessel equipped with a condenser, an agitator, and a nitrogen feed pipe to be reacted for 5 hours at 100° C.

| | |
|---|---|
| Intermediate polyester 1 prepared above | 410 parts |
| Isophorone diisocyanate | 89 parts |
| Ethyl acetate | 500 parts |

Thus, a polyester prepolymer 1 having an isocyanate group was prepared. The content of free isocyanate in the polyester prepolymer 1 was 1.53% by weight.

(3) Preparation of Oil Phase Liquid (Pigment/Wax Dispersion 1)

The following components were fed into a reaction vessel equipped with an agitator, and a thermometer.

| | |
|---|---|
| Non-crystalline polyester resin 1 prepared above | 378 parts |
| Ester wax 1 prepared above | 110 parts |
| Ethyl acetate | 947 parts |

The mixture was heated to 80° C. while agitated. After being agitated for 5 hours at 80° C., the mixture was cooled to 30° C. over one hour.

Next, 500 parts of the master batch prepared above and 500 parts of ethyl acetate were added thereto, and the mixture was agitated for one hour. Thus, a toner component solution 1 was prepared.

Further, 1,324 parts of the toner component solution 1 was subjected to bead milling using a bead mill (ULTRAVISCOMILL from Aimex Co., Ltd.) to disperse the carbon black and the ester wax. The milling conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Next, 1,042.3 parts of a 65% ethyl acetate solution of the non-crystalline polyester resin 1 was added thereto, and the mixture was subjected to bead milling using the bead mill mentioned above, wherein the dispersion conditions were the same as those mentioned above except that the dispersion operation was performed once (i.e., one pass).

Thus, a pigment/wax dispersion 1 was prepared. The solid content of the pigment/wax dispersion 1, which was determined by heating the dispersion for 30 minutes at 130° C., was 50% by weight.

(4) Preparation of Particulate Organic Material Emulsion

In a reaction vessel equipped with an agitator and a thermometer, 683 parts of water, 11 parts of a sodium salt of sulfate of an ethylene oxide adduct of methacrylic acid (ELEMINOL RS-30 from Sanyo Chemical Industries Ltd.), 138 parts of styrene, 138 parts of methacrylic acid, and 1 part of ammonium persulfate were mixed. The mixture was agitated for 15 minutes by the agitator, which was rotated at a revolution of 400 rpm. Thus, a white emulsion was prepared. The emulsion was then heated to 75° C. and the temperature was maintained for 5 hours to react the monomers.

Further, 30 parts of a 1% aqueous solution of ammonium persulfate was added thereto, and the mixture was aged for 5 hours at 75° C. Thus, an aqueous dispersion of a vinyl resin (i.e., a copolymer of styrene/methacrylic acid/butyl acrylate/sodium salt of sulfate of ethylene oxide adduct of methacrylic acid) was prepared. This dispersion is hereinafter referred to as a particulate resin dispersion 1.

The volume average particle diameter of the resin particles in the particulate resin dispersion 1, which was measured by an instrument LA-920 (from Horiba Ltd.), was 0.14 μm.

Part of the particulate resin dispersion 1 was heated to solidify the resin.

(5) Preparation of Aqueous Phase Liquid

The following components were mixed in a vessel using a mixer.

| | |
|---|---|
| Water | 990 parts |
| Particulate resin dispersion 1 prepared above | 83 parts |
| Sodium salt of dodecyl diphenyl ether disulfonic acid (ELEMINOL MON-7 from Sanyo Chemical Industries Ltd., solid content of 48.5 %) | 37 parts |
| Ethyl acetate | 90 parts |

Thus, an aqueous phase liquid 1, which is a milk white liquid, was prepared.

(6) Preparation of Ketimine Compound

In a reaction vessel equipped with an agitator and a thermometer, 170 parts of isophorone diamine and 75 parts of methyl ethyl ketone were mixed and reacted for 5 hours at 50° C. to prepare a ketimine compound 1. It was confirmed that the ketimine compound 1 has an amine value of 418 mgKOH/g.

(7) Emulsification

The below-mentioned components were mixed for 1 minute in a vessel using a TK HOMOMIXER mixer (PRIMIX Corp.), whose rotor was rotated at a revolution of 5,000 rpm.

| | |
|---|---|
| Pigment/wax dispersion 1 prepared above | 664 parts |
| Polyester prepolymer 1 prepared above | 109.4 parts |
| Crystalline polyester resin dispersion 1 prepared above | 73.9 parts |
| Ketimine compound 1 prepared above | 4.6 parts |

Next, 1,200 parts of the aqueous phase liquid 1 prepared above was added to the mixture, and the mixture was agitated for 5 minutes by the TK HOMOMIXER mixer, whose rotor was rotated at a revolution of 11,000 rpm. Thus, an emulsion slurry 1 was prepared.

The emulsion slurry 1 was fed into a vessel equipped with an agitator and a thermometer, and heated for 8 hours at 30° C. to remove the organic solvent (i.e., ethyl acetate) therefrom, followed by aging for 4 hours at 45° C. Thus, a dispersion slurry 1 was prepared.

(8) Washing and Drying

1) One hundred (100) parts of the dispersion slurry 1 was filtered under a reduced pressure to obtain a cake.

2) One hundred (100) parts of ion exchange water was added to the cake, and the mixture was agitated for 10 minutes with a TK HOMOMIXER mixer rotated at a revolution of 12,000 rpm, followed by filtering to obtain a cake (a).

3) One hundred (100) parts of a 10% aqueous solution of sodium hydroxide was added to the cake (a), and the mixture was agitated for 30 minutes with the TK HOMOMIXER mixer rotated at a revolution of 12,000 rpm, followed by filtering under a reduced pressure to obtain a cake (b).

4) One hundred (100) parts of a 10% aqueous solution of hydrochloric acid was added to the cake (b), and the mixture was agitated for 10 minutes by the TK HOMOMIXER mixer rotated at a revolution of 12,000 rpm, followed by filtering to obtain a cake (c).

5) Three hundred (300) parts of ion exchange water was added to the cake (c), and the mixture was agitated for 10 minutes by the TK HOMOMIXER mixer rotated at a speed of 12,000 rpm, followed by filtering to obtain a cake 1.

The filtered cake 1 was dried for 48 hours at 45° C. using a hot air dryer. Thus, toner particles B (mother toner B) were prepared.

(9) Addition of External Additive

The following components were mixed for 1 minute using a HENSCHEL MIXER mixer (Mitsui Mining Co., Ltd.), which was rotated at a peripheral speed of 13 m/s.

| | |
|---|---|
| Toner particles B prepared above | 100 parts |
| Silica A (UFP-35 from Denki Kagaku Kogyo K.K.) | 1.5 parts |

Further, the mixture was agitated for 10 minutes by the HENSCHEL MIXER mixer, which was rotated at a peripheral speed of 40 m/s.

Next, 0.5 parts of titanium oxide having a volume average particle diameter of 20 nm was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. Further, 2.0 parts of a silica B (H1303 from Clariant Japan K.K.) was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. Furthermore, 0.2 parts of zinc stearate 1 prepared above was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. The mixture was filtered using a screen with openings of 500 μm to remove coarse particles. Thus, a toner 17 to which the fatty acid metal salt (zinc stearate 1) and the particulate inorganic materials (silicas A and B and titanium oxide) were added was prepared.

Example 18

The procedure for preparation of the toner 17 in Example 17 was repeated except that the average temperature of the crystalline polyester dispersion in the milling process using the sand mill was changed from 24° C. to 28° C. Thus, a toner 18 was prepared.

Example 19

The procedure for preparation of the toner 17 in Example 17 was repeated except that the average temperature of the crystalline polyester dispersion in the milling process using the sand mill was changed from 24° C. to 18° C. Thus, a toner 19 was prepared.

Example 20

The procedure for preparation of the toner 17 in Example 17 was repeated except that the ester wax 1 used for preparing the oil phase liquid was replaced with the ester wax 2. Thus, a toner 20 was prepared.

Example 21

The procedure for preparation of the toner 17 in Example 17 was repeated except that the ester wax 1 used for preparing the oil phase liquid was replaced with the ester wax 3. Thus, a toner 21 was prepared.

Comparative Example 1

The procedure for preparation of the toner 1 in Example 1 was repeated except that the mixing time in the external additive mixing process of the zinc stearate 1 using the HENSCHEL MIXER mixer rotated at a peripheral speed of 40 m/s was changed from 10 minutes to 5 minutes. Thus, a toner 22 was prepared.

Comparative Example 2

The procedure for preparation of the toner 1 in Example 1 was repeated except that the mixing time in the external additive mixing process of the zinc stearate 1 using the HENSCHEL MIXER mixer rotated at a peripheral speed of 40 m/s was changed from 10 minutes to 0 minute (i.e., the mixing process at a peripheral speed of 40 m/s was not performed). Thus, a toner 23 was prepared.

Comparative Example 3

The procedure for preparation of the toner 1 in Example 1 was repeated except that the external additive mixing process of the zinc stearate 1 using the HENSCHEL MIXER mixer was performed for 12 minutes at a peripheral speed of 33 m/s. Thus, a toner 24 was prepared.

Comparative Example 4

The following components were mixed for 1 minute using a HENSCHEL MIXER mixer (Mitsui Mining Co., Ltd.), which was rotated at a peripheral speed of 13 m/s.

| | |
|---|---|
| Toner particles A prepared above | 100 parts |
| Silica A (UFP-35 from Denki Kagaku Kogyo K.K.) | 1.5 parts |
| Zinc stearate 1 prepared above | 0.2 parts |

Further, the mixture was agitated for 5 minutes by the HENSCHEL MIXER mixer, which was rotated at a peripheral speed of 33 m/s.

Next, 0.5 parts of titanium oxide having a volume average particle diameter of 20 nm was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. Further, 2.0 parts of a silica B (H1303 from Clariant Japan K.K.) was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 40 m/s. Thus, a toner 25 to which the fatty acid metal salt (zinc stearate 1) and the particulate inorganic materials (silicas A and B and titanium oxide) were added was prepared.

Comparative Example 5

The following components were mixed for 1 minute using a HENSCHEL MIXER mixer (Mitsui Mining Co., Ltd.), which was rotated at a peripheral speed of 13 m/s.

| | |
|---|---|
| Toner particles A prepared above | 100 parts |
| Silica A (UFP-35 from Denki Kagaku Kogyo K.K.) | 1.5 parts |
| Zinc stearate 1 prepared above | 0.2 parts |

Further, the mixture was agitated for 5 minutes by the HENSCHEL MIXER mixer, which was rotated at a peripheral speed of 33 m/s.

Next, 0.5 parts of titanium oxide having a volume average particle diameter of 20 nm was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 33 m/s. Further, 2.0 parts of a silica B (H1303 from Clariant Japan K.K.) was added thereto, and the mixture was agitated for 1 minute by the HENSCHEL MIXER mixer at a peripheral speed of 13 m/s, followed by agitation for 10 minutes using the HENSCHEL MIXER mixer rotated at a peripheral speed of 33 m/s. Thus, a toner 26 to which the fatty acid metal salt (zinc stearate 1) and the particulate inorganic materials (silicas A and B and titanium oxide) were added was prepared.

Comparative Example 6

The procedure for preparation of the toner 7 in Example 7 was repeated except that the external additive mixing process of the zinc stearate 3 using the HENSCHEL MIXER mixer was performed for 12 minutes at a peripheral speed of 30 m/s. Thus, a toner 27 was prepared.

Comparative Example 7

The procedure for preparation of the toner 9 in Example 9 was repeated except that the external additive mixing process of the zinc stearate 5 using the HENSCHEL MIXER mixer was performed for 12 minutes at a peripheral speed of 30 m/s. Thus, a toner 28 was prepared.

Comparative Example 8

The procedure for preparation of the toner 11 in Example 11 was repeated except that the external additive mixing process of the zinc stearate 1 using the HENSCHEL MIXER mixer was performed for 12 minutes at a peripheral speed of 30 m/s. Thus, a toner 29 was prepared.

Comparative Example 9

The procedure for preparation of the toner 13 in Example 13 was repeated except that the external additive mixing process of the zinc stearate 1 using the HENSCHEL MIXER mixer was performed for 12 minutes at a peripheral speed of 30 m/s. Thus, a toner 30 was prepared.

Comparative Example 10

The procedure for preparation of the toner 1 in Example 1 was repeated except that the crystalline polyester resin 1 was replaced with the crystalline polyester resin 2, the ester wax 1 was replaced with the ester wax 4, and the average temperature of the crystalline polyester dispersion in the milling process using the sand mill was changed from 24° C. to 28° C. Thus, a toner 31 was prepared.

Comparative Example 11

The procedure for preparation of the toner 1 in Example 1 was repeated except that the crystalline polyester resin 1 was replaced with the crystalline polyester resin 3, and the ester wax 1 was replaced with the ester wax 2. Thus, a toner 32 was prepared.

Comparative Example 12

The procedure for preparation of the toner 1 in Example 1 was repeated except that the ester wax 1 was replaced with the ester wax 5. Thus, a toner 33 was prepared.

Comparative Example 13

The procedure for preparation of the toner 1 in Example 1 was repeated except that the ester wax 1 was replaced with the ester wax 6. Thus, a toner 34 was prepared.

The above-prepared toners of Examples 1-21 and Comparative Examples 1-13 were evaluated with respect to the following properties.

(1) The above-mentioned content (C1) of perfectly-free particles of the fatty acid metal salt in the toner, and the above-mentioned content (C2) of particles of the fatty acid metal salt, which are weakly adhered to the toner.

(2) Volume average particle diameter (Dv) of the toner, which was measured by COULTER MULTISIZER II from Beckman Coulter Inc.

(3) Flow starting temperature (Tfb) of the toner, which was measured by a flow tester.

(4) Melting point (Tm1) of the wax, which was measured by a differential scanning calorimeter (DSC).

(5) Melting point (Tm2) of the crystalline polyester resin, which was measured by a differential scanning calorimeter (DSC).

The evaluation results are shown in Table 4 below.

TABLE 4

| | Toner No. | C1(%) | C2(%) | Dv (μm) | Tfb (° C.) | Tm1 (° C.) | Tm2 (° C.) |
|---|---|---|---|---|---|---|---|
| Ex. 1 | 1 | 5.3 | 29.8 | 5.6 | 93.1 | 79.1 | — |
| Ex. 2 | 2 | 24.8 | 48.3 | 5.6 | 93.3 | 78.5 | — |
| Ex. 3 | 3 | 24.6 | 21 | 5.6 | 92.8 | 78.2 | — |
| Ex. 4 | 4 | 1 | 22.3 | 5.6 | 93.5 | 78.9 | — |
| Ex. 5 | 5 | 1.5 | 46.8 | 5.6 | 92.1 | 77.9 | — |
| Ex. 6 | 6 | 10.3 | 22.6 | 5.6 | 91.9 | 77.6 | — |
| Ex. 7 | 7 | 8.5 | 21 | 5.6 | 93.4 | 78.6 | — |
| Ex. 8 | 8 | 22.1 | 43.3 | 5.6 | 93.2 | 77.1 | — |
| Ex. 9 | 9 | 24.7 | 45 | 5.6 | 91.1 | 77.9 | — |
| Ex. 10 | 10 | 22.3 | 40.5 | 5.6 | 93.3 | 78.9 | — |
| Ex. 11 | 11 | 24.5 | 30.4 | 5.6 | 93.1 | 79.1 | — |
| Ex. 12 | 12 | 5.6 | 26.2 | 5.6 | 91.8 | 78.6 | — |
| Ex. 13 | 13 | 3.1 | 24.3 | 5.6 | 92.7 | 77.9 | — |
| Ex. 14 | 14 | 12.3 | 27.6 | 5.6 | 93.6 | 79 | — |
| Ex. 15 | 15 | 13.9 | 36.9 | 5.6 | 93.4 | 78 | — |
| Ex. 16 | 16 | 16.3 | 28.9 | 5.7 | 93.1 | 78.3 | — |
| Ex. 17 | 17 | 19.6 | 26.9 | 5.4 | 80.2 | 67.9 | 64.3 |
| Ex. 18 | 18 | 10.5 | 23.5 | 5.5 | 89.1 | 69.1 | 64.2 |
| Ex. 19 | 19 | 8.5 | 27.3 | 5.6 | 72.6 | 68.1 | 60.5 |
| Ex. 20 | 20 | 12.7 | 26.5 | 5.5 | 85 | 82.9 | 63.1 |
| Ex. 21 | 21 | 15.3 | 30.1 | 5.5 | 84.1 | 64.3 | 64.2 |
| Comp. Ex. 1 | 22 | 29.6 | 13.2 | 5.6 | 90.9 | 78.7 | — |
| Comp. Ex. 2 | 23 | 33.6 | 51.1 | 5.6 | 92.1 | 77.6 | — |
| Comp. Ex. 3 | 24 | 28.9 | 26.9 | 5.6 | 92.2 | 78.6 | — |
| Comp. Ex. 4 | 25 | 12.1 | 11.2 | 5.6 | 92.6 | 78.3 | — |
| Comp. Ex. 5 | 26 | 14.6 | 55.6 | 5.6 | 93.1 | 79.1 | — |
| Comp. Ex. 6 | 27 | 28.9 | 33.2 | 5.6 | 92.4 | 78.9 | — |

TABLE 4-continued

| | Toner No. | C1(%) | C2(%) | Dv (μm) | Tfb (° C.) | Tm1 (° C.) | Tm2 (° C.) |
|---|---|---|---|---|---|---|---|
| Comp. Ex. 7 | 28 | 29.6 | 31.3 | 5.6 | 91.5 | 77.9 | — |
| Comp. Ex. 8 | 29 | 26.7 | 51.1 | 5.6 | 93.2 | 77.5 | — |
| Comp. Ex. 9 | 30 | 1.2 | 19.3 | 5.6 | 92.9 | 78.6 | — |
| Comp. Ex. 10 | 31 | 28.4 | 38.4 | 5.4 | 62.1 | 60.2 | 53.3 |
| Comp. Ex. 11 | 32 | 27.6 | 36.2 | 5.6 | 99.8 | 80.6 | 74.6 |
| Comp. Ex. 12 | 33 | 30.1 | 29.8 | 5.5 | 79.6 | 56.3 | 65.3 |
| Comp. Ex. 13 | 34 | 29 | 31.1 | 5.4 | 88.6 | 86.6 | 66.2 |

Next, the second embodiment will be described by reference to Examples 22-50 and Comparative Examples 14-43. In the descriptions in the following examples, the numbers represent weight ratios in parts, unless otherwise specified.

Example 22

1. Formation of Undercoat Layer

The following components were mixed to prepare an undercoat layer coating liquid.

| | |
|---|---|
| Alkyd resin (BECKOSOL 1307-60-EL from DIC Corp.) | 12 parts |
| Melamine resin (SUPER BECKAMIN G-821-60 from DIC Corp.) | 8 parts |
| Titanium oxide (CR-EL from ISHIHARA SANGYO KAISHA LTD.) | 80 parts |
| Methyl ethyl ketone | 250 parts |

The undercoat layer coating liquid was applied on a peripheral surface of an aluminum drum having an outside diameter of 40 mm, and the coated liquid was dried. Thus, an undercoat layer having a thickness of about 3.5 μm was prepared.

2. Formation of Charge Generation Layer

The following components were mixed to prepare a charge generation layer coating liquid.

| | |
|---|---|
| Bisazo pigment having the following formula (1) | 2.5 parts |

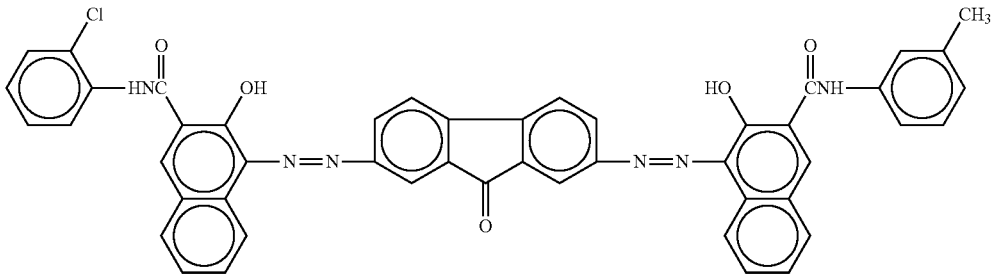

(1)

| | |
|---|---|
| Polyvinyl butyral resin (XYHL, manufactured by Union Carbide Corp.) | 0.5 parts |
| Cyclohexanone | 200 parts |
| Methyl ethyl ketone | 80 parts |

The charge generation layer coating liquid was applied on the undercoat layer, and the coated liquid was dried to prepare a charge generation layer having a thickness of 0.2 μm.

3. Formation of Charge Transport Layer

The following components were mixed to prepare a charge transport layer coating liquid.

| | |
|---|---|
| Bisphenol Z-form polycarbonate (PANLITE TS-2050 manufactured by Teijin Chemicals Ltd.) | 10 parts |
| Charge transport material having the following formula (2) | 7 parts |

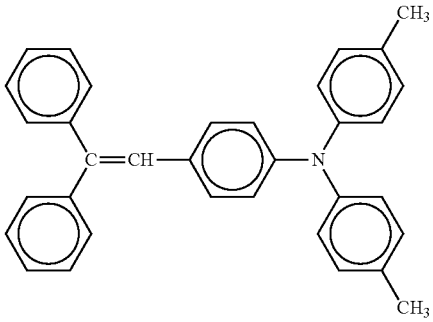

(2)

| | |
|---|---|
| Tetrahydrofuran | 100 parts |
| 1% tetrahydrofuran solution of silicone oil (Silicone oil: KF50-100CS from Shin-Etsu Chemical Co., Ltd.) | 1 part |

The charge transport layer coating liquid was applied on the charge generation layer, and the coated liquid was dried to prepare a charge transport layer having a thickness of about 20 μm.

4. Formation of Outermost Layer

Initially, 110 g of zirconia beads with an average particle size of 0.1 mm were fed into a 50 ml container, and 33.3 parts of an Al-doped zinc oxide (PAZET CK with an average particle size of 35 nm from Hakusuitech Co., Ltd.), 1.7 parts of a surfactant (low molecular weight unsaturated polycarboxylic acid polymer (BYK-P105 from BYK Chemie GmbH), and 178 parts of cyclohexanone were fed into the container. The mixture was subjected to a vibration dispersing treatment for 2 hours under a condition of 1,500 rpm to prepare an Al-doped zinc oxide dispersion. The dispersion was fed into a 50 ml container containing 60 g of zirconia beads with an average particle size of 5 mm to subject the dispersion to bead milling for 24 hours at a revolution of 200 rpm to prepare a mill base. The mill base was added to a tetrahydrofuran solution of bisphenol Z-form polycarbonate resin, which had been prepared by dissolving 100 parts of a bisphenol Z type polycarbonate resin (PANLITE TS-2050 from Teijin Chemicals Ltd.) in 711 parts of tetrahydrofuran, to prepare an outermost layer coating liquid.

The outermost layer coating liquid was applied on the charge transport layer by a spray coating method, and the coated liquid was dried for 30 minutes at 150° C. to prepare an outermost layer with a thickness of 4.5 μm. Thus, a photoreceptor of Example 22 was prepared.

Example 23

The procedure for preparation of the photoreceptor in Example 22 was repeated except that the formulation of the outermost layer coating liquid was changed to the following.

| | |
|---|---|
| Bisphenol Z-form polycarbonate resin (PANLITE TS-2050 from Teijin Chemicals Ltd.) | 100 parts |
| Al-doped zinc oxide (PAZET CK with an average particle size of 35 nm from Hakusuitech Co., Ltd.) | 53.8 parts |
| Surfactant (BYK-P105 from BYK Chemie GmbH) | 2.7 parts |
| Tetrahydrofuran | 821 parts |
| Cyclohexanone | 205 parts |

Thus, a photoreceptor of Example 23 was prepared.

Example 24

The procedure for preparation of the photoreceptor in Example 22 was repeated except that the formulation of the outermost layer coating liquid was changed to the following.

| | |
|---|---|
| Bisphenol Z-form polycarbonate resin (PANLITE TS-2050 from Teijin Chemicals Ltd.) | 100 parts |
| Al-doped zinc oxide (PAZET CK with an average particle size of 35 nm from Hakusuitech Co., Ltd.) | 100 parts |
| Surfactant (BYK-P105 from BYK Chemie GmbH) | 5.0 parts |
| Tetrahydrofuran | 1,067 parts |
| Cyclohexanone | 267 parts |

Thus, a photoreceptor of Example 24 was prepared.

Example 25

The procedure for preparation of the photoreceptor in Example 22 was repeated except that the formulation of the outermost layer coating liquid was changed to the following.

| | |
|---|---|
| Bisphenol Z-form polycarbonate resin (PANLITE TS-2050 from Teijin Chemicals Ltd.) | 100 parts |
| Al-doped zinc oxide (PAZET CK with an average particle size of 35 nm from Hakusuitech Co., Ltd.) | 150 parts |
| Surfactant (BYK-P105 from BYK Chemie GmbH) | 7.5 parts |

-continued

| | |
|---|---|
| Tetrahydrofuran | 1,333 parts |
| Cyclohexanone | 333 parts |

Thus, a photoreceptor of Example 25 was prepared.

Example 26

The procedure for preparation of the photoreceptor in Example 22 was repeated except that the Al-doped zinc oxide was replaced with a Ga-doped zinc oxide (PAZET GK-40 with an average particle size of 32 nm from Hakusuitech Co., Ltd.).

Thus, a photoreceptor of Example 26 was prepared.

Example 27

The procedure for preparation of the photoreceptor in Example 23 was repeated except that the Al-doped zinc oxide was replaced with a Ga-doped zinc oxide (PAZET GK-40 with an average particle size of 32 nm from Hakusuitech Co., Ltd.).

Thus, a photoreceptor of Example 27 was prepared.

Example 28

The procedure for preparation of the photoreceptor in Example 24 was repeated except that the Al-doped zinc oxide was replaced with a Ga-doped zinc oxide (PAZET GK-40 with an average particle size of 32 nm from Hakusuitech Co., Ltd.).

Thus, a photoreceptor of Example 28 was prepared.

Example 29

The procedure for preparation of the photoreceptor in Example 25 was repeated except that the Al-doped zinc oxide was replaced with a Ga-doped zinc oxide (PAZET GK-40 with an average particle size of 32 nm from Hakusuitech Co., Ltd.).

Thus, a photoreceptor of Example 29 was prepared.

Example 30

The procedure for preparation of the photoreceptor in Example 22 was repeated except that the formulation of the outermost layer coating liquid was changed to the following.

| | |
|---|---|
| Bisphenol Z-form polycarbonate resin (PANLITE TS-2050 from Teijin Chemicals Ltd.) | 100 parts |
| Charge transport material having the above-mentioned formula (2) | 10 parts |
| Ga-doped zinc oxide (PAZET GK-40 with an average particle size of 32 nm from Hakusuitech Co., Ltd.) | 110 parts |
| Surfactant (BYK-P105 from BYK Chemie GmbH) | 5.5 parts |
| Tetrahydrofuran | 1,173 parts |
| Cyclohexanone | 293 parts |

Thus, a photoreceptor of Example 30 was prepared.

Example 31

The procedure for preparation of the photoreceptor in Example 22 was repeated except that the formulation of the outermost layer coating liquid was changed to the following.

| | |
|---|---|
| Bisphenol Z-form polycarbonate resin (PANLITE TS-2050 from Teijin Chemicals Ltd.) | 100 parts |
| Charge transport material having the above-mentioned formula (2) | 20 parts |
| Ga-doped zinc oxide (PAZET GK-40 with an average particle size of 32 nm from Hakusuitech Co., Ltd.) | 120 parts |
| Surfactant (BYK-P105 from BYK Chemie GmbH) | 6.0 parts |
| Tetrahydrofuran | 1,280 parts |
| Cyclohexanone | 320 parts |

Thus, a photoreceptor of Example 31 was prepared.

Example 32

The procedure for preparation of the photoreceptor in Example 22 was repeated except that the resin having no charge transportability (i.e., the bisphenol Z-form polycarbonate resin) in the outermost layer coating liquid was replaced with a mixture of 100 parts of trimethylolpropane triacrylate (TMPTA, from Tokyo Kasei Kogyo Co., Ltd.) and 5 parts of a photopolymerization initiator (1-hydroxycyclohexyl phenyl ketone, IRGACURE 1-184 from BASF Japan (Ciba Specialty Chemicals Corp.)), and the coated outermost layer coating liquid was subjected to the following ultraviolet irradiation process and drying process to prepare a crosslinked outermost layer.

(Ultraviolet Irradiation Process and Drying Process)

The above-prepared outermost layer coating liquid was applied on the charge transport layer, which had been formed on the cylindrical electroconductive support with the charge generation layer and the undercoat layer therebetween. Next, the cylindrical electroconductive support was rotated, and the coated outermost layer was exposed to ultraviolet rays, which were emitted by a metal halide lamp with an illuminance of 900 mW/cm$^2$, for 120 seconds to form a crosslinked outermost layer. The crosslinked outermost layer was then heated for 30 minutes at 130° C. to be dried.

Thus, a photoreceptor of Example 32 was prepared.

Example 33

The procedure for preparation of the photoreceptor in Example 23 was repeated except that the resin having no charge transportability (i.e., the bisphenol Z-form polycarbonate resin) in the outermost layer coating liquid was replaced with a mixture of 100 parts of trimethylolpropane triacrylate (TMPTA) and 5 parts of a photopolymerization initiator (1-hydroxycyclohexyl phenyl ketone, IRGACURE I-184 from BASF Japan (Ciba Specialty Chemicals Corp.)), and the coated outermost layer coating liquid was subjected to the ultraviolet irradiation process and drying process mentioned above in Example 32 to prepare a crosslinked outermost layer.

Thus, a photoreceptor of Example 33 was prepared.

Example 34

The procedure for preparation of the photoreceptor in Example 24 was repeated except that the resin having no charge transportability (i.e., the bisphenol Z-form polycarbonate resin) in the outermost layer coating liquid was replaced with a mixture of 100 parts of trimethylolpropane triacrylate (TMPTA) and 5 parts of a photopolymerization initiator (1-hydroxycyclohexyl phenyl ketone, IRGACURE I-184 from BASF Japan (Ciba Specialty Chemicals Corp.)), and the coated outermost layer coating liquid was subjected to the ultraviolet irradiation process and drying process mentioned above in Example 32 to prepare a crosslinked outermost layer.

Thus, a photoreceptor of Example 34 was prepared.

Example 35

The procedure for preparation of the photoreceptor in Example 25 was repeated except that the resin having no charge transportability (i.e., the bisphenol Z-form polycarbonate resin) in the outermost layer coating liquid was replaced with a mixture of 100 parts of trimethylolpropane triacrylate (TMPTA) and 5 parts of a photopolymerization initiator (1-hydroxycyclohexyl phenyl ketone, IRGACURE I-184 from BASF Japan (Ciba Specialty Chemicals Corp.)), and the coated outermost layer coating liquid was subjected to the ultraviolet irradiation process and drying process mentioned above in Example 32 to prepare a crosslinked outermost layer.

Thus, a photoreceptor of Example 35 was prepared.

Example 36

The procedure for preparation of the photoreceptor in Example 26 was repeated except that the resin having no charge transportability (i.e., the bisphenol Z-form polycarbonate resin) in the outermost layer coating liquid was replaced with a mixture of 100 parts of trimethylolpropane triacrylate (TMPTA) and 5 parts of a photopolymerization initiator (1-hydroxycyclohexyl phenyl ketone, IRGACURE I-184 from BASF Japan (Ciba Specialty Chemicals Corp.)), and the coated outermost layer coating liquid was subjected to the ultraviolet irradiation process and drying process mentioned above in Example 32 to prepare a crosslinked outermost layer.

Thus, a photoreceptor of Example 36 was prepared.

Example 37

The procedure for preparation of the photoreceptor in Example 27 was repeated except that the resin having no charge transportability (i.e., the bisphenol Z-form polycarbonate resin) in the outermost layer coating liquid was replaced with a mixture of 100 parts of trimethylolpropane triacrylate (TMPTA) and 5 parts of a photopolymerization initiator (1-hydroxycyclohexyl phenyl ketone, IRGACURE I-184 from BASF Japan (Ciba Specialty Chemicals Corp.)), and the coated outermost layer coating liquid was subjected to the ultraviolet irradiation process and drying process mentioned above in Example 32 to prepare a crosslinked outermost layer.

Thus, a photoreceptor of Example 37 was prepared.

Example 38

The procedure for preparation of the photoreceptor in Example 28 was repeated except that the resin having no charge transportability (i.e., the bisphenol Z-form polycarbonate resin) in the outermost layer coating liquid was replaced with a mixture of 100 parts of trimethylolpropane triacrylate (TMPTA) and 5 parts of a photopolymerization initiator (1-hydroxycyclohexyl phenyl ketone, IRGACURE I-184 from BASF Japan (Ciba Specialty Chemicals Corp.)), and the coated outermost layer coating liquid was subjected to the ultraviolet irradiation process and drying process mentioned above in Example 32 to prepare a crosslinked outermost layer.

Thus, a photoreceptor of Example 38 was prepared.

Example 39

The procedure for preparation of the photoreceptor in Example 29 was repeated except that the resin having no charge transportability (i.e., the bisphenol Z-form polycarbonate resin) in the outermost layer coating liquid was replaced with a mixture of 100 parts of trimethylolpropane triacrylate (TMPTA) and 5 parts of a photopolymerization initiator (1-hydroxycyclohexyl phenyl ketone, IRGACURE I-184 from BASF Japan (Ciba Specialty Chemicals Corp.)), and the coated outermost layer coating liquid was subjected to the ultraviolet irradiation process and drying process mentioned above in Example 32 to prepare a crosslinked outermost layer.

Thus, a photoreceptor of Example 39 was prepared.

Example 40

The procedure for preparation of the photoreceptor in Example 30 was repeated except that the charge transport material was replaced with a charge transport material having the below-mentioned formula (3), and the resin having no charge transportability (i.e., the bisphenol Z-form polycarbonate resin) in the outermost layer coating liquid was replaced with a mixture of 100 parts of trimethylolpropane triacrylate (TMPTA) and 5 parts of a photopolymerization initiator (1-hydroxycyclohexyl phenyl ketone, IRGACURE I-184 from BASF Japan (Ciba Specialty Chemicals Corp.)), and the coated outermost layer coating liquid was subjected to the ultraviolet irradiation process and drying process mentioned above in Example 32 to prepare a crosslinked outermost layer.

(3)

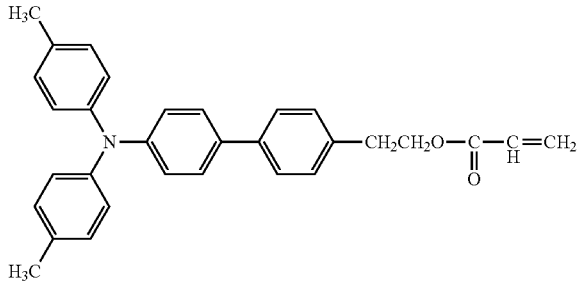

Thus, a photoreceptor of Example 40 was prepared.

Example 41

The procedure for preparation of the photoreceptor in Example 31 was repeated except that the charge transport material was replaced with the charge transport material having the above-mentioned formula (3), and the resin having no charge transportability (i.e., the bisphenol Z-form polycarbonate resin) in the outermost layer coating liquid was replaced with a mixture of 100 parts of trimethylolpropane triacrylate (TMPTA) and 5 parts of a photopolymerization initiator (1-hydroxycyclohexyl phenyl ketone, IRGACURE I-184 from BASF Japan (Ciba Specialty Chemicals Corp.)), and the coated outermost layer coating liquid was subjected to the ultraviolet irradiation process and drying process mentioned above in Example 32 to prepare a crosslinked outermost layer.

Thus, a photoreceptor of Example 41 was prepared.

Example 42

The procedure for preparation of the photoreceptor in Example 33 was repeated except that the Al-doped zinc oxide (PAZET CK) was replaced with an Al-doped zinc oxide (PAZET 23-K with an average particle size of 152 nm from Hakusuitech Co., Ltd.).

Thus, a photoreceptor of Example 42 was prepared.

Example 43

The procedure for preparation of the photoreceptor in Example 34 was repeated except that the Al-doped zinc oxide (PAZET CK) was replaced with an Al-doped zinc oxide (PAZET 23-K with an average particle size of 152 nm from Hakusuitech Co., Ltd.).

Thus, a photoreceptor of Example 43 was prepared.

Example 44

The procedure for preparation of the photoreceptor in Example 38 was repeated except that 100 parts of trimethylolpropane triacrylate (TMPTA) was replaced with a combination of 40 parts of trimethylolpropane triacrylate (TMPTA) and 60 parts of a compound (bisphenol A-form acrylate monomer from Sartomer) having the following formula.

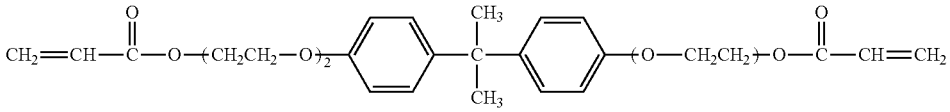

Thus, a photoreceptor of Example 44 was prepared.

Example 45

The procedure for preparation of the photoreceptor in Example 38 was repeated except that 100 parts of trimethylolpropane triacrylate (TMPTA) was replaced with a combination of 80 parts of trimethylolpropane triacrylate (TMPTA) and 20 parts of a compound (caprolactone-modified dipentaerythritol hexaacrylate, from Nippon Kayaku Co., Ltd.) having the following formula.

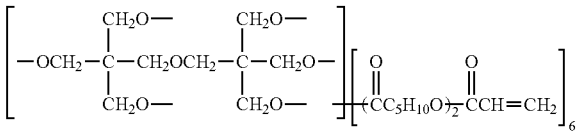

Thus, a photoreceptor of Example 45 was prepared.

Example 46

The procedure for preparation of the photoreceptor in Example 24 was repeated except that the resin having no charge transportability (i.e., the bisphenol Z-form polycarbonate resin) in the outermost layer coating liquid was replaced with a polyarylate resin (U-100 from Unitika Ltd.).

Thus, a photoreceptor of Example 46 was prepared.

Example 47

The procedure for preparation of the photoreceptor in Example 24 was repeated except that the resin having no charge transportability (i.e., the bisphenol Z-form polycarbonate resin) in the outermost layer coating liquid was replaced with a styrene resin (SEPTON 2043 from Kuraray Co. Ltd.).

Thus, a photoreceptor of Example 47 was prepared.

Example 48

The procedure for preparation of the photoreceptor in Example 24 was repeated except that the resin having no charge transportability (i.e., the bisphenol Z-form polycarbonate resin) in the outermost layer coating liquid was replaced with a phenolic resin (PR9480 from Sumitomo Bakelite Company, Limited).

Thus, a photoreceptor of Example 48 was prepared.

Example 49

The procedure for preparation of the photoreceptor in Example 24 was repeated except that the resin having no charge transportability (i.e., the bisphenol Z-form polycarbonate resin) in the outermost layer coating liquid was replaced with a resin prepared by reacting a polyol compound having the below-mentioned formula (4) with an isocyanate compound (TAKENATE D140N from Mitsui Chemicals, Inc.), wherein the OH/NCO equivalent ratio of 1.0.

(4)

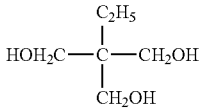

Thus, a photoreceptor of Example 49 was prepared.

Example 50

The procedure for preparation of the photoreceptor in Example 24 was repeated except that the resin having no charge transportability (i.e., the bisphenol Z-form polycarbonate resin) in the outermost layer coating liquid was replaced with a compound prepared by the following method.

Specifically, the compound was prepared by the method including agitating a mixture of 10 parts of methyltrimethoxy silane, 5 parts of 1% aqueous solution of acetic acid, and 15 parts of n-butanol for 2 hours at 60° C.; adding 0.016 parts of dibutyltin diacetate ($nBu_2.Sn(OAc)_2$) to the mixture; and agitating the mixture for 3 hours at 40° C.

Thus, a photoreceptor of Example 50 was prepared.

Comparative Example 14

The procedure for preparation of the photoreceptor in Example 22 was repeated except that the outermost layer coating liquid was replaced with the following outermost layer coating liquid.

| | |
|---|---|
| Bisphenol Z-form polycarbonate (PANLITE TS-2050manufactured by Teijin Chemicals Ltd.) | 100 parts |
| Tetrahydrofuran | 533 parts |
| Cyclohexanone | 133 parts |

Thus, a photoreceptor of Comparative Example 14 was prepared.

Comparative Example 15

The procedure for preparation of the photoreceptor in Example 22 was repeated except that the outermost layer coating liquid was replaced with the following outermost layer coating liquid.

| | |
|---|---|
| Bisphenol Z-form polycarbonate (PANLITE TS-2050manufactured by Teijin Chemicals Ltd.) | 100 parts |
| Charge transport material having the above-mentioned formula (2) | 10 parts |
| Tetrahydrofuran | 587 parts |
| Cyclohexanone | 147 parts |

Thus, a photoreceptor of Comparative Example 15 was prepared.

Comparative Example 16

The procedure for preparation of the photoreceptor in Example 22 was repeated except that the outermost layer coating liquid was replaced with the following outermost layer coating liquid.

| | |
|---|---|
| Bisphenol Z-form polycarbonate (PANLITE TS-2050manufactured by Teijin Chemicals Ltd.) | 100 parts |
| Charge transport material having the above-mentioned formula (2) | 20 parts |
| Tetrahydrofuran | 640 parts |
| Cyclohexanone | 160 parts |

Thus, a photoreceptor of Comparative Example 16 was prepared.

Comparative Example 17

The procedure for preparation of the photoreceptor in Example 32 was repeated except that the outermost layer coating liquid was replaced with the following outermost layer coating liquid.

| | |
|---|---|
| Trimethylolpropane triacrylate (TMPTA, from Tokyo Kasei Kogyo Co., Ltd.) | 100 parts |
| Photopolymerization initiator (1-hydroxycyclohexyl phenyl ketone, IRGACURE I-184 from BASF Japan (Ciba Specialty Chemicals Corp.)) | 5 parts |
| Tetrahydrofuran | 533 parts |
| Cyclohexanone | 133 parts |

Thus, a photoreceptor of Comparative Example 17 was prepared.

Comparative Example 18

The procedure for preparation of the photoreceptor in Example 32 was repeated except that the outermost layer coating liquid was replaced with the following outermost layer coating liquid.

| | |
|---|---|
| Trimethylolpropane triacrylate (TMPTA, from Tokyo Kasei Kogyo Co., Ltd.) | 100 parts |
| Photopolymerization initiator (1-hydroxycyclohexyl phenyl ketone, IRGACURE I-184 from BASF Japan (Ciba Specialty Chemicals Corp.)) | 5 parts |
| Charge transport material having the above-mentioned formula (3) | 10 parts |
| Tetrahydrofuran | 587 parts |
| Cyclohexanone | 147 parts |

Thus, a photoreceptor of Comparative Example 18 was prepared.

Comparative Example 19

The procedure for preparation of the photoreceptor in Example 32 was repeated except that the outermost layer coating liquid was replaced with the following outermost layer coating liquid.

| | |
|---|---|
| Trimethylolpropane triacrylate (TMPTA, from Tokyo Kasei Kogyo Co., Ltd.) | 100 parts |
| Photopolymerization initiator (1-hydroxycyclohexyl phenyl ketone, IRGACURE I-184 from BASF Japan (Ciba Specialty Chemicals Corp.)) | 5 parts |
| Charge transport material having the above-mentioned formula (3) | 20 parts |
| Tetrahydrofuran | 640 parts |
| Cyclohexanone | 160 parts |

Thus, a photoreceptor of Comparative Example 19 was prepared.

Comparative Example 20

The procedure for preparation of the photoreceptor in Example 22 was repeated except that the outermost layer coating liquid was replaced with the following outermost layer coating liquid.

| | |
|---|---|
| Bisphenol Z-form polycarbonate (PANLITE TS-2050manufactured by Teijin Chemicals Ltd.) | 100 parts |
| Ga-doped zinc oxide (PAZET GK-40 with an average particle size of 32 nm from Hakusuitech Co., Ltd.) | 5.3 parts |
| Surfactant (BYK-P105 from BYK Chemie GmbH) | 0.3 parts |
| Tetrahydrofuran | 561 parts |
| Cyclohexanone | 140 parts |

Thus, a photoreceptor of Comparative Example 20 was prepared.

Comparative Example 21

The procedure for preparation of the photoreceptor in Example 22 was repeated except that the outermost layer coating liquid was replaced with the following outermost layer coating liquid.

| | |
|---|---|
| Bisphenol Z-form polycarbonate (PANLITE TS-2050manufactured by Teijin Chemicals Ltd.) | 100 parts |
| Ga-doped zinc oxide (PAZET GK-40 with an average particle size of 32 nm from Hakusuitech Co., Ltd.) | 11.1 parts |
| Surfactant (BYK-P105 from BYK Chemie GmbH) | 0.6 parts |
| Tetrahydrofuran | 593 parts |
| Cyclohexanone | 148 parts |

Thus, a photoreceptor of Comparative Example 21 was prepared.

Comparative Example 22

The procedure for preparation of the photoreceptor in Example 22 was repeated except that the outermost layer coating liquid was replaced with the following outermost layer coating liquid.

| | |
|---|---|
| Bisphenol Z-form polycarbonate (PANLITE TS-2050manufactured by Teijin Chemicals Ltd.) | 100 parts |
| Ga-doped zinc oxide (PAZET GK-40 with an average particle size of 32 nm from Hakusuitech Co., Ltd.) | 233.3 parts |
| Surfactant (BYK-P105 from BYK Chemie GmbH) | 11.7 parts |
| Tetrahydrofuran | 1,779 parts |
| Cyclohexanone | 444 parts |

Thus, a photoreceptor of Comparative Example 22 was prepared.

Comparative Example 23

The procedure for preparation of the photoreceptor in Example 32 was repeated except that the outermost layer coating liquid was replaced with the following outermost layer coating liquid.

| | |
|---|---|
| Trimethylolpropane triacrylate (TMPTA, from Tokyo Kasei Kogyo Co., Ltd.) | 100 parts |
| Photopolymerization initiator (1-hydroxycyclohexyl phenyl ketone, IRGACURE I-184 from BASF Japan (Ciba Specialty Chemicals Corp.)) | 5 parts |
| Ga-doped zinc oxide (PAZET GK-40 with an average particle size of 32 nm from Hakusuitech Co., Ltd.) | 5.3 parts |
| Surfactant (BYK-P105 from BYK Chemie GmbH) | 0.3 parts |
| Tetrahydrofuran | 561 parts |
| Cyclohexanone | 140 parts |

Thus, a photoreceptor of Comparative Example 23 was prepared.

Comparative Example 24

The procedure for preparation of the photoreceptor in Example 32 was repeated except that the outermost layer coating liquid was replaced with the following outermost layer coating liquid.

| | |
|---|---|
| Trimethylolpropane triacrylate (TMPTA, from Tokyo Kasei Kogyo Co., Ltd.) | 100 parts |
| Photopolymerization initiator (1-hydroxycyclohexyl phenyl ketone, IRGACURE I-184 from BASF Japan (Ciba Specialty Chemicals Corp.)) | 5 parts |
| Ga-doped zinc oxide (PAZET GK-40 with an average particle size of 32 nm from Hakusuitech Co., Ltd.) | 11.1 parts |
| Surfactant (BYK-P105 from BYK Chemie GmbH) | 0.6 parts |
| Tetrahydrofuran | 593 parts |
| Cyclohexanone | 148 parts |

Thus, a photoreceptor of Comparative Example 24 was prepared.

Comparative Example 25

The procedure for preparation of the photoreceptor in Example 32 was repeated except that the outermost layer coating liquid was replaced with the following outermost layer coating liquid.

| | |
|---|---|
| Trimethylolpropane triacrylate (TMPTA, from Tokyo Kasei Kogyo Co., Ltd.) | 100 parts |
| Photopolymerization initiator (1-hydroxycyclohexyl phenyl ketone, IRGACURE I-184 from BASF Japan (Ciba Specialty Chemicals Corp.)) | 5 parts |
| Ga-doped zinc oxide (PAZET GK-40 with an average particle size of 32 nm from Hakusuitech Co., Ltd.) | 233.3 parts |
| Surfactant (BYK-P105 from BYK Chemie GmbH) | 11.7 parts |
| Tetrahydrofuran | 1,779 parts |
| Cyclohexanone | 444 parts |

Thus, a photoreceptor of Comparative Example 25 was prepared.

Comparative Example 26

The procedure for preparation of the photoreceptor in Example 22 was repeated except that the outermost layer coating liquid was replaced with the following outermost layer coating liquid.

| | |
|---|---|
| Bisphenol Z-form polycarbonate (PANLITE TS-2050manufactured by Teijin Chemicals Ltd.) | 100 parts |
| Charge transport material having the above-mentioned formula (2) | 30 parts |
| Ga-doped zinc oxide (PAZET GK-40 with an average particle size of 32 nm from Hakusuitech Co., Ltd.) | 130 parts |
| Photopolymerization initiator (1-hydroxycyclohexyl phenyl ketone, IRGACURE I-184 from BASF Japan (Ciba Specialty Chemicals Corp.)) | 5 parts |
| Surfactant (BYK-P105 from BYK Chemie GmbH) | 6.5 parts |
| Tetrahydrofuran | 1,387 parts |
| Cyclohexanone | 347 parts |

Thus, a photoreceptor of Comparative Example 26 was prepared.

Comparative Example 27

The procedure for preparation of the photoreceptor in Example 22 was repeated except that the outermost layer coating liquid was replaced with the following outermost layer coating liquid.

| | |
|---|---|
| Bisphenol Z-form polycarbonate (PANLITE TS-2050manufactured by Teijin Chemicals Ltd.) | 100 parts |
| Charge transport material having the above-mentioned formula (2) | 40 parts |
| Ga-doped zinc oxide (PAZET GK-40 with an average particle size of 32 nm from Hakusuitech Co., Ltd.) | 140 parts |
| Photopolymerization initiator (1-hydroxycyclohexyl phenyl ketone, IRGACURE I-184 from BASF Japan (Ciba Specialty Chemicals Corp.)) | 5 parts |
| Surfactant (BYK-P105 from BYK Chemie GmbH) | 7.0 parts |
| Tetrahydrofuran | 1,493 parts |
| Cyclohexanone | 373 parts |

Thus, a photoreceptor of Comparative Example 27 was prepared.

Comparative Example 28

The procedure for preparation of the photoreceptor in Example 32 was repeated except that the outermost layer coating liquid was replaced with the following outermost layer coating liquid.

| | |
|---|---|
| Trimethylolpropane triacrylate (TMPTA, from Tokyo Kasei Kogyo Co., Ltd.) | 100 parts |
| Photopolymerization initiator (1-hydroxycyclohexyl phenyl ketone, IRGACURE 1-184 from BASF Japan (Ciba Specialty Chemicals Corp.)) | 5 parts |
| Charge transport material having the above-mentioned formula (3) | 30 parts |
| Ga-doped zinc oxide (PAZET GK-40 with an average particle size of 32 nm from Hakusuitech Co., Ltd.) | 130 parts |
| Surfactant (BYK-P105 from BYK Chemie GmbH) | 6.5 parts |
| Tetrahydrofuran | 1,387 parts |
| Cyclohexanone | 347 parts |

Thus, a photoreceptor of Comparative Example 28 was prepared.

Comparative Example 29

The procedure for preparation of the photoreceptor in Example 32 was repeated except that the outermost layer coating liquid was replaced with the following outermost layer coating liquid.

| | |
|---|---|
| Trimethylolpropane triacrylate (TMPTA, from Tokyo Kasei Kogyo Co., Ltd.) | 100 parts |
| Photopolymerization initiator (1-hydroxycyclohexyl phenyl ketone, IRGACURE I-184 from BASF Japan (Ciba Specialty Chemicals Corp.)) | 5 parts |
| Charge transport material having the above-mentioned formula (3) | 40 parts |
| Ga-doped zinc oxide (PAZET GK-40 with an average particle size of 32 nm from Hakusuitech Co., Ltd.) | 140 parts |
| Surfactant (BYK-P105 from BYK Chemie GmbH) | 7.0 parts |
| Tetrahydrofuran | 1,493 parts |
| Cyclohexanone | 373 parts |

Thus, a photoreceptor of Comparative Example 29 was prepared.

Comparative Example 30

The procedure for preparation of the photoreceptor in Example 22 was repeated except that the Al-doped zinc oxide in the outermost layer coating liquid was replaced with a zinc oxide (NANOTEK ZnO with an average particle size of 34 nm from C.I. KASEI CO., LTD.)

Thus, a photoreceptor of Comparative Example 30 was prepared.

Comparative Example 31

The procedure for preparation of the photoreceptor in Example 23 was repeated except that the Al-doped zinc oxide in the outermost layer coating liquid was replaced with a zinc oxide (NANOTEK ZnO with an average particle size of 34 nm from C.I. KASEI CO., LTD.)

Thus, a photoreceptor of Comparative Example 31 was prepared.

Comparative Example 32

The procedure for preparation of the photoreceptor in Example 24 was repeated except that the Al-doped zinc oxide in the outermost layer coating liquid was replaced with a zinc oxide (NANOTEK ZnO with an average particle size of 34 nm from C.I. KASEI CO., LTD.)

Thus, a photoreceptor of Comparative Example 32 was prepared.

Comparative Example 33

The procedure for preparation of the photoreceptor in Example 25 was repeated except that the Al-doped zinc oxide in the outermost layer coating liquid was replaced with a zinc oxide (NANOTEK ZnO with an average particle size of 34 nm from C.I. KASEI CO., LTD.)

Thus, a photoreceptor of Comparative Example 33 was prepared.

Comparative Example 34

The procedure for preparation of the photoreceptor in Example 32 was repeated except that the Al-doped zinc oxide in the outermost layer coating liquid was replaced with a zinc oxide (NANOTEK ZnO with an average particle size of 34 nm from C.I. KASEI CO., LTD.)

Thus, a photoreceptor of Comparative Example 34 was prepared.

Comparative Example 35

The procedure for preparation of the photoreceptor in Example 33 was repeated except that the Al-doped zinc oxide in the outermost layer coating liquid was replaced with a zinc oxide (NANOTEK ZnO with an average particle size of 34 nm from C.I. KASEI CO., LTD.)

Thus, a photoreceptor of Comparative Example 35 was prepared.

Comparative Example 36

The procedure for preparation of the photoreceptor in Example 34 was repeated except that the Al-doped zinc oxide in the outermost layer coating liquid was replaced with a zinc oxide (NANOTEK ZnO with an average particle size of 34 nm from C.I. KASEI CO., LTD.)

Thus, a photoreceptor of Comparative Example 36 was prepared.

Comparative Example 37

The procedure for preparation of the photoreceptor in Example 35 was repeated except that the Al-doped zinc oxide in the outermost layer coating liquid was replaced with a zinc oxide (NANOTEK ZnO with an average particle size of 34 nm from C.I. KASEI CO., LTD.)

Thus, a photoreceptor of Comparative Example 37 was prepared.

Comparative Example 38

The procedure for preparation of the photoreceptor in Example 32 was repeated except that the outermost layer coating liquid was replaced with the following outermost layer coating liquid.

| | |
|---|---|
| Trimethylolpropane triacrylate (TMPTA, from Tokyo Kasei Kogyo Co., Ltd.) | 100 parts |
| Photopolymerization initiator (1-hydroxycyclohexyl phenyl ketone, IRGACURE I-184 from BASF Japan (Ciba Specialty Chemicals Corp.)) | 5 parts |
| Particulate titanium oxide (NANOTEK $TiO_2$ with an average particle size of 36 nm from C. I. KASEI CO., LTD.) | 53.8 parts |
| Surfactant (BYK-P105 from BYK Chemie GmbH) | 2.7 parts |
| Tetrahydrofuran | 821 parts |
| Cyclohexanone | 205 parts |

Thus, a photoreceptor of Comparative Example 38 was prepared.

Comparative Example 39

The procedure for preparation of the photoreceptor in Example 32 was repeated except that the outermost layer coating liquid was replaced with the following outermost layer coating liquid.

| | |
|---|---|
| Trimethylolpropane triacrylate (TMPTA, from Tokyo Kasei Kogyo Co., Ltd.) | 100 parts |
| Photopolymerization initiator (1-hydroxycyclohexyl phenyl ketone, IRGACURE I-184 from BASF Japan (Ciba Specialty Chemicals Corp.)) | 5 parts |
| Particulate titanium oxide (NANOTEK $TiO_2$ with an average particle size of 36 nm from C. I. KASEI CO., LTD.) | 100 parts |
| Surfactant (BYK-P105 from BYK Chemie GmbH) | 5.0 parts |
| Tetrahydrofuran | 1,067 parts |
| Cyclohexanone | 267 parts |

Thus, a photoreceptor of Comparative Example 39 was prepared.

Comparative Example 40

The procedure for preparation of the photoreceptor in Comparative Example 38 was repeated except that the particulate titanium oxide in the outermost layer coating liquid was replaced with a particulate aluminum oxide (NANOTEK $Al_2O_3$ with an average particle size of 31 nm from C.I. KASEI CO., LTD.)

Thus, a photoreceptor of Comparative Example 40 was prepared.

Comparative Example 41

The procedure for preparation of the photoreceptor in Comparative Example 39 was repeated except that the particulate titanium oxide in the outermost layer coating liquid was replaced with a particulate aluminum oxide (NANOTEK $Al_2O_3$ with an average particle size of 31 nm from C.I. KASEI CO., LTD.)

Thus, a photoreceptor of Comparative Example 41 was prepared.

Comparative Example 42

The procedure for preparation of the photoreceptor in Comparative Example 38 was repeated except that the particulate titanium oxide in the outermost layer coating liquid was replaced with a particulate tin oxide (NANOTEK $SnO_2$ with an average particle size of 21 nm from C.I. KASEI CO., LTD.)

Thus, a photoreceptor of Comparative Example 42 was prepared.

Comparative Example 43

The procedure for preparation of the photoreceptor in Comparative Example 39 was repeated except that the particulate titanium oxide in the outermost layer coating liquid was replaced with a particulate tin oxide (NANOTEK $SnO_2$ with an average particle size of 21 nm from C.I. KASEI CO., LTD.)

Thus, a photoreceptor of Comparative Example 43 was prepared.

The materials used for the outermost layers of the thus prepared photoreceptors of Examples 22-50 and Comparative Examples 14-43 are listed in Tables 5 and 6 below.

TABLE 5

| | Materials used for the outermost layer | | | | | |
|---|---|---|---|---|---|---|
| | Essential components | | | | Other components | |
| | Resin having no charge transport-ability | Particulate inorganic material (zinc oxide doped with a thirteenth group element) | | | Surfactant | Charge transport material |
| | Material | Material | Content in the outermost layer (vol %) | Average primary particle diameter (nm) | Material | Material |
| Ex. 22 | Poly-carbonate resin | Al—ZnO | 8.8 | 35 | BYK P105 | — |
| Ex. 23 | ditto | ditto | 16.2 | 35 | ditto | — |
| Ex. 24 | ditto | ditto | 22.5 | 35 | ditto | — |
| Ex. 25 | ditto | ditto | 30.4 | 35 | ditto | — |
| Ex. 26 | ditto | Ga—ZnO | 8.8 | 30 | ditto | — |
| Ex. 27 | ditto | ditto | 16.2 | 30 | ditto | — |
| Ex. 28 | ditto | ditto | 22.5 | 30 | ditto | — |
| Ex. 29 | ditto | ditto | 30.4 | 30 | ditto | — |
| Ex. 30 | ditto | ditto | 24.2 | 30 | ditto | Compound having formula (2) (10 parts) |
| Ex. 31 | ditto | ditto | 25.9 | 30 | ditto | Ditto (20 parts) |
| Ex. 32 | Acrylic resin | Al—ZnO | 8.8 | 35 | ditto | — |
| Ex. 33 | ditto | ditto | 16.2 | 35 | ditto | — |
| Ex. 34 | ditto | ditto | 22.5 | 35 | ditto | — |
| Ex. 35 | ditto | ditto | 30.4 | 35 | ditto | — |
| Ex. 36 | ditto | Ga—ZnO | 8.8 | 30 | ditto | — |
| Ex. 37 | ditto | ditto | 16.2 | 30 | ditto | — |
| Ex. 38 | ditto | ditto | 22.5 | 30 | ditto | — |

TABLE 5-continued

| | | | | | | |
|---|---|---|---|---|---|---|
| Ex. 39 | ditto | ditto | 30.4 | 30 | ditto | — |
| Ex. 40 | ditto | ditto | 24.2 | 30 | ditto | Compound having formula (3) (10 parts) |
| Ex. 41 | ditto | ditto | 25.9 | 30 | ditto | Ditto (20 parts) |
| Ex. 42 | ditto | Al—ZnO | 22.5 | 150 | ditto | — |
| Ex. 43 | ditto | ditto | 22.5 | 150 | ditto | — |
| Ex. 44 | ditto | Ga—ZnO | 22.5 | 30 | ditto | — |
| Ex. 45 | ditto | ditto | 22.5 | 30 | ditto | — |
| Ex. 46 | Poly-arylate resin | ditto | 22.5 | 30 | ditto | — |
| Ex. 47 | Styrene resin | ditto | 22.5 | 30 | ditto | — |
| Ex. 48 | Phenolic resin | ditto | 22.5 | 30 | ditto | — |
| Ex. 49 | Urethane resin | ditto | 22.5 | 30 | ditto | — |
| Ex. 50 | Silicone resin | ditto | 22.5 | 30 | ditto | — |

TABLE 6

| | Materials used for the outermost layer | | | | | |
|---|---|---|---|---|---|---|
| | Essential components | | | | Other components | |
| | Resin having no charge transport-ability | Particulate inorganic material (zinc oxide doped with a thirteenth group element) | | | Surfactant | Charge transport material |
| | Material | Material | Content in the outermost layer (vol %) | Average primary particle diameter (nm) | Material | Material |
| Comp. Ex. 14 | Poly-carbonate resin | — | — | — | — | — |
| Comp. Ex. 15 | ditto | — | — | — | — | Compound having formula (2) (10 parts) |
| Comp. Ex. 16 | ditto | — | — | — | — | Ditto (20 parts) |
| Comp. Ex. 17 | Acrylic resin | — | — | — | — | — |
| Comp. Ex. 18 | ditto | — | — | — | — | Compound having formula (3) (10 parts) |
| Comp. Ex. 19 | ditto | — | — | — | — | Ditto (20 parts) |
| Comp. Ex. 20 | Poly-carbonate resin | Ga—ZnO | 1.5 | 30 | BYK P105 | — |
| Comp. Ex. 21 | ditto | ditto | 3.1 | 30 | ditto | — |
| Comp. Ex. 22 | ditto | ditto | 40.4 | 30 | ditto | — |
| Comp. Ex. 23 | Acrylic resin | ditto | 1.5 | 30 | ditto | — |
| Comp. Ex. 24 | ditto | ditto | 3.1 | 30 | ditto | — |
| Comp. Ex. 25 | ditto | ditto | 40.4 | 30 | ditto | — |

TABLE 6-continued

| | | | | | | |
|---|---|---|---|---|---|---|
| Comp. Ex. 26 | Poly-carbonate resin | ditto | 27.4 | 30 | ditto | Compound having formula (2) (30 parts) |
| Comp. Ex. 27 | ditto | ditto | 27.4 | 30 | ditto | Ditto (40 parts) |
| Comp. Ex. 28 | Acrylic resin | ditto | 27.4 | 30 | ditto | Compound having formula (3) (30 parts) |
| Comp. Ex. 29 | ditto | ditto | 27.4 | 30 | ditto | Ditto (40 parts) |
| Comp. Ex. 30 | Poly-carbonate resin | ZnO | 8.8 | 34 | ditto | — |
| Comp. Ex. 31 | ditto | ditto | 16.2 | 34 | ditto | — |
| Comp. Ex. 32 | ditto | ditto | 22.5 | 34 | ditto | — |
| Comp. Ex. 33 | ditto | ditto | 30.4 | 34 | ditto | — |
| Comp. Ex. 34 | Acrylic resin | ditto | 8.8 | 34 | ditto | — |
| Comp. Ex. 35 | ditto | ditto | 16.2 | 34 | ditto | — |
| Comp. Ex. 36 | ditto | ditto | 22.5 | 34 | ditto | — |
| Comp. Ex. 37 | ditto | ditto | 30.4 | 34 | ditto | — |
| Comp. Ex. 38 | ditto | $TiO_2$ | 17.0 | 36 | ditto | — |
| Comp. Ex. 39 | ditto | ditto | 27.6 | 36 | ditto | — |
| Comp. Ex. 40 | ditto | $Al_2O_3$ | 18.1 | 31 | ditto | — |
| Comp. Ex. 41 | ditto | ditto | 29.1 | 31 | ditto | — |
| Comp. Ex. 42 | ditto | $SnO_2$ | 11.0 | 21 | ditto | — |
| Comp. Ex. 43 | ditto | ditto | 18.6 | 21 | ditto | — |

Next, the surface resistivities R1, R3 and R15 of these photoreceptors were measured by the following methods.

1. Surface Resistivity R1

The surface resistivity R1 is the resistivity of a photoreceptor measured at an electric field strength of $1\times10^4$V/cm by the following method. Specifically, two parallel electrodes, each of which has a length of 10 mm and whose gap is 25 μm, were formed on the surface of a photoreceptor. Next, a bias was applied between the two electrodes to form an electric field of $1\times10^4$V/cm therebetween, and the current flowing between the electrodes was measured. The surface resistivity R1 of the photoreceptor was calculated from the current. In this regard, the surface resistivity R1 at three points of the surface of the photoreceptor, which are apart from the upper edge by 70 mm, 170 mm and 270 mm, was measured, and the three data were averaged to obtain the averaged surface resistivity R1, which is the surface resistivity R1 of the photoreceptor.

The measuring conditions were as follows.

Voltammeter used: Source Measure Unit type 2410 from Keithley Instruments Inc.

Metal of electrodes: Gold

Length of electrodes: 10 mm

Gap between electrodes: 25 μm

Measurement environment: 25° C. and 50% RH

Bias application time: 70 seconds (The surface resistivity is calculated from the current 60 seconds after the start of application of the bias.)

2. Surface Resistivity R3

The procedure for measuring the surface resistivity R1 was repeated except that the applied bias was changed so that the electric field strength becomes $3\times10^4$V/cm.

3. Surface Resistivity R15

The procedure for measuring the surface resistivity R1 was repeated except that the applied bias was changed so that the electric field strength becomes $1.5\times10^5$V/cm.

The results are shown in Tables 7 and 8 below.

TABLE 7

| | Properties of the outermost layer | | | | |
|---|---|---|---|---|---|
| | Surface resistivity (Ω/cm²) | | | | |
| | R1 | R3 | R15 | R1/R3 | R1/R15 |
| Ex. 22 | $1.54\times10^{14}$ | $1.15\times10^{14}$ | $1.19\times10^{11}$ | 1.3 | 772 |
| Ex. 23 | $9.11\times10^{13}$ | $7.59\times10^{13}$ | $6.73\times10^{10}$ | 1.2 | 1354 |
| Ex. 24 | $6.59\times10^{13}$ | $2.64\times10^{13}$ | $2.62\times10^{10}$ | 2.5 | 2518 |
| Ex. 25 | $4.46\times10^{13}$ | $7.82\times10^{12}$ | $1.13\times10^{10}$ | 5.7 | 3940 |
| Ex. 26 | $5.20\times10^{14}$ | $4.20\times10^{14}$ | $8.46\times10^{11}$ | 1.2 | 614 |
| Ex. 27 | $2.10\times10^{14}$ | $1.94\times10^{14}$ | $1.51\times10^{11}$ | 1.1 | 1390 |
| Ex. 28 | $1.90\times10^{14}$ | $1.03\times10^{14}$ | $7.54\times10^{10}$ | 1.8 | 519 |
| Ex. 29 | $1.01\times10^{14}$ | $4.28\times10^{13}$ | $2.78\times10^{10}$ | 2.4 | 3633 |
| Ex. 30 | $4.95\times10^{13}$ | $2.85\times10^{13}$ | $2.25\times10^{10}$ | 1.7 | 2200 |
| Ex. 31 | $2.18\times10^{13}$ | $1.18\times10^{13}$ | $1.01\times10^{10}$ | 1.8 | 2158 |
| Ex. 32 | $3.18\times10^{14}$ | $2.97\times10^{14}$ | $5.44\times10^{11}$ | 1.1 | 585 |
| Ex. 33 | $1.52\times10^{14}$ | $1.50\times10^{14}$ | $1.32\times10^{11}$ | 1.5 | 1154 |
| Ex. 34 | $8.77\times10^{13}$ | $3.05\times10^{13}$ | $3.99\times10^{10}$ | 2.9 | 2198 |
| Ex. 35 | $5.69\times10^{13}$ | $1.35\times10^{13}$ | $1.70\times10^{10}$ | 4.2 | 3350 |
| Ex. 36 | $4.38\times10^{14}$ | $3.88\times10^{14}$ | $8.61\times10^{11}$ | 1.1 | 509 |
| Ex. 37 | $1.96\times10^{14}$ | $1.65\times10^{14}$ | $1.70\times10^{11}$ | 1.2 | 1153 |
| Ex. 38 | $1.33\times10^{14}$ | $7.64\times10^{13}$ | $6.02\times10^{10}$ | 1.7 | 2210 |
| Ex. 39 | $9.87\times10^{13}$ | $3.87\times10^{13}$ | $2.60\times10^{10}$ | 2.6 | 3801 |
| Ex. 40 | $5.11\times10^{13}$ | $3.38\times10^{13}$ | $2.68\times10^{10}$ | 1.5 | 1906 |
| Ex. 41 | $2.89\times10^{13}$ | $1.54\times10^{13}$ | $1.44\times10^{10}$ | 1.9 | 2014 |

TABLE 7-continued

| | Properties of the outermost layer | | | | |
|---|---|---|---|---|---|
| | Surface resistivity (Ω/cm²) | | | | |
| | R1 | R3 | R15 | R1/R3 | R1/R15 |
| Ex. 42 | $7.88 \times 10^{14}$ | $5.40 \times 10^{14}$ | $9.82 \times 10^{11}$ | 1.5 | 803 |
| Ex. 43 | $9.15 \times 10^{14}$ | $4.36 \times 10^{14}$ | $6.14 \times 10^{11}$ | 2.1 | 1490 |
| Ex. 44 | $8.23 \times 10^{14}$ | $3.43 \times 10^{14}$ | $3.92 \times 10^{11}$ | 2.4 | 2101 |
| Ex. 45 | $7.73 \times 10^{14}$ | $2.42 \times 10^{14}$ | $3.99 \times 10^{11}$ | 3.2 | 1905 |
| Ex. 46 | $2.11 \times 10^{14}$ | $1.19 \times 10^{14}$ | $8.68 \times 10^{10}$ | 1.8 | 2432 |
| Ex. 47 | $2.27 \times 10^{14}$ | $1.24 \times 10^{14}$ | $8.06 \times 10^{10}$ | 1.8 | 2816 |
| Ex. 48 | $1.84 \times 10^{14}$ | $1.09 \times 10^{14}$ | $7.18 \times 10^{10}$ | 1.7 | 2564 |
| Ex. 49 | $4.84 \times 10^{14}$ | $2.83 \times 10^{14}$ | $1.97 \times 10^{11}$ | 1.7 | 2461 |
| Ex. 50 | $5.98 \times 10^{13}$ | $3.23 \times 10^{13}$ | $2.34 \times 10^{10}$ | 1.9 | 2554 |

TABLE 8

| | Properties of the outermost layer | | | | |
|---|---|---|---|---|---|
| | Surface resistivity (Ω/cm²) | | | | |
| | R1 | R3 | R15 | R1/R3 | R1/R15 |
| Comp. Ex. 14 | $7.54 \times 10^{15}$ | $1.01 \times 10^{16}$ | $7.25 \times 10^{15}$ | 0.8 | 1 |
| Comp. Ex. 15 | $6.59 \times 10^{14}$ | $5.94 \times 10^{14}$ | $3.21 \times 10^{13}$ | 1.1 | 21 |
| Comp. Ex. 16 | $1.48 \times 10^{14}$ | $1.37 \times 10^{14}$ | $2.80 \times 10^{12}$ | 1.1 | 53 |
| Comp. Ex. 17 | $5.49 \times 10^{15}$ | $6.78 \times 10^{15}$ | $5.44 \times 10^{15}$ | 0.8 | 1 |
| Comp. Ex. 18 | $3.88 \times 10^{14}$ | $3.70 \times 10^{14}$ | $2.46 \times 10^{13}$ | 1.1 | 16 |
| Comp. Ex. 19 | $7.54 \times 10^{14}$ | $6.28 \times 10^{14}$ | $1.59 \times 10^{13}$ | 1.2 | 48 |
| Comp. Ex. 20 | $1.85 \times 10^{15}$ | $1.89 \times 10^{15}$ | $1.68 \times 10^{13}$ | 1.0 | 11 |
| Comp. Ex. 21 | $9.14 \times 10^{14}$ | $8.70 \times 10^{14}$ | $1.42 \times 10^{13}$ | 1.1 | 64 |
| Comp. Ex. 22 | $3.95 \times 10^{12}$ | $2.21 \times 10^{11}$ | $6.42 \times 10^{8}$ | 17.9 | 6155 |
| Comp. Ex. 23 | $2.95 \times 10^{15}$ | $2.98 \times 10^{15}$ | $1.97 \times 10^{14}$ | 1.0 | 15 |
| Comp. Ex. 24 | $1.26 \times 10^{15}$ | $1.27 \times 10^{15}$ | $1.69 \times 10^{13}$ | 1.0 | 75 |
| Comp. Ex. 25 | $4.88 \times 10^{12}$ | $3.21 \times 10^{11}$ | $7.03 \times 10^{8}$ | 15.2 | 6945 |
| Comp. Ex. 26 | $8.52 \times 10^{12}$ | $6.50 \times 10^{12}$ | $1.09 \times 10^{11}$ | 1.3 | 75 |
| Comp. Ex. 27 | $7.19 \times 10^{11}$ | $4.92 \times 10^{11}$ | $7.90 \times 10^{9}$ | 1.5 | 91 |
| Comp. Ex. 28 | $7.33 \times 10^{12}$ | $5.73 \times 10^{12}$ | $1.14 \times 10^{11}$ | 1.3 | 64 |
| Comp. Ex. 29 | $5.85 \times 10^{11}$ | $4.03 \times 10^{11}$ | $6.59 \times 10^{9}$ | 1.5 | 89 |
| Comp. Ex. 30 | $1.02 \times 10^{14}$ | $7.61 \times 10^{13}$ | $1.10 \times 10^{11}$ | 1.3 | 928 |
| Comp. Ex. 31 | $7.43 \times 10^{13}$ | $4.40 \times 10^{13}$ | $4.01 \times 10^{10}$ | 1.7 | 1852 |
| Comp. Ex. 32 | $4.51 \times 10^{13}$ | $7.22 \times 10^{12}$ | $1.50 \times 10^{10}$ | 6.3 | 3000 |
| Comp. Ex. 33 | $2.88 \times 10^{13}$ | $1.82 \times 10^{12}$ | $6.23 \times 10^{9}$ | 15.8 | 4620 |
| Comp. Ex. 34 | $8.75 \times 10^{13}$ | $7.61 \times 10^{13}$ | $1.03 \times 10^{11}$ | 1.2 | 851 |
| Comp. Ex. 35 | $5.27 \times 10^{13}$ | $3.42 \times 10^{13}$ | $3.18 \times 10^{10}$ | 1.5 | 1658 |
| Comp. Ex. 36 | $3.48 \times 10^{13}$ | $7.60 \times 10^{12}$ | $1.19 \times 10^{10}$ | 4.6 | 2915 |
| Comp. Ex. 37 | $1.55 \times 10^{13}$ | $1.10 \times 10^{12}$ | $3.64 \times 10^{9}$ | 14.1 | 4257 |
| Comp. Ex. 38 | $7.88 \times 10^{13}$ | $5.97 \times 10^{13}$ | $4.91 \times 10^{10}$ | 1.3 | 1606 |
| Comp. Ex. 39 | $3.51 \times 10^{13}$ | $1.66 \times 10^{13}$ | $1.13 \times 10^{10}$ | 2.1 | 3112 |
| Comp. Ex. 40 | $8.47 \times 10^{14}$ | $7.56 \times 10^{14}$ | $6.32 \times 10^{11}$ | 1.1 | 1340 |
| Comp. Ex. 41 | $3.19 \times 10^{14}$ | $1.82 \times 10^{14}$ | $1.23 \times 10^{11}$ | 1.8 | 2604 |
| Comp. Ex. 42 | $5.52 \times 10^{14}$ | $3.81 \times 10^{14}$ | $3.61 \times 10^{11}$ | 1.5 | 1529 |
| Comp. Ex. 43 | $1.59 \times 10^{14}$ | $6.68 \times 10^{13}$ | $5.49 \times 10^{10}$ | 2.4 | 2894 |

It is clear form Tables 7 and 8 that the photoreceptors of Examples 22 to 50 have a relatively high surface resistivity of not less than $10^{13}$ Ω/cm² at the relatively low electric field strength of $1\times10^{4}$V/cm. In addition, the ratio R1/R3 of the photoreceptors of Examples 22 to 50 is not greater than 10. This means that the surface resistivity of the photoreceptors is very stable in a relatively low electric field strength range.

Although the photoreceptors of Comparative Examples 14-21, 23 and 24 have a relatively high surface resistivity of not less than $10^{13}$ Ω/cm² at the relatively low electric field strength of $1\times10^{4}$V/cm, the photoreceptors of Comparative Examples 22 and 25-29 have a relatively low surface resistivity at the relatively low electric field strength. The reason therefor is considered to be due to the contents of the particulate inorganic material and the charge transport material in the outermost layer. However, the ratio R1/R3 of these comparative photoreceptors is relatively small (i.e., the surface resistivity of the photoreceptors is stable in the relatively low electric field strength range) except for the photoreceptors of Comparative Examples 22, 25, 33 and 37. Since the ratio R1/R3 of the photoreceptors of Comparative Examples 22, 25, 33 and 37 is greater than 10, the surface resistivity of the photoreceptors is unstable in the relatively low electric field strength range.

Since the photoreceptors of Comparative Examples 30-43 do not include a zinc oxide doped with a thirteenth group element, the photoreceptors have a relatively high surface resistivity of not less than $10^{13}$ Ω/cm² at the relatively low electric field strength of $1\times10^{4}$V/cm, and the ratio R1/R3 thereof is almost the same as those of the photoreceptors of Examples 22-50.

The surface resistivity R15 of the photoreceptors of Examples 22-50 at the relatively high electric field strength of $1.5\times10^{5}$V/cm is 2 to 4 orders of magnitude less than the surface resistivity (R1 and R3) thereof at the relatively low electric field strength ($1\times10^{4}$V/cm and $3\times10^{4}$V/cm). In particular, as the content of a particulate inorganic material increases, the difference between the surface resistivity at the relatively low electric field strength and the surface resistivity at the relatively high electric field strength increases to about 4,000. This phenomenon is also observed for the photoreceptors including a relatively small amount of charge transport material (an amount of not greater than 20 parts by weight based on 100 parts by weight of the resin having no charge transportability). Namely, using a charge transport material in the above-mentioned range of content does not adversely affect the surface resistivity while enhancing the charge transport function of the photoreceptor.

In contrast, the photoreceptors of Comparative Examples 14-19 do not include a particulate inorganic material, and therefore the ratio R1/R15 of the comparative photoreceptors is relatively small compared with the ratio of the photoreceptors of Examples 22-50. Even when a charge transport material is included in the comparative photoreceptors, the ratio R1/R15 thereof is relatively small compared with the ratio of the photoreceptors of Examples 22-50.

Since the content of a particulate inorganic material in the outermost layers of the photoreceptors of Comparative Examples 20, 32, 23 and 24 is low, the ratio R1/R15 thereof is lower than the ratio of the photoreceptors of Examples 22-50. This means that the photoreceptors of Comparative Examples 20, 32, 23 and 24 have poor charge transportability at a high electric field strength.

The photoreceptors of Comparative Examples 22 and 25, which include a particulate inorganic material in a relatively large amount, the ratio R1/R15 becomes not less than 5,000. This means that since the content of a particulate inorganic material is high, the number of contact points of particles of the particulate inorganic material increases (i.e., the number of electroconductive paths increases), thereby decreasing the surface resistivity at the high electric field strength.

The photoreceptors of Comparative Examples 26-29 include both a particulate inorganic material and a charge transport material, wherein the content of the charge transport material is relatively high. These comparative photoreceptors have a relatively low surface resistivity at the low and high electric field strengths, and the ratio R1/R15 is not large.

The photoreceptors of Examples 22-50 and the photoreceptors of Comparative Examples 14-43 were evaluated with respect to the below-mentioned electric properties (potentials of a non-irradiated portion and an irradiated portion) and image qualities by using the following methods.

1. Method for Evaluating the Electric Properties

Each of the photoreceptors was subjected to a running test using a photoreceptor unit of an image forming apparatus (IMAGIO MP C5000 from Ricoh Co., Ltd.), which had been modified such that devices such as a cleaning blade are detached therefrom except for the charging unit. Specifically, each photoreceptor was set to the modified photoreceptor unit, and the photoreceptor unit was attached to the image forming apparatus to perform a running test including charging the photoreceptor, irradiating the charged photoreceptor with light, and repeating the charging and irradiating processes without feeding a recording material. In this running test, a charging roller was used as the charger, and a DC voltage on which an AC voltage is superimposed was applied to the photoreceptor, wherein the peak-to-peak voltage (Vpp) of the AC voltage was about 1.9 kV, the frequency f of the AC voltage was about 900 Hz, the voltage of the DC voltage was −650V, and the rotation speed of the photoreceptor was 230 mm/sec. In addition, the irradiating and developing conditions were such that a laser diode (LD) emitting light of 655 nm was used as the irradiator to form a solid image having an image area ratio of 100% on the photoreceptor. In this regard, it was previously determined that the fatigue of a photoreceptor subjected to this running test for about 2.5 hours corresponds to the fatigue of the photoreceptor subjected to a running test in which 100,000 copies of a test pattern having an image area ratio of 5% are produced under conditions of 550V in potential difference between the potential of the charged photoreceptor and the potential of the irradiated photoreceptor and 110 pF/cm$^2$ in capacitance of the photoreceptor. Therefore, the above-mentioned running test was performed for 2.5 hours.

2. Method for Evaluating the Image Qualities

Each photoreceptor was set to an image forming apparatus, IPSIO MP C5000 from Ricoh Co., Ltd., which had been modified such that the initial idling process is not performed, and three copies of a half tone image were continuously produced using a toner TYPE 27 for use in IMAGIO MP C5000, and an A-4 size recording paper, NBS RICOH MYPAPER from Ricoh Co., Ltd. In addition, after the photoreceptor was subjected to the running test mentioned above, three copies of the half tone image were also produced.

3. Evaluation of the Electric Properties

The initial surface potential of the photoreceptor was set to −650V, and the above-mentioned running test was performed while measuring the potential of the charged photoreceptor and the potential of the irradiated photoreceptor. The results are shown in Tables 9 and 10.

4. Evaluation of the Image Qualities

The three half tone images were visually observed optionally using a microscope to evaluate the reproducibility of dot images of the half tone images. Specifically, the half tone images were observed whether the dot images of the half tone images are satisfactorily reproduced and the half tone images have good image density. The results are also shown in Tables 9 and 10.

TABLE 9

| | Electric properties | | | | | | Image qualities | |
|---|---|---|---|---|---|---|---|---|
| | Potential of non-irradiated portion of photoreceptor | | | Potential of irradiated portion of photoreceptor | | | Initial | Image qualities after |
| | Vi (−V) | Vl (−V) | Vi − Vl | Vi (−V) | Vl (−V) | Vi − Vl | image qualities | running test |
| Ex. 22 | 650 | 650 | 0 | 90 | 125 | −35 | Good | Good |
| Ex. 23 | 645 | 645 | 0 | 80 | 115 | −35 | Good | Good |
| Ex. 24 | 645 | 640 | 5 | 75 | 105 | −30 | Good | Good |

TABLE 9-continued

| | Electric properties | | | | | | Image qualities | |
|---|---|---|---|---|---|---|---|---|
| | Potential of non-irradiated portion of photoreceptor | | | Potential of irradiated portion of photoreceptor | | | Initial | Image qualities after |
| | Vi (−V) | Vl (−V) | Vi − Vl | Vi (−V) | Vl (−V) | Vi − Vl | image qualities | running test |
| Ex. 25 | 650 | 655 | −5 | 70 | 95 | −25 | Good | Good |
| Ex. 26 | 650 | 655 | −5 | 75 | 80 | −5 | Good | Good |
| Ex. 27 | 645 | 645 | 0 | 75 | 80 | −5 | Good | Good |
| Ex. 28 | 655 | 650 | 5 | 70 | 70 | 0 | Good | Good |
| Ex. 29 | 640 | 640 | 0 | 65 | 65 | 0 | Good | Good |
| Ex. 30 | 645 | 640 | 5 | 90 | 95 | −5 | Good | Good |
| Ex. 31 | 645 | 650 | −5 | 85 | 85 | 0 | Good | Good |
| Ex. 32 | 655 | 655 | 0 | 80 | 105 | −25 | Good | Good |
| Ex. 33 | 660 | 655 | 5 | 75 | 100 | −25 | Good | Good |
| Ex. 34 | 650 | 650 | 0 | 70 | 90 | −20 | Good | Good |
| Ex. 35 | 650 | 655 | −5 | 70 | 90 | −20 | Good | Good |
| Ex. 36 | 655 | 660 | −5 | 65 | 70 | −5 | Good | Good |
| Ex. 37 | 645 | 645 | 0 | 65 | 70 | −5 | Good | Good |
| Ex. 38 | 645 | 640 | 5 | 60 | 60 | 0 | Good | Good |
| Ex. 39 | 640 | 635 | 5 | 60 | 60 | 0 | Good | Good |
| Ex. 40 | 650 | 655 | −5 | 75 | 80 | −5 | Good | Good |
| Ex. 41 | 645 | 645 | 0 | 75 | 75 | 0 | Good | Good |
| Ex. 42 | 650 | 650 | 0 | 115 | 140 | −25 | Good | Good |
| Ex. 43 | 650 | 650 | 0 | 105 | 125 | −20 | Good | Good |
| Ex. 44 | 645 | 640 | 5 | 65 | 65 | 0 | Good | Good |
| Ex. 45 | 650 | 650 | 0 | 70 | 70 | 0 | Good | Good |
| Ex. 46 | 650 | 645 | 5 | 90 | 95 | −5 | Good | Good |
| Ex. 47 | 655 | 665 | −10 | 90 | 95 | −5 | Good | Good |
| Ex. 48 | 650 | 655 | −5 | 80 | 80 | 0 | Good | Good |
| Ex. 49 | 655 | 665 | −10 | 70 | 75 | −5 | Good | Good |
| Ex. 50 | 650 | 655 | −5 | 75 | 75 | 0 | Good | Good |

Vi: Initial potential (i.e., potential before the running test)
Vl: Potential after the running test

TABLE 10

| | Electric properties | | | | | | Image qualities | |
|---|---|---|---|---|---|---|---|---|
| | Potential of non-irradiated portion of photoreceptor | | | Potential of irradiated portion of photoreceptor | | | Initial | Image qualities after |
| | Vi (−V) | Vl (−V) | Vi − Vl | Vi (−V) | Vl (−V) | Vi − Vl | image qualities | running test |
| Comp. Ex. 14 | 655 | — | — | 350 | — | — | —(*) | —(*) |
| Comp. Ex. 15 | 660 | — | — | 275 | — | — | —(*) | —(*) |
| Comp. Ex. 16 | 660 | — | — | 220 | — | — | —(*) | —(*) |
| Comp. Ex. 17 | 655 | — | — | 375 | — | — | —(*) | —(*) |
| Comp. Ex. 18 | 650 | — | — | 300 | — | — | —(*) | —(*) |
| Comp. Ex. 19 | 655 | — | — | 245 | — | — | —(*) | —(*) |
| Comp. Ex. 20 | 660 | 655 | 5 | 210 | 295 | −85 | Low density | Low density |
| Comp. Ex. 21 | 650 | 645 | 5 | 155 | 225 | −70 | Low density | Low density |
| Comp. Ex. 22 | 640 | 680 | −40 | 65 | 85 | −20 | Bad dot repro. | Very bad dot repro. |
| Comp. Ex. 23 | 660 | 655 | 5 | 225 | 300 | −75 | Low density | Low density |
| Comp. Ex. 24 | 655 | 655 | 0 | 170 | 230 | −60 | Low density | Low density |
| Comp. Ex. 25 | 640 | 685 | −45 | 55 | 70 | −15 | Bad dot repro. | Very bad dot repro. |
| Comp. Ex. 26 | 640 | 675 | −35 | 75 | 130 | −55 | Good | Low density |

TABLE 10-continued

| | Electric properties | | | | | | Image qualities | |
|---|---|---|---|---|---|---|---|---|
| | Potential of non-irradiated portion of photoreceptor | | | Potential of irradiated portion of photoreceptor | | | Initial | Image qualities after |
| | Vi (−V) | Vl (−V) | Vi − Vl | Vi (−V) | Vl (−V) | Vi − Vl | image qualities | running test |
| Comp. Ex. 27 | 645 | 700 | −55 | 70 | 130 | −60 | Bad dot repro. | Very bad dot repro. |
| Comp. Ex. 28 | 640 | 675 | −35 | 65 | 115 | −50 | Good | Low density |
| Comp. Ex. 29 | 640 | 690 | −50 | 60 | 115 | −55 | Bad dot repro. | Very bad dot repro. |
| Comp. Ex. 30 | 650 | 650 | 0 | 90 | 155 | −65 | Good | Low density |
| Comp. Ex. 31 | 645 | 645 | 0 | 80 | 145 | −65 | Good | Low density |
| Comp. Ex. 32 | 645 | 640 | 5 | 75 | 135 | −60 | Good | Low density |
| Comp. Ex. 33 | 650 | 655 | −5 | 70 | 125 | −55 | Low density | Bad dot repro. |
| Comp. Ex. 34 | 650 | 655 | −5 | 85 | 150 | −65 | Good | Low density |
| Comp. Ex. 35 | 650 | 650 | 0 | 80 | 140 | −60 | Good | Low density |
| Comp. Ex. 36 | 645 | 640 | 5 | 80 | 140 | −60 | Good | Low density |
| Comp. Ex. 37 | 650 | 650 | 0 | 75 | 125 | −50 | Low density | Bad dot repro. |
| Comp. Ex. 38 | 645 | 655 | −10 | 85 | 160 | −75 | Good | Low density |
| Comp. Ex. 39 | 655 | 665 | −10 | 80 | 140 | −60 | Good | Low density |
| Comp. Ex. 40 | 650 | 655 | −5 | 95 | 155 | −60 | Good | Low density |
| Comp. Ex. 41 | 650 | 650 | 0 | 95 | 145 | −50 | Good | Low density |
| Comp. Ex. 42 | 645 | 670 | −25 | 85 | 150 | −65 | Good | Low density |
| Comp. Ex. 43 | 655 | 695 | −40 | 90 | 150 | −60 | Good | Low density |

Vi: Initial potential (i.e., potential before the running test)

Vl: Potential after the running test

Low density: Low density images were formed.

Bad dot repro.: The images had bad dot reproducibility.

Very bad dot repro.: The images had very bad dot reproducibility.

(*): Since abnormal sounds were generated in the running test, the running test was discontinued.

It is clear from Tables 9 and 10 that the potential differences (Vi−Vl) of the non-irradiated portion and the irradiated portion of the photoreceptors of Examples 22-50 was small in the running test, i.e., the photoreceptors had good electric properties. Among these photoreceptors, photoreceptors including an Al-doped zinc oxide or a Ga-doped zinc oxide have good stability in irradiated portion potential, and particularly the photoreceptors including a Ga-doped zinc oxide have excellent stability in irradiated portion potential. The photoreceptors including a Ga-doped zinc oxide have little variations in potential of the non-irradiated portion and the irradiated portion. The reason therefor is considered to be as follows. Since zinc oxide itself includes many oxygen losses on the surface thereof due to great bulk of the particles, zinc oxide is easily oxidized in the atmosphere, and thereby the resistivity of zinc oxide is easily changed. However, when zinc oxide is doped with a thirteenth group element to compensate for the oxygen losses, the stability of zinc oxide in the atmosphere can be enhanced. Therefore, photoreceptors including zinc oxide doped with a thirteenth group element have good stability in potential of the irradiated portion and non-irradiated portion. Among the thirteenth group elements, Ga is not easily oxidized in the atmosphere, and therefore photoreceptors including a Ga-doped zinc oxide have excellent potential stability.

Since abnormal sounds were generated in the running tests using the photoreceptors of Comparative Examples 14-19, the running tests were discontinued. The reason therefor is considered to be that since increase in irradiated portion potential is large, the mount of the toner supplied to the photoreceptor decreases in the running test, and thereby abnormal sounds are generated in the developing device of the image forming apparatus.

Although variation of the photoreceptors of Comparative Examples 20, 21, 23 and 24 in charging properties is not so large, the irradiated portion potential is high even before the running test, and increases relatively largely as the running test proceeds. This is because the photoreceptors have a relatively high surface resistivity at the high electric field strength, and therefore have insufficient charge transportability. Therefore, it is considered that as the photoreceptors are used, the charge transportability thereof largely decreases. Particularly, the photoreceptor of Comparative Example 10, which has a surface resistivity of not lower than $10^{14}$ Ω/cm$^2$ at the electric field strength of $1.5\times10^5$V/cm, has a very large irradiated-portion potential, and therefore the image density seriously decreases. In addition, the photoreceptor has large difference between the irradiated-portion potentials before and after the running test and large difference between the non-irradiated-portion potentials before and after the running test, namely, the photoreceptor has poor potential stability.

Although the non-irradiated-portion potential and the irradiated-portion potential of the photoreceptors of Comparative Examples 22 and 25 are relatively low before the running test, the potentials vary largely and increase as the running test proceeds. The reason therefor is considered to be that since the content of the particulate inorganic material in the outermost layer is very high, the number of contact points of particles of the particulate inorganic material increases, and thereby charge traps are formed in the outermost layer. These photoreceptors have a relatively low surface resistivity at the relatively low electric field strengths, and produce images with bad dot reproducibility before the running test. At the end of the running test, the photoreceptors produce images with very bad dot reproducibility. The photoreceptors of Comparative Examples 26 and 28 include a charge transport material in a large amount, but can produce images with good dot reproducibility before the running test. However, the non-irradiated-portion potential and the irradiated-portion potential before and after the running test largely change, and low density images are produced after the running test. The reason therefor is considered to be that the charge transport material used therefor deteriorates as the running test proceeds.

The photoreceptors of Comparative Examples 27 and 29 include a charge transport material in a larger amount than the photoreceptors of Comparative Examples 13 and 15. Therefore, the photoreceptors produce images with bad dot reproducibility even before the running test. In addition, the non-irradiated-portion potential and the irradiated-portion potential before and after the running test largely change, and therefore images in which dot images are hardly reproduced are produced by the photoreceptors. The reason therefor is considered to be that the charge transport material used for the outermost layer deteriorates as the running test proceeds, thereby decreasing the surface resistivity of the outermost layer while forming charge traps therein, resulting in formation of images with very bad dot reproducibility.

The photoreceptors of Comparative Examples 30-32, 34-36 and 38-48, which include a zinc oxide including no thirteenth group element or another metal oxide, have a good surface resistivity as described in Table 8. However, change in the non-irradiated-portion potential and the irradiated-portion potential in the comparative photoreceptors before and after the running test is much larger than that in the photoreceptors of Examples 22-50. In addition, low density images are produced after the running test, because the irradiated-portion potential increases as the running test proceeds.

The photoreceptors of Comparative Examples 33 and 37 produce low density images even before the running test, and produce images with bad dot reproducibility after the running test. The reason therefor is considered to be that the surface resistivity stability (i.e., the ratio R1/R3) in the low electric field strength range is bad even before the running test, and the surface resistivity seriously decreases as the running test proceeds, thereby deteriorating the dot reproducibility.

It is clear from these results that even when the photoreceptor of this disclosure is subjected to a long running test, the photoreceptor can maintain excellent charge transportability and electrostatic latent image maintainability. Therefore, by using the photoreceptor of this disclosure, high quality images can be produced over a long period of time.

Next, abrasion resistance of the photoreceptors of Examples 32 to 45 was evaluated by the following method.

Specifically, a running test was performed using an image forming apparatus IMAGIO MP C5000 from Ricoh Co., Ltd., which had been modified such that a lubricant bar to be applied to the surface of the photoreceptor is detached from the process cartridge of the image forming apparatus so that the surface of the photoreceptor is not coated with a lubricant. The running test was performed under the following conditions.

1. Toner used: IMAGIO TONER TYPE 27 from Ricoh Co., Ltd.
2. Recording medium used: NBS RICOH MYPAPER from Ricoh Co., Ltd. (A-4 size)
3. Initial surface potential of the photoreceptor: −650V
4. Image to be copied: Image of a test chart with an image area proportion of 5%
5. Number of copies produced: 100,000 copies The thickness of the photoreceptor was measured before and after the running test to determine the abrasion loss (thickness) of the photoreceptor.

The reason why the photoreceptors of Examples 32 to 45 were used is that the photoreceptors have an outermost layer including a crosslinked resin as the resin having no charge transportability, and have relatively small variation in the non-irradiated-portion potential and the irradiated-portion potential even when the photoreceptors are subjected to the running test mentioned above.

The results are shown in Table 11 below.

In addition, the universal hardness and the elastic work of the photoreceptors were also measured by the following methods.

1. Measurements of Universal Hardness

The universal hardness of five points of each photoreceptor was measured under the below-mentioned conditions, and the five data of the universal hardness were averaged to determine the universal hardness of the photoreceptor.

Instrument used: FISCHER SCOPE H-100 from Fischer Instruments K.K.

Software: WIN-HCU from Fischer Instruments K.K.
Maximum load: 1 mN
Load application time: 30 seconds
Load increasing rate: 1 mN/30 seconds
Creep at the maximum load: 5 seconds
Load decreasing rate: 1 mN/30 seconds
Creep after removing load: 5 seconds
Indenter: SMC117

2. Measurements of Elastic Work

The elastic work was measured by the method mentioned above for use in measuring the universal hardness. The elastic work (EW) was calculated from the following equation 1:

$$EW\ (\%)=100\times(MD-PD)/MD \qquad \text{equation 1,}$$

wherein MD represents the maximum displacement, and PD represents the plastic displacement.

The results are also shown in Table 11 below.

TABLE 11

| | Evaluation of properties of outermost layer | | Evaluation of abrasion resistance of photoreceptor | |
|---|---|---|---|---|
| | Universal hardness ($N/mm^2$) | Elastic work (%) | Abrasion loss (μm) | Surface state of photoreceptor |
| Ex. 32 | 265.3 | 56.2 | 1.9 | No material was adhered thereto. |
| Ex. 33 | 274.6 | 58.4 | 1.6 | ditto |
| Ex. 34 | 291.3 | 60.2 | 1.3 | ditto |
| Ex. 35 | 304.2 | 61.6 | 1.1 | ditto |
| Ex. 36 | 263.3 | 57.3 | 1.7 | ditto |
| Ex. 37 | 278.9 | 58.9 | 1.4 | ditto |
| Ex. 38 | 298.5 | 60.6 | 1.1 | ditto |
| Ex. 39 | 311.8 | 62.1 | 0.9 | ditto |
| Ex. 40 | 275.1 | 54.3 | 1.5 | Material was slightly adhered thereto. |
| Ex. 41 | 260.9 | 51.1 | 3.1 | Material was adhered thereto. |
| Ex. 42 | 262.1 | 56.1 | 2.2 | No material was adhered thereto. |
| Ex. 43 | 276.8 | 59.1 | 2.1 | ditto |
| Ex. 44 | 230.2 | 52.7 | 3.1 | Material was slightly adhered thereto. |
| Ex. 45 | 190.5 | 48.3 | 6.2 | Material was adhered thereto. |

The photoreceptors of Examples 32-39, 42 and 43 have good abrasion resistance and there is no material adhered to the surface of the photoreceptors when the photoreceptors are subjected to a running test. Since the photoreceptors have good electric properties as described in Table 9, it is clear that the photoreceptors have good durability. In contrast, the photoreceptor of Example 40 has good abrasion resistance, but a white material is slightly adhered to the surface of the photoreceptor. The photoreceptor of Example 41 is inferior to the photoreceptor of Example 40 in abrasion resistance, and a relatively large amount of material is adhered to the surface of the photoreceptor. The reason therefor is considered to be that since a compound having a charge transport structure is included in the outermost layer, the crosslinkage density of the layer deteriorates, thereby deteriorating the hardness and elastic work of the photoreceptor. Similarly, the photoreceptors of Examples 44 and 45 are inferior to the photoreceptors of Examples 32-39, 42 and 43 in abrasion resistance, and a material is adhered to the surface of the photoreceptors. The reason therefor is the same as that mentioned above for the photoreceptor 41. Particularly, the entire outermost layer of the photoreceptor of Example 45 is lost in the running test.

It is found from these results that when a photoreceptor has an outermost layer, which includes a crosslinked resin having no charge transportability and which has a universal hardness of not less than 250 $N/mm^2$, a material is hardly adhered to the surface of the photoreceptor. In addition, it is found that when the outermost layer of a photoreceptor has an elastic work of not less than 50%, the photoreceptor has good abrasion resistance, and when the elastic work is not less than 55%, the photoreceptor has excellent abrasion resistance.

In the cleaner of this disclosure, both the first and second side surfaces of the cleaning blade, which are located with the edge therebetween, are contacted with the surface of a member to be cleaned, and the edge portion of the cleaning blade is not largely deformed. Therefore, increase in area of the contact portion of the edge portion with the surface of the member to be cleaned can be prevented, thereby increasing the contact pressure of the cleaning blade to the member, resulting in enhancement of the cleaning ability of the cleaner.

Additional modifications and variations of the present invention are possible in light of the above teachings. It is therefore to be understood that within the scope of the appended claims the invention may be practiced other than as specifically described herein.

What is claimed is:

1. A cleaner comprising:

a cleaning blade having an edge configured to contact a surface of a member to be cleaned while moving relative to the member to clean the surface of the member, wherein the cleaning blade includes:

the edge; and a first side surface; and a second side surface, wherein the edge is disposed between the first and second side surfaces, and is deformed to create a deformed edge so that portions of the first and second side surfaces contact the surface of the member at a same time and to avoid a formation of a wedge-shaped portion, and wherein when the cleaning blade is not in contact with the surface of the member to be cleaned, the first side surface is opposed to the surface of the member to be cleaned, and when the cleaning blade is in contact with the surface of the member to be cleaned, the edge, and the first and second side surfaces of the cleaning blade contact the surface of the member to be cleaned.

2. The cleaner according to claim 1, wherein the cleaning blade includes:

an edge layer, wherein a surface of the edge layer serves as the first side surface, another surface of the edge layer serves as at least part of the second side surface, and an edge of the edge layer serves as the edge of the cleaning blade; and a second layer located on the edge layer, wherein the edge layer has a higher hardness than the second layer.

3. The cleaner according to claim 2, wherein the edge layer has a 100% modulus value of from 6 MPa to 12 MPa at 23° C.

4. The cleaner according to claim 2, wherein the edge layer is formed of a material having a tan δ peak temperature of lower than 10° C.

5. The cleaner according to claim 2, wherein the second layer is formed of a material having a tan δ peak temperature of lower than 10° C.

6. A process cartridge comprising:

an image bearing member to bear an electrostatic latent image on a surface thereof;

a charger to charge the surface of the image bearing member;

a developing device to develop the electrostatic latent image with toner to form a toner image on the surface of the image bearing member; and the cleaner according to claim 1 to clean the surface of the image bearing member, wherein the process cartridge is detachably attachable to an image forming apparatus as a unit.

7. The process cartridge according to claim 6, wherein the surface of the image bearing member that contacts the cleaner includes a particulate inorganic material.

8. The process cartridge according to claim 6, further comprising:

a protective agent applicator to apply a protective agent including a fatty acid metal salt and an inorganic lubricant to the surface of the image bearing member to be contacted with the cleaner.

9. The process cartridge according to claim 8, wherein the protective agent applicator is located on a downstream side from the cleaning blade relative to a moving direction of the image bearing member.

10. The process cartridge according to claim 6, wherein the toner includes a lubricant including a fatty acid metal salt.

11. An image forming apparatus comprising:

an image bearing member to bear a toner image on a surface thereof;

a transferring device to transfer the toner image onto a recording medium; and the cleaner according to claim 1 to clean the surface of the image bearing member after the toner image on the image bearing member is transferred to the recording medium.

12. The image forming apparatus according to claim 11, wherein the image bearing member is a photoreceptor including:

an electroconductive support;

a photosensitive layer located overlying the electroconductive support;

an outermost layer located overlying the photosensitive layer and including a resin having no charge transport structure, and a particulate inorganic material, and wherein the outermost layer has a surface resistivity R1 of not less than $10^{13}$ Ω/cm$^2$ at an electric field strength of $1\times10^4$V/cm, and a ratio R1/R15 of the surface resistivity R1 to a surface resistivity R15 of the outermost layer, which is measured at an electric field strength of $1.5\times10^5$V/cm, is from 100 to 5,000.

13. The image forming apparatus according to claim 12, wherein a ratio R1/R3 of the surface resistivity R1 to a surface resistivity R3 of the outermost layer, which is measured at an electric field strength of $3\times10^4$V/cm, is from 0.1 to 10.

14. The image forming apparatus according to claim 12, wherein the resin having no charge transport structure in the outermost layer is a crosslinked resin, and wherein the outermost layer has a universal hardness of not less than 250 N/mm$^2$.

15. The cleaner according to claim 1, wherein the deformed edge is a continuous surface of the edge of the cleaning blade.

16. The cleaner according to claim 1, wherein the deformed edge is a protrusion that extends beyond a surface of the edge of the cleaning blade.

17. The cleaner according to claim 1, wherein a material of the deformed edge has a 100% modulus value of from 6 MPa to 12 MPa and has a high hardness.

18. The cleaner according to claim 1, wherein the cleaning blade includes an edge layer and a backup layer, the backup layer is made of an elastic material having lower hardness than the edge layer.

19. The cleaner according to claim 18, wherein the edge layer has a material made up of 100% modules value at 23° C. of from 6 to 7 MPa and the backup layer has a material made up of 100% modulus value at 23° C. of from 4 to 5 MPa.

20. The cleaner according to claim 18, wherein the edge layer has a thickness of approximately 0.5 mm and the backup layer has a thickness of approximately 1.3 mm.

* * * * *